US010464740B2

(12) United States Patent
DiSorbo

(10) Patent No.: US 10,464,740 B2
(45) Date of Patent: Nov. 5, 2019

(54) MODULAR SHIPPING APPARATUS AND SYSTEM

(71) Applicant: Cargo Cube Systems, LLC, Tamarac, FL (US)

(72) Inventor: Aldo DiSorbo, Davie, FL (US)

(73) Assignee: CARGO CUBE SYSTEMS, LLC

( * ) Notice: Subject to any disclaimer, the term of this patent is extended or adjusted under 35 U.S.C. 154(b) by 270 days.

(21) Appl. No.: 15/493,563

(22) PCT Filed: Aug. 24, 2016

(86) PCT No.: PCT/US2016/048266
§ 371 (c)(1),
(2) Date: Apr. 21, 2017

(87) PCT Pub. No.: WO2017/065873
PCT Pub. Date: Apr. 20, 2017

(65) Prior Publication Data

US 2017/0247180 A1 Aug. 31, 2017

Related U.S. Application Data

(63) Continuation of application No. 14/973,830, filed on Dec. 18, 2015, now Pat. No. 9,499,334, which is a
(Continued)

(51) Int. Cl.
*B65D 88/12* (2006.01)
*B65D 90/00* (2006.01)
(Continued)

(52) U.S. Cl.
CPC ..... *B65D 88/12* (2013.01); *B65D 90/008* (2013.01); *B65D 90/0066* (2013.01);
(Continued)

(58) Field of Classification Search
CPC ..... B65D 88/00; B65D 88/005; B65D 88/02; B65D 88/022; B65D 88/027; B65D 88/10;
(Continued)

(56) References Cited

U.S. PATENT DOCUMENTS 1,693,607 A * 12/1928 Kellett ..... B60P 7/13 105/159
2,172,154 A * 9/1939 Perin ..... B60P 7/13 220/1.5
(Continued)

FOREIGN PATENT DOCUMENTS

CA 2144886 9/1996
DE 25 01 414 7/1975

*Primary Examiner* — Steven A. Reynolds
*Assistant Examiner* — Javier A Pagan
(74) *Attorney, Agent, or Firm* — Jennifer Meredith, Esq.; Meredith Attorneys, PLLC

(57) ABSTRACT

A modular shipping container apparatus having a base with two support portions each of having two substantially open top rectangular shaped spaces each having a bottom side, a left side and a right side and at least one set of base holes; at least one wheel assembly between the two substantially open top rectangular shaped spaces, the at least one wheel assembly having a substantially open bottom rectangular piece with at least one set of wheel assembly holes and at least one wheel with a center opening, the wheel assembly is retained between the two substantially open top rectangular shaped spaces by at least one bar through the at least one set of base holes, the at least one set of wheel assembly holes and the wheels; at least two tracks attached to the bottom interior of a shipping container for slidably receiving the at least one wheel assemblies.

15 Claims, 60 Drawing Sheets

Related U.S. Application Data continuation of application No. 15/493,563, and a continuation-in-part of application No. 14/414,473, filed as application No. PCT/US2015/011088 on Jan. 13, 2015, now Pat. No. 9,988,206, and a continuation of application No. 14/361,280, filed on May 28, 2014, now Pat. No. 9,868,589, which is a continuation of application No. PCT/US2014/034186, filed on Apr. 15, 2014, and a continuation of application No. 14/242,998, filed on Apr. 2, 2014, now Pat. No. 9,908,723.

(60) Provisional application No. 62/241,263, filed on Oct. 14, 2015, provisional application No. 61/927,957, filed on Jan. 15, 2014.

(51) Int. Cl.
*B65D 90/02* (2019.01)
*B65D 90/18* (2006.01)
*B65D 90/20* (2006.01)

(52) U.S. Cl.
CPC ..... *B65D 90/02* (2013.01); *B65D 90/18* (2013.01); *B65D 90/20* (2013.01)

(58) Field of Classification Search
CPC .... B65D 88/12; B65D 88/121; B65D 88/127; B65D 88/128; B65D 88/129; B65D 90/004; B65D 90/006; B65D 90/0066; B65D 90/0073; B65D 90/008; B65D 90/02; B65D 90/023; B65D 90/08; B65D 90/18
See application file for complete search history.

(56) References Cited

U.S. PATENT DOCUMENTS

| | | | | |
|---|---|---|---|---|
| 2,287,886 | A | 6/1942 | Kellett | |
| 2,858,774 | A | 11/1958 | Lee | |
| 2,988,036 | A | 6/1961 | Mooneyhan | |
| 3,169,652 | A | 2/1965 | Ewell | |
| 3,315,826 | A | 4/1967 | Gardner | |
| 3,722,705 | A | 3/1973 | Gould | |
| 3,735,884 | A | 5/1973 | Klett | |
| 3,779,406 | A | 12/1973 | Hermann | |
| 3,854,544 | A * | 12/1974 | Kolchev | B62B 3/02 180/14.1 |
| 3,866,539 | A | 2/1975 | Gasser | |
| 3,982,639 | A | 9/1976 | Haldimann | |
| 4,130,208 | A | 12/1978 | Barry | |
| 4,231,695 | A * | 11/1980 | Weston, Sr. | B60P 1/52 277/590 |
| 4,273,217 | A | 6/1981 | Kajita | |
| 4,344,368 | A | 8/1982 | Remington | |
| 4,421,186 | A | 12/1983 | Bradley | |
| 4,537,554 | A | 8/1985 | Collins | |
| 4,640,657 | A | 2/1987 | Moore | |
| 4,699,337 | A | 10/1987 | Lewis | |
| 4,747,504 | A * | 5/1988 | Wiseman | B65D 88/14 220/1.5 |
| 4,770,589 | A | 9/1988 | Bryan | |
| 4,976,365 | A | 12/1990 | Seo | |
| 5,054,295 | A | 10/1991 | Goulooze | |
| 6,485,239 | B2 | 11/2002 | Afful | |
| 6,622,854 | B2 | 9/2003 | Coblentz | |
| 6,824,338 | B2 * | 11/2004 | Looker | B60P 7/13 410/67 |
| 7,482,928 | B2 | 1/2009 | Brackmann | |
| 7,686,550 | B2 | 3/2010 | Mix | |
| 8,353,388 | B2 | 1/2013 | Rice | |
| 8,474,223 | B2 | 7/2013 | Lancaster | |
| 8,718,372 | B2 | 5/2014 | Holeva | |
| 9,056,577 | B2 | 6/2015 | Corrigan | |
| 9,499,334 | B2 * | 11/2016 | DiSorbo | B65D 88/12 |
| 9,988,206 | B2 * | 6/2018 | DiSorbo | B60P 1/52 |
| 2005/0226706 | A1 | 10/2005 | Thomas | |
| 2008/0211669 | A1 * | 9/2008 | Dagher | B65D 90/022 340/561 |
| 2009/0202330 | A1 | 8/2009 | Hamather | |
| 2010/0091094 | A1 | 4/2010 | Sekowski | |
| 2010/0147841 | A1 | 6/2010 | Reynard | |
| 2010/0147842 | A1 * | 6/2010 | Reynard | B65D 88/022 220/23.88 |
| 2011/0234389 | A1 | 9/2011 | Mellin | |
| 2012/0177467 | A1 | 7/2012 | Corrigan | |
| 2012/0205943 | A1 | 8/2012 | Nelson | |
| 2015/0053691 | A1 * | 2/2015 | Sanger | B65D 19/44 220/544 |
| 2015/0117997 | A1 | 4/2015 | Grady | |
| 2015/0129444 | A1 * | 5/2015 | Witczak | B65D 85/66 206/389 |
| 2016/0055506 | A1 | 2/2016 | Tama | |

* cited by examiner

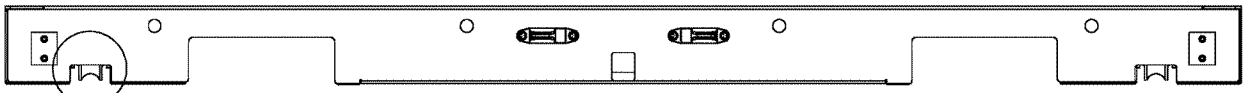
FIGURE 39
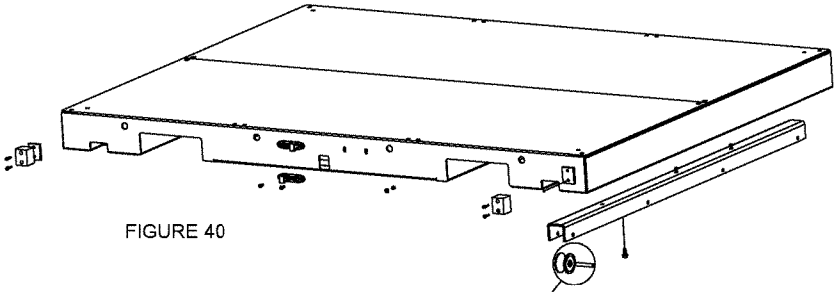
FIGURE 40
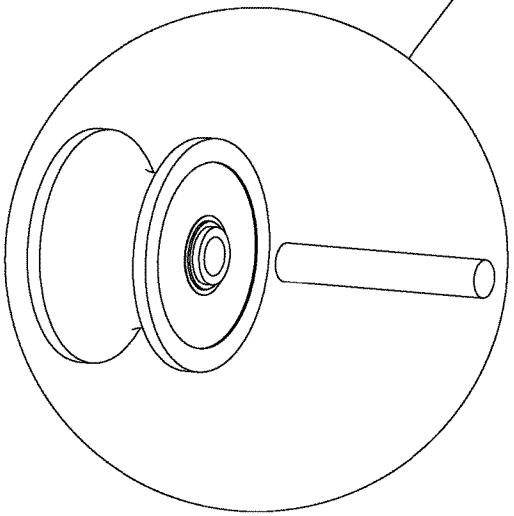
DETAIL B
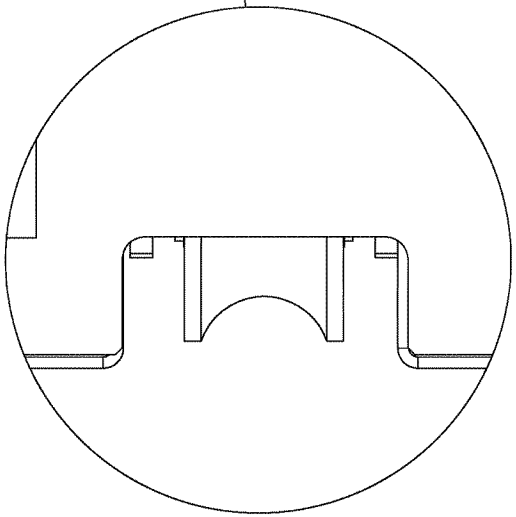
DETAIL A

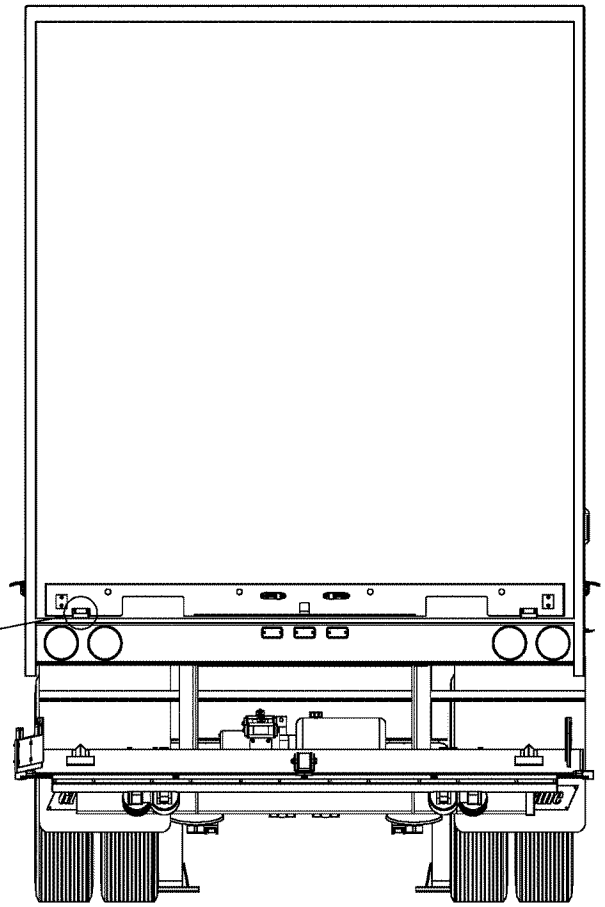
FIGURE 42
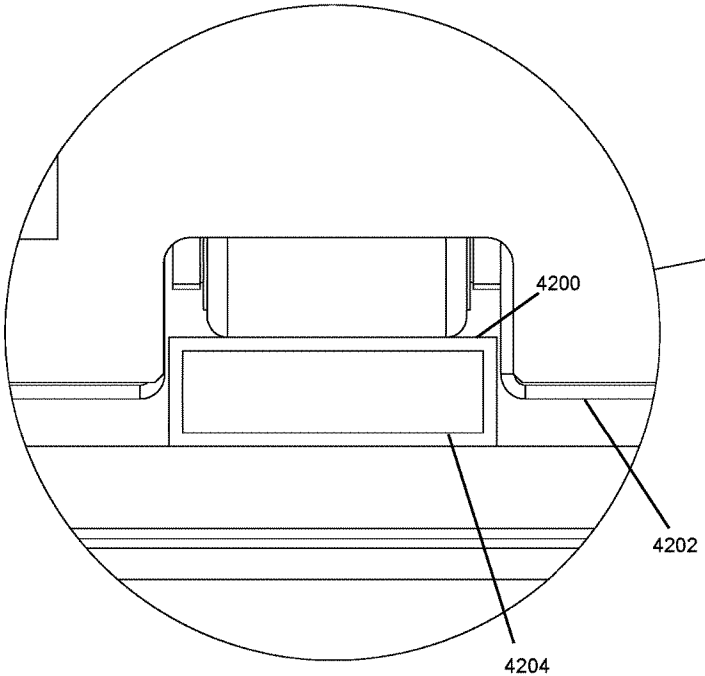
DETAIL A

DETAIL A

DETAIL A

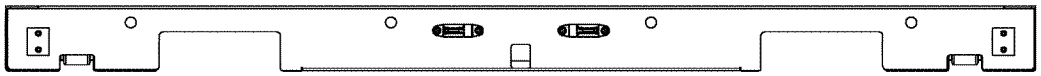
FIGURE 46
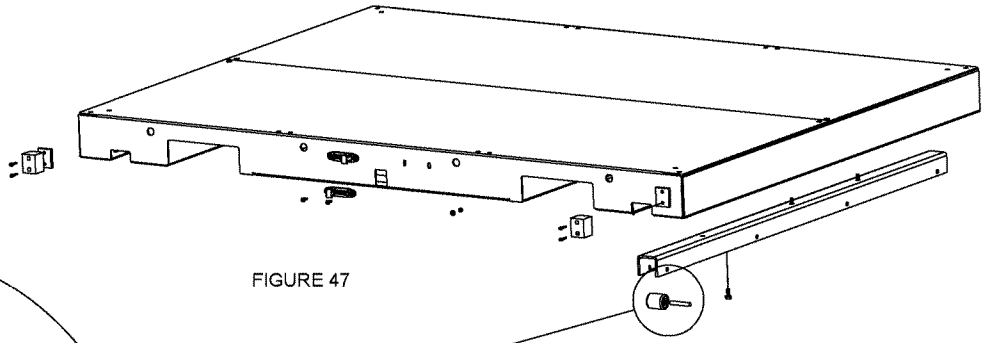
FIGURE 47
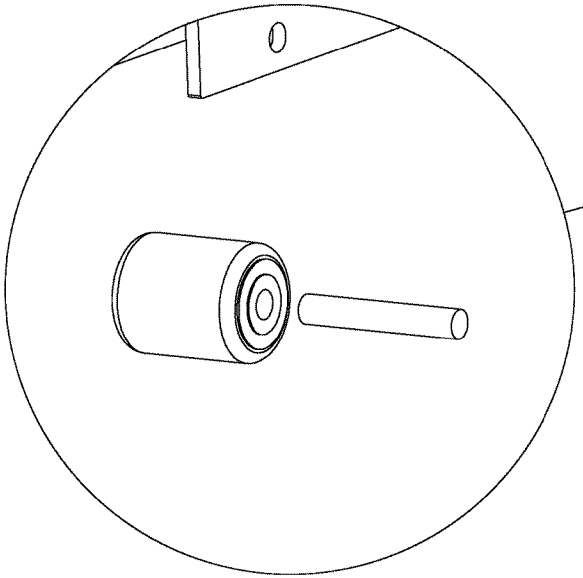
DETAIL A

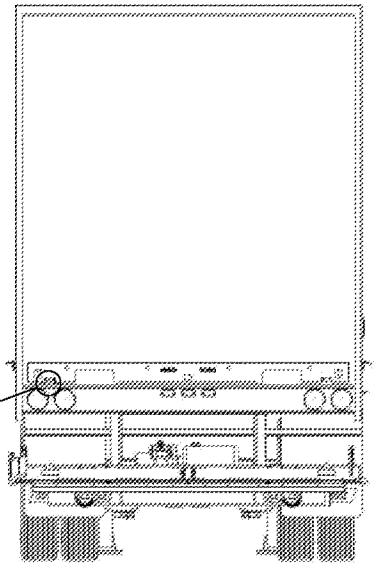
FIGURE 49
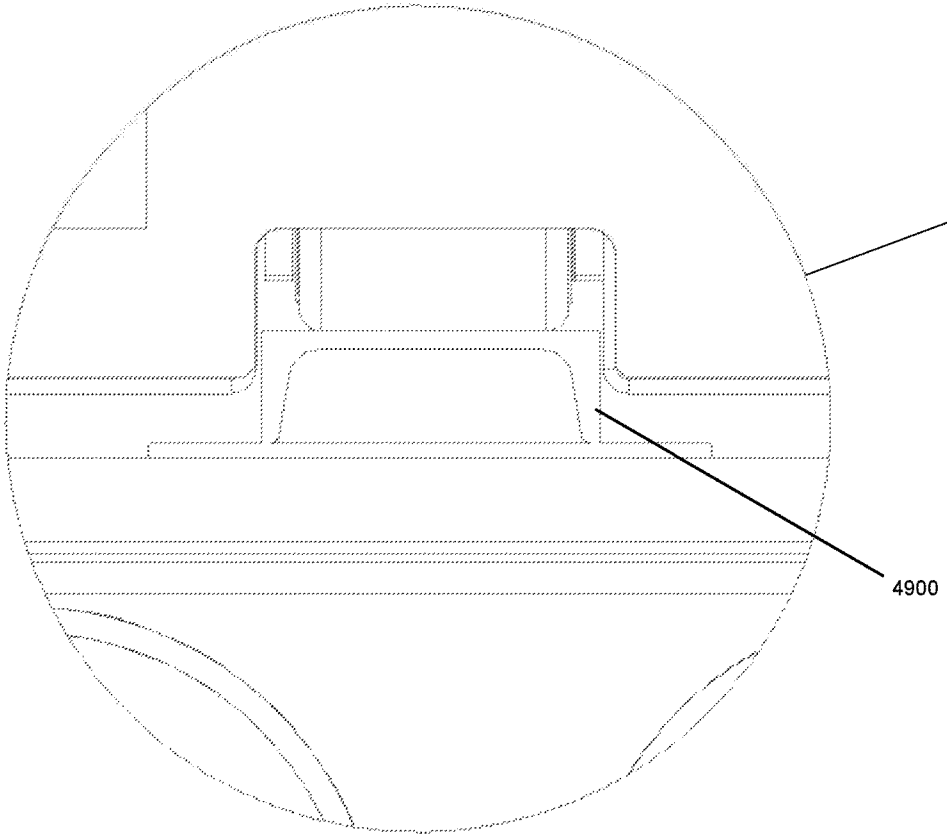
DETAIL A

MODULAR SHIPPING APPARATUS AND SYSTEM

FIELD OF THE INVENTION

The present invention relates generally to the field of transportation, storage, and shipping. The present invention is a system to transport, consolidate and store all types of cargo. The system is designed to the reduce cost of transportation and labor. It is also designed to ensure security of cargo for worldwide transportation. This application is a national stage application under 35 U.S.C. 371 of International Application No. PCT/US16/48266 filed Aug. 24, 2016 which is a continuation of application Ser. No. 14/973,830 filed Dec. 18, 2015 (now U.S. Pat. No. 9,499,334). Application Ser. No. 14/973,830 in turn claims priority to provisional U.S. Pat. App. 62/241,263 filed Oct. 14, 2015. This application is a continuation-in-part of application Ser. No. 14/414,473 filed Jan. 13, 2015 which is a national stage entry of PCT/US15/11088 and is a continuation of patent application Ser. No. 14/361,280 filed May 28, 2014, which in turn is a continuation of PCT/US14/34186 filed Apr. 15, 2014, a continuation of Ser. No. 14/242,998 filed Apr. 2, 2014 and claims priority from provisional patent application 61/927,957 filed Jan. 15, 2014. This application incorporates by reference applications PCT/US16/48266, 62/241,263, Ser. Nos. 14/414,473, 14/361,280, 14/242,998 and 61/927,957 herein in their entirety.

BACKGROUND

In the shipping industry, it is desirable to utilize all of the space available. The simple stacking of a plurality of boxes having variable shapes often results in wasted space in a storage compartment. Unused space in a storage compartment also increases the likelihood that objects stored there will shift during transport, suffering damage or fracture.

Shipping is common, as are large-scale shipping vessels. However, much ground transportation is not efficiently conducted. In addition, trailers used for shipping may elevate several feet off the ground. Operating one of these trailers requires the use of ramps or the lifting by human operators in an effort to place objects in one of said trailers. Trailer lifts have also been developed to assist in this operation.

Once objects are placed inside a trailer it is often challenging to stack and arrange said objects in an alignment in which they can be transported in an efficient manner utilizing all available space, and in such a way so as to prevent shifting or damage during transport.

Distribution centers, where cargo is redistributed among trailers and forklifts, are commonly used. However, it is difficult to operate a forklift inside a trailer. In addition, a pallet generally used with standard forklifts does not have the same dimensions as that of a trailer. Thus, using forklifts may require less manual labor, but does not improve the ability to maximize the use of storage space.

It is therefore desirable to provide a means to efficiently maximize the amount of space used inside a storage or transportation container. It is also desirable to have a system that can be installed and removed in any truck or container. Once removed, the truck or container may be utilized with flat bottom pallets.

It is also desirable to provide a means for efficiently and easily arranging transported objects inside a trailer or other compartment.

It is also desirable to provide a system that may be utilized in conjunction with a rail system, which is more cost effective.

The present invention also seeks to provide an efficient manner in which to transport commodities.

BRIEF SUMMARY OF THE INVENTION

Accordingly, objects of the present invention are to provide modular shipping systems, apparatuses and methods for improving efficient use of space in storage compartments in the transport and shipping industries.

According to one object of the present invention, a modular shipping container apparatus is provided, having a base, each base having two support portions, each of the two support portions having two substantially open top rectangular shaped spaces each having a bottom side, a left side and a right side and at least one set of base holes in at least one of the left side and the right side; at least one wheel assembly between the two substantially open top rectangular shaped spaces, wherein the at least one wheel assembly has a substantially open bottom rectangular piece with at least one set of wheel assembly holes and at least one wheel with a center opening, wherein the at least one wheel assembly is retained between the two substantially open top rectangular shaped spaces by at least one bar through the at least one set of base holes, the at least one set of wheel assembly holes and the center opening of each of the wheels; at least two tracks for attachment to a bottom interior of a shipping container, wherein at least a portion of each of the at least one wheel assemblies slides along one of the at least two tracks attached to the bottom interior of a shipping container.

These and other objects and advantages of the present invention will become apparent from a reading of the attached specification and appended claims. There has thus been outlined, rather broadly, the more salient features of the invention in order to better appreciate the contribution of the instant invention to the art. There are features of the instant invention that will be described hereinafter and which will form the subject matter of the claims appended hereto.

BRIEF DESCRIPTION OF THE DRAWINGS

FIG. 39 depicts a front view of a base with round groove wheels.

FIG. 40 depicts an exploded view of a base with round groove wheels.

FIG. 42 depicts a back view of a truck with a rounded rectangular wheel and rectangular shaped track.

FIG. 46 depicts a front view of the base with a rounded rectangular wheel.

FIG. 47 depicts an exploded view of a base with a rounded rectangular wheel.

FIGS. 48 and 49 depicts a back view of a truck with a U channel track and a rounded rectangular wheel.

FIG. 65 depicts cargo loaded on a base and being strapped down. FIG. 66 depicts a base with cargo being removed by the pulley system strap and roller mechanism.

DETAILED DESCRIPTION

The claimed invention is designed to use every available square inch of a vehicle. A vehicle may include a truck, trailer, international container, rail car, overseas container, or other transportation vehicle. A transportation box is also referred to as a Cargo Container or Cargo Cube. The claimed invention may enable a buffer space of 1 inch on each side plus 1 inch on the top and 1 inch on the bottom for the transportation modular components to fit. This arrangement increases efficiency and enables a user to use every square inch of the vehicle.

This system is designed to load any number of, by way of example up to ten, transportation modular components in a container, trailer, or rail container. The system is designed to save money in transportation cost across country, or across the globe. The transportation modular components may be used to load household goods and other freight items and commodities.

Figure 1:
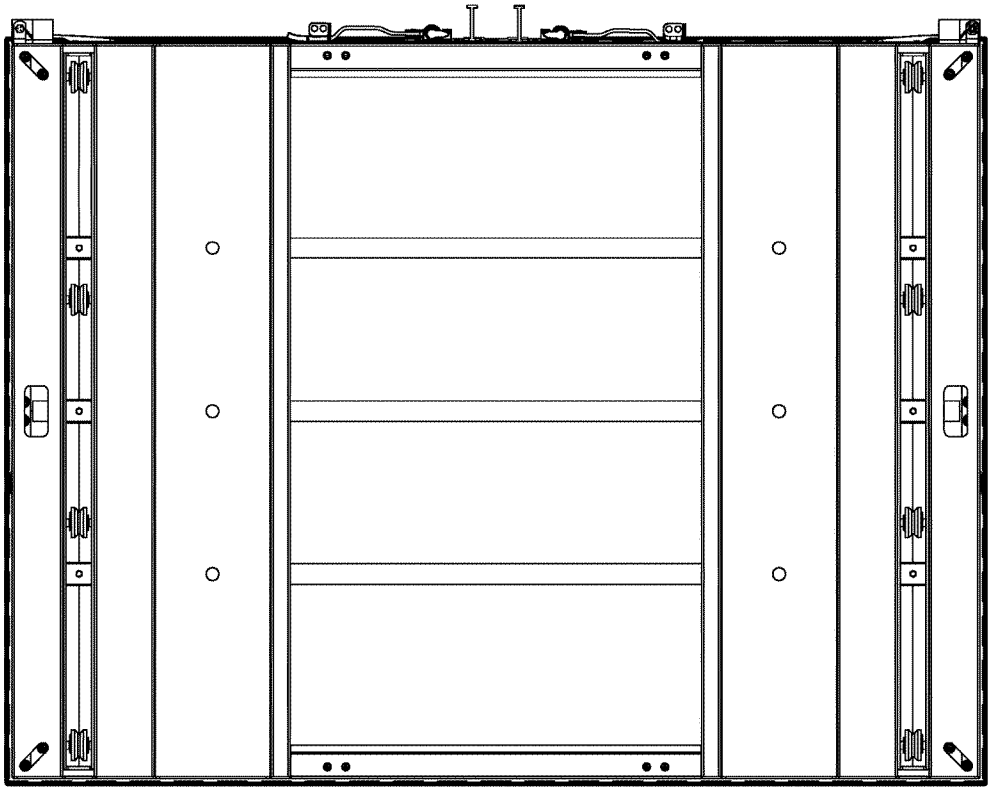
FIG. 1 is a picture of a bottom of a base.
Figure 2:
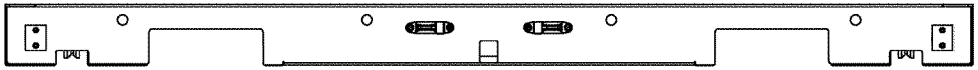
FIG. 2 is a picture of a front side of the base.
Figure 3:
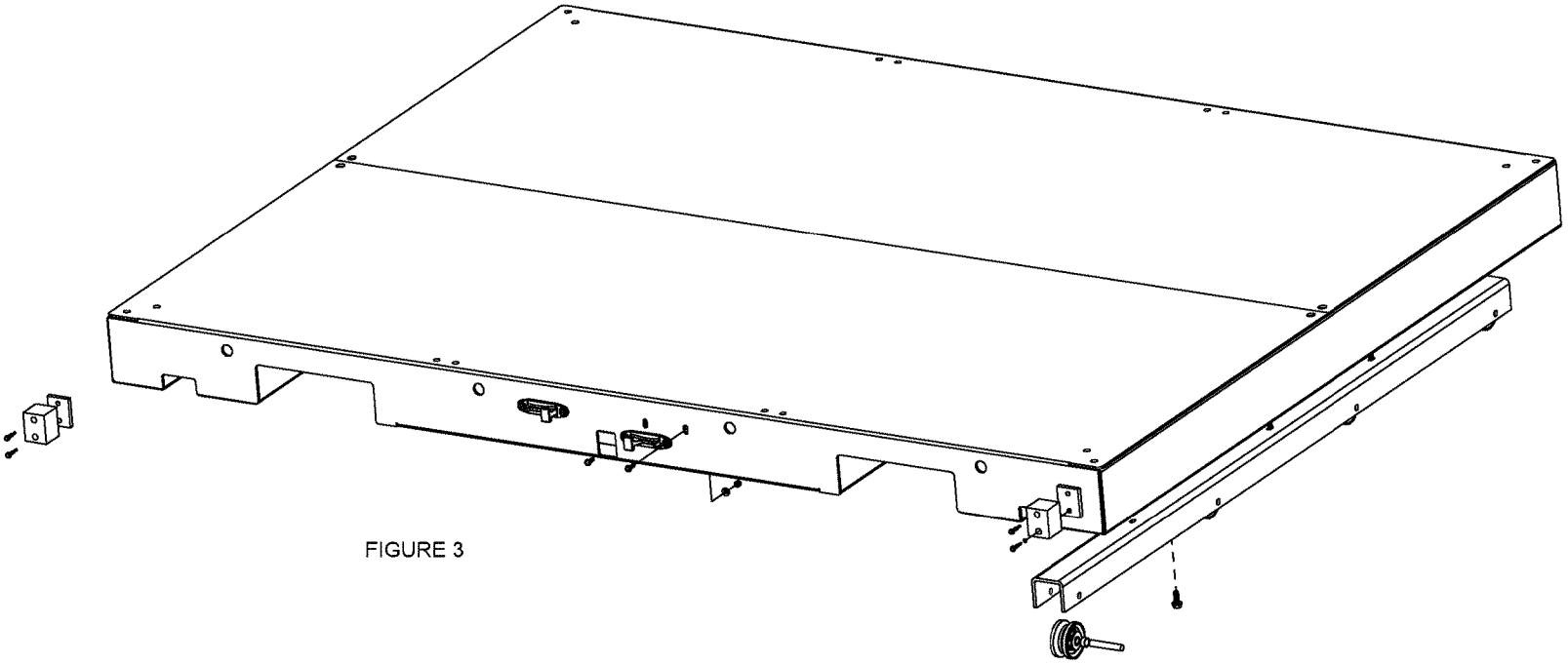
FIG. 3 is a picture of the base with a wheel assembly and also depicting the bumper and keeper.
Figure 4:
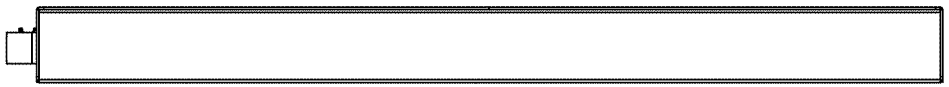
FIG. 4 is a picture of a side of the base.
Figure 5:
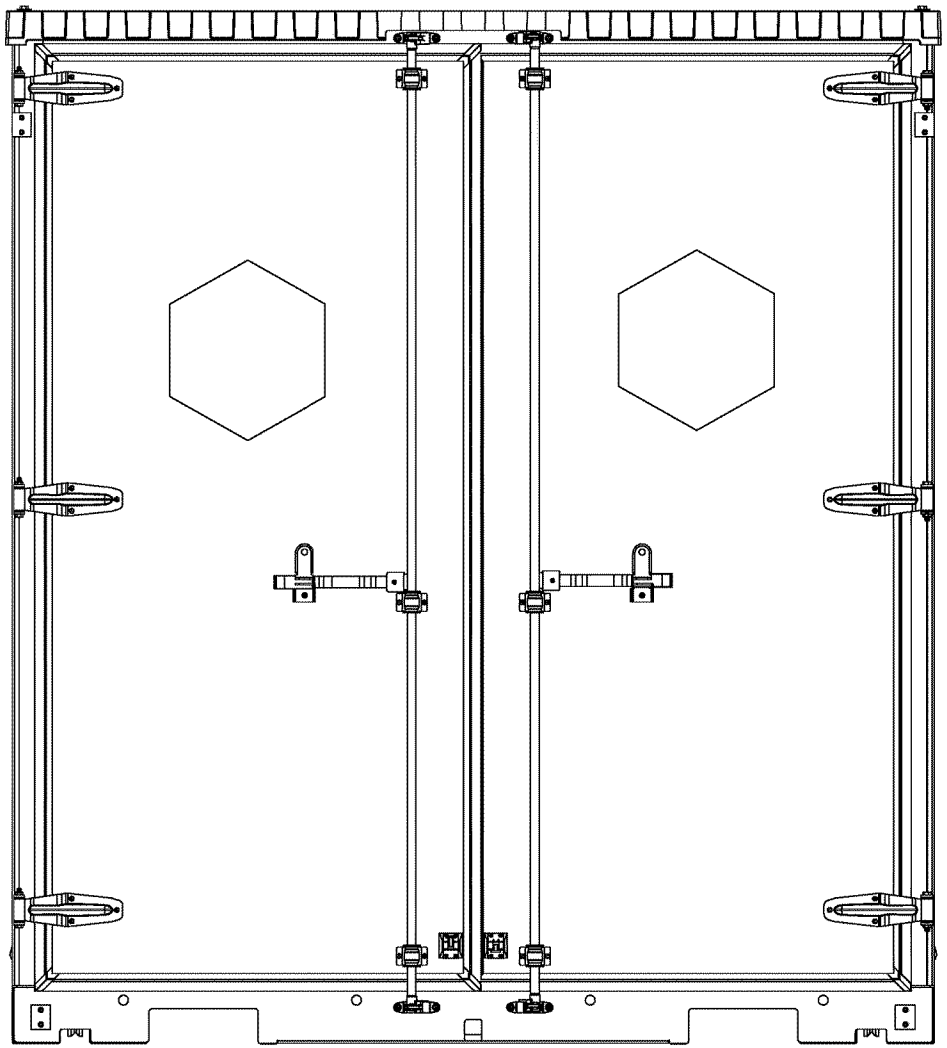
FIG. 5 is a picture of a cargo container mounted on a base.
Figure 6:
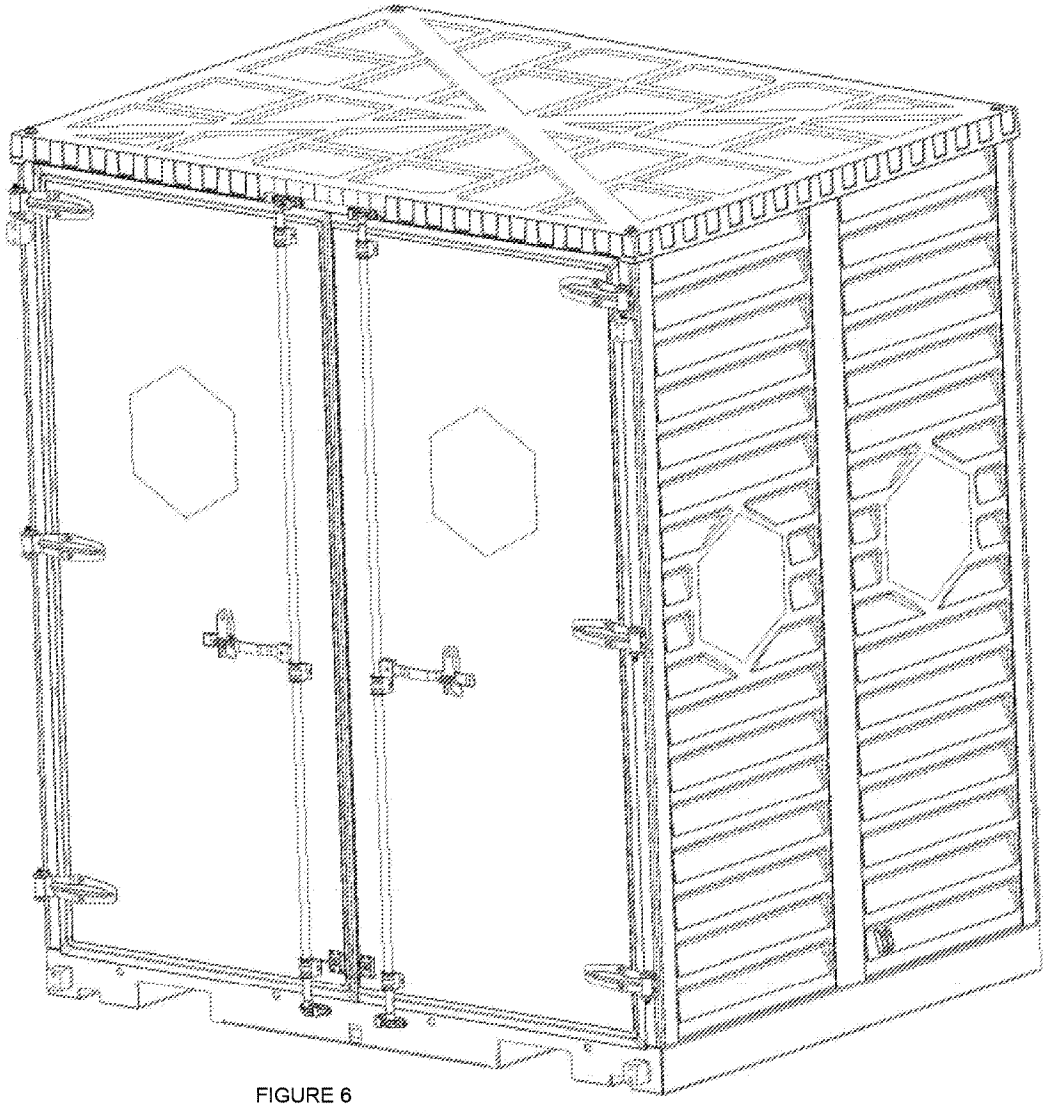
FIG. 6 is a picture of a cargo container mounted on a base.
Figure 7:
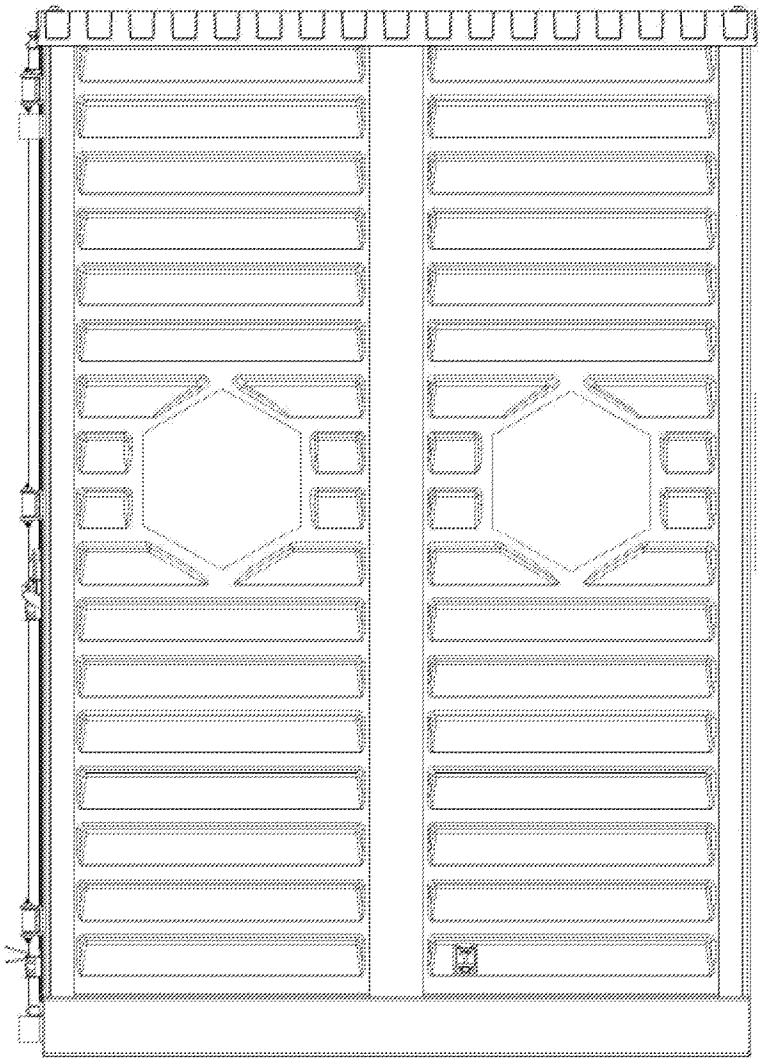
FIG. 7 is a picture of the side of the cargo container.
Figure 8:
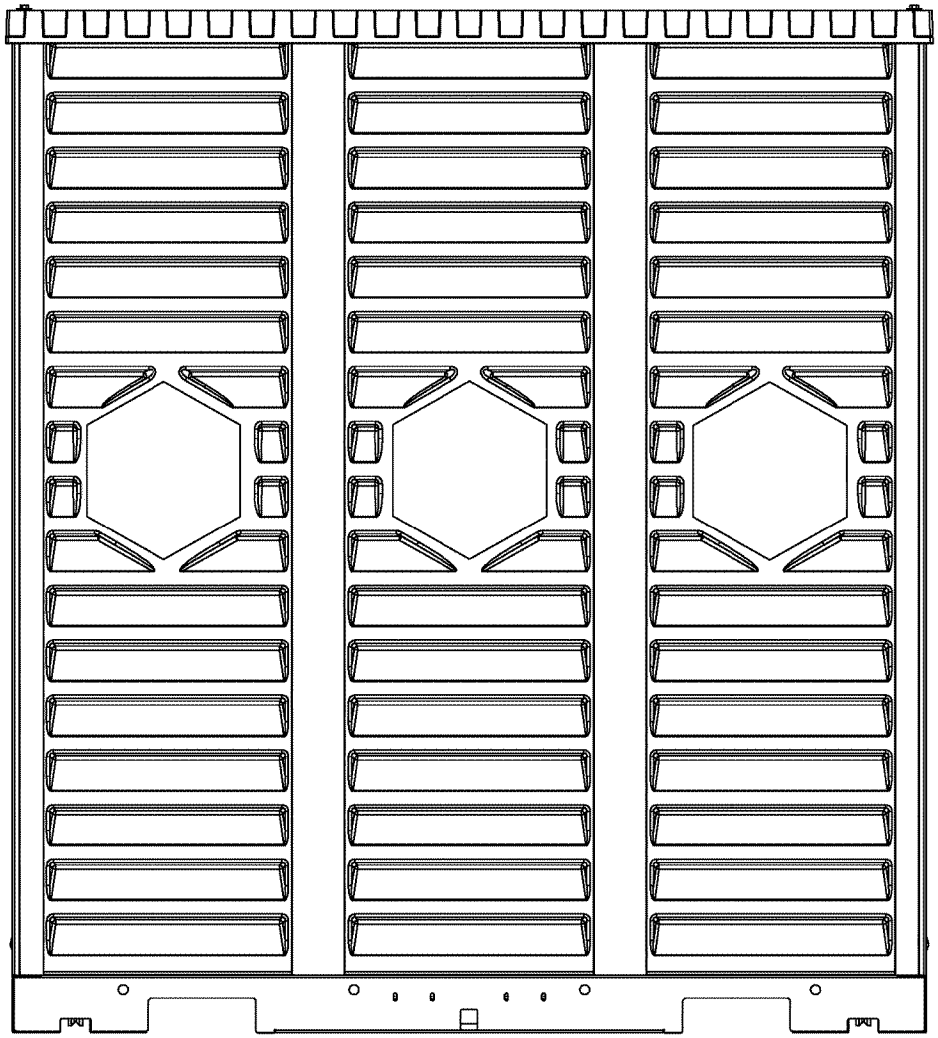
FIG. 8 represents a picture a back view of the cargo container.
Figure 9:
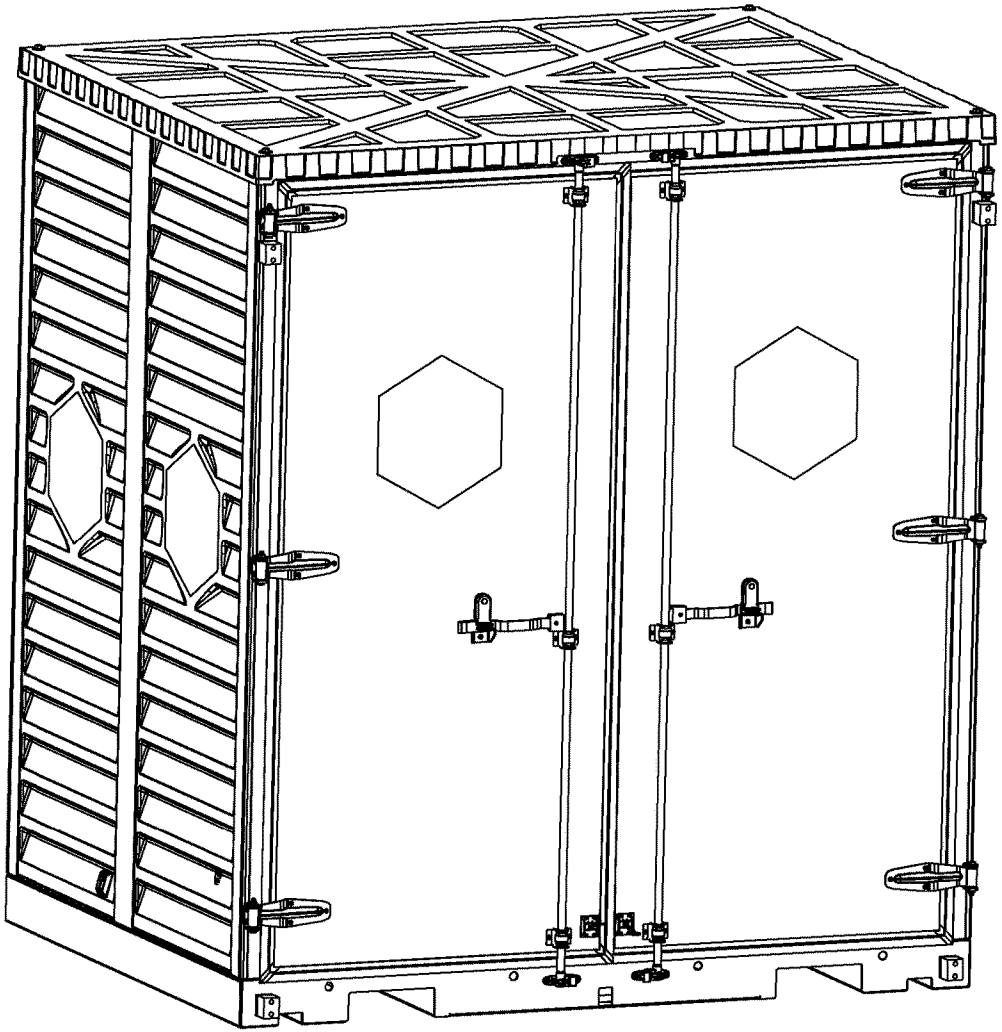
FIG. 9 is a picture of a cargo container with closed doors.
Figure 10:
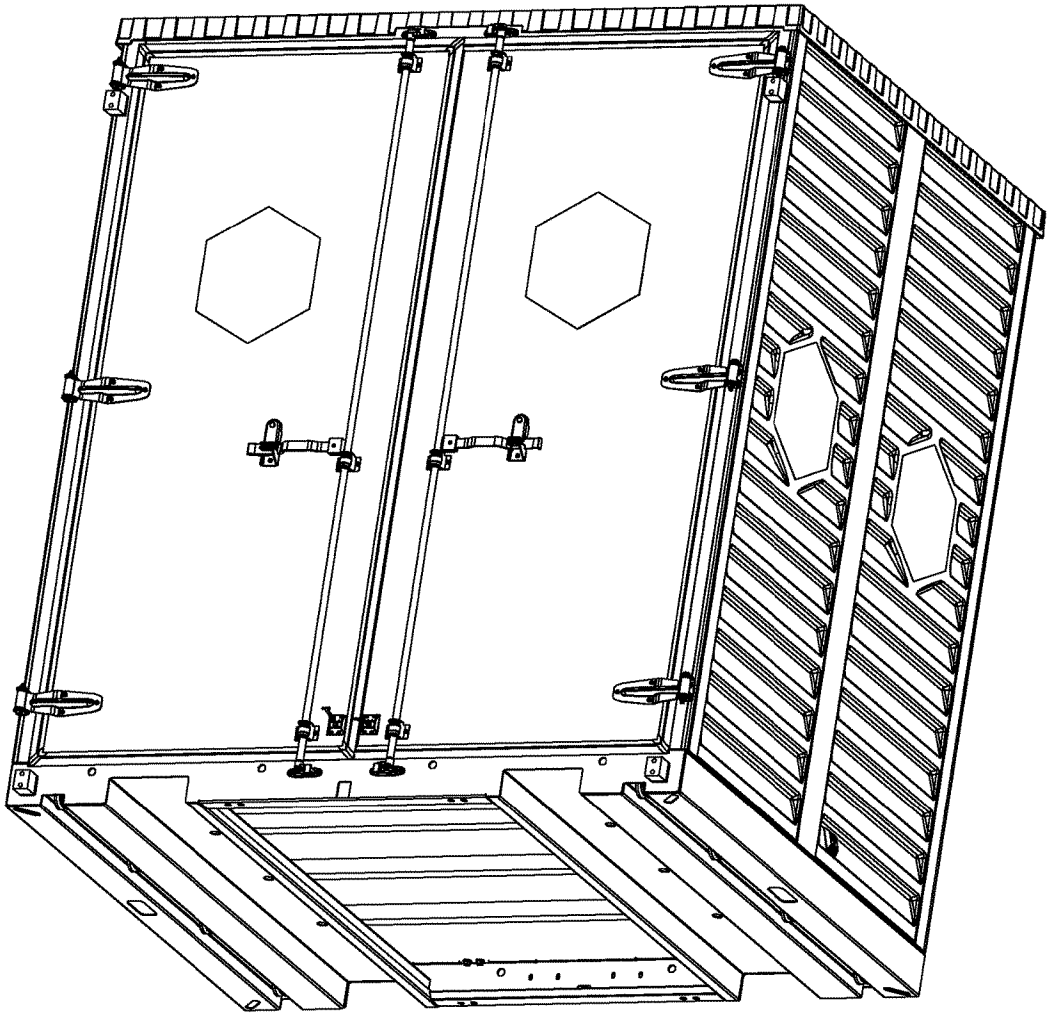
FIG. 10 is a picture of the cargo container box at an angle showing the base.
Figure 11:
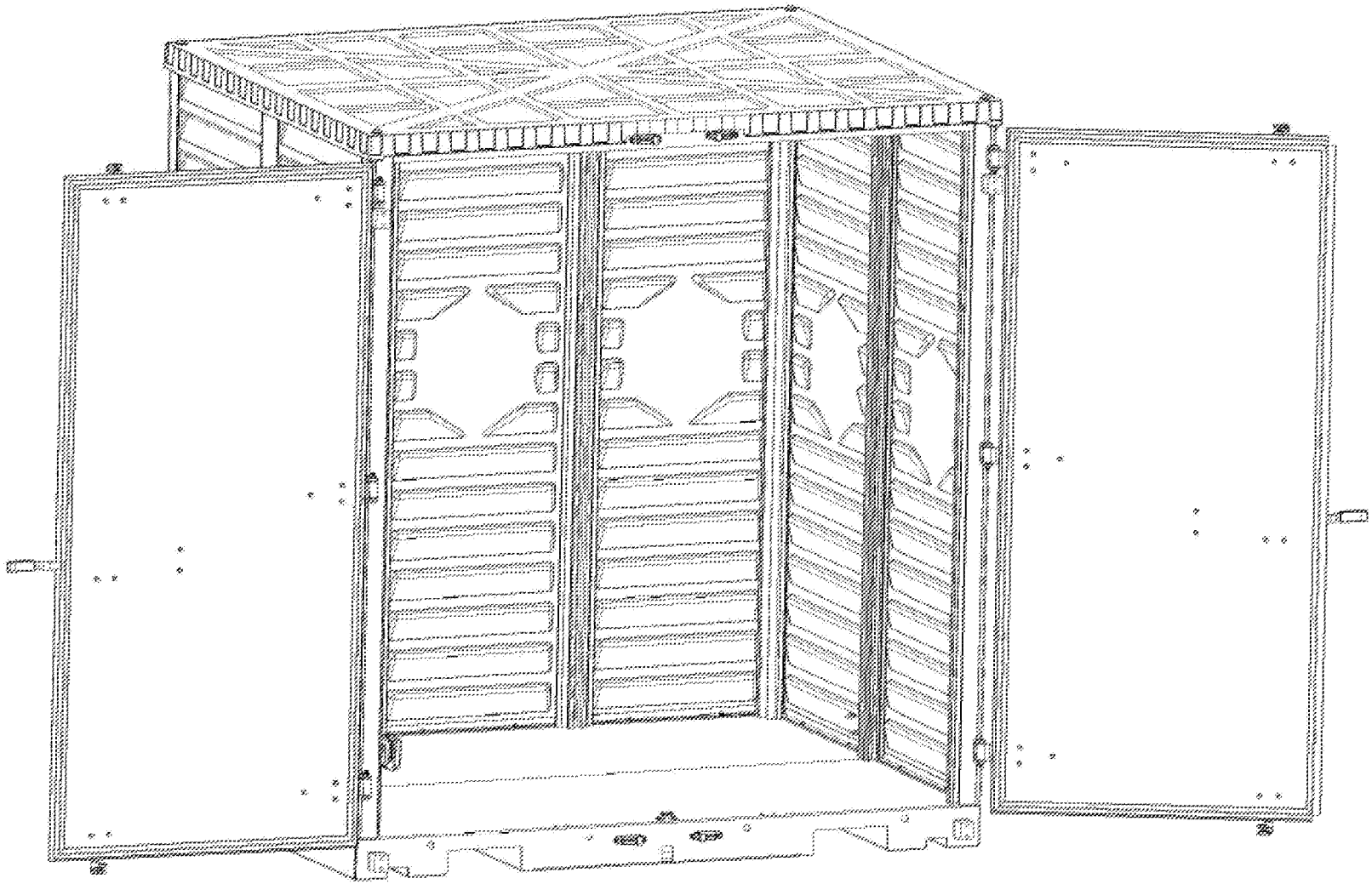
FIG. 11 is a picture of a cargo container box with the doors open.
Figure 12:
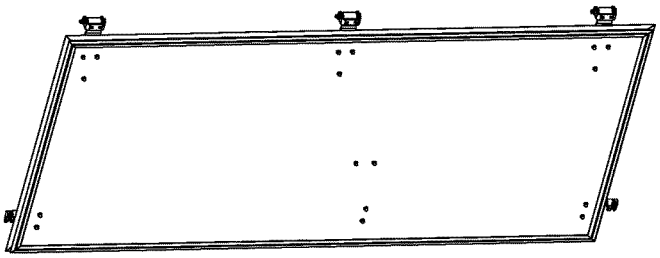
FIG. 12 depicts a door of a cargo container.
Figure 12:
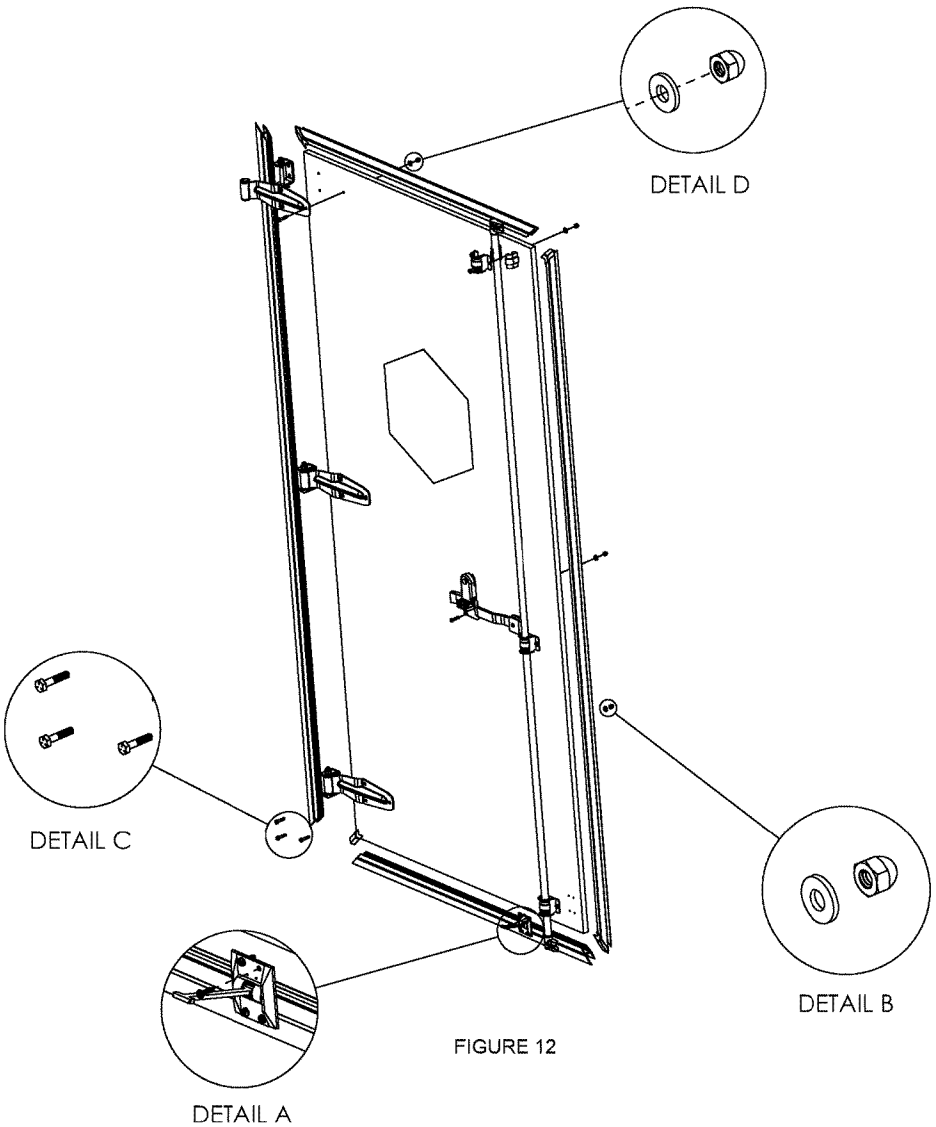
Figure 13:
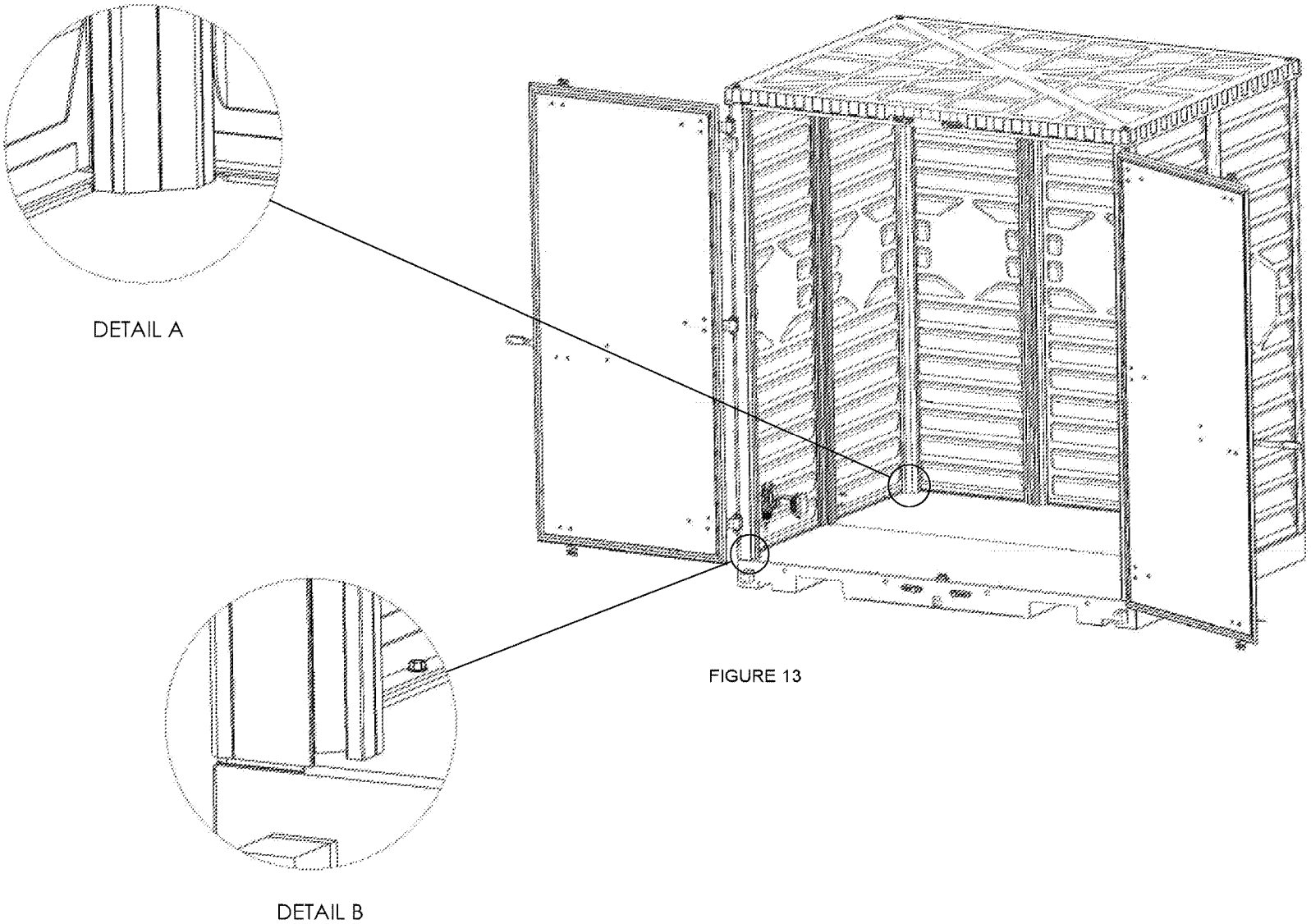
FIG. 13 is a picture of the cargo container with the doors open and depicting corner supports.
Figure 14:
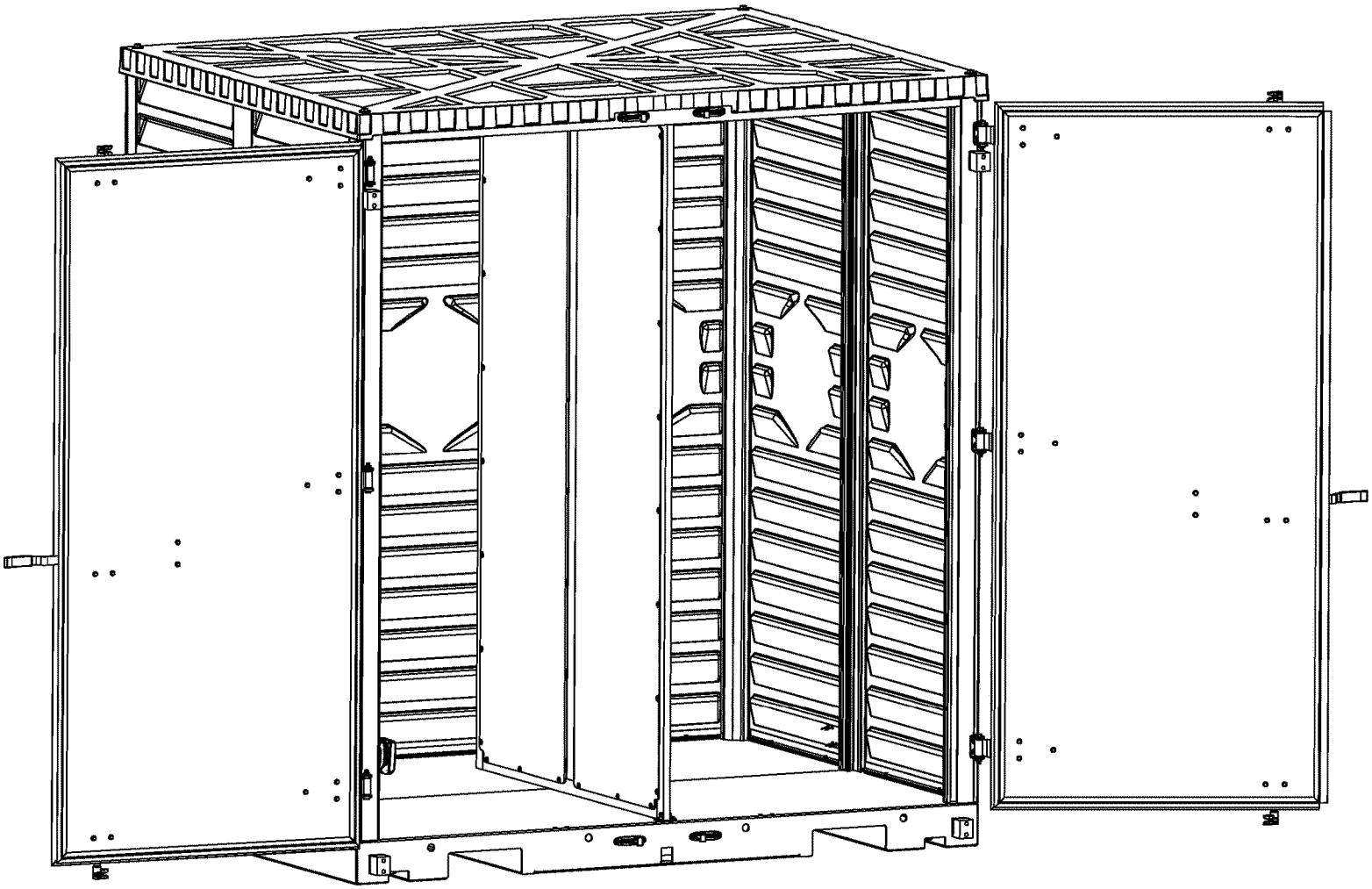
FIG. 14 is a picture of the cargo container with a base, the doors open and an interior partition wall.
Figure 15E:
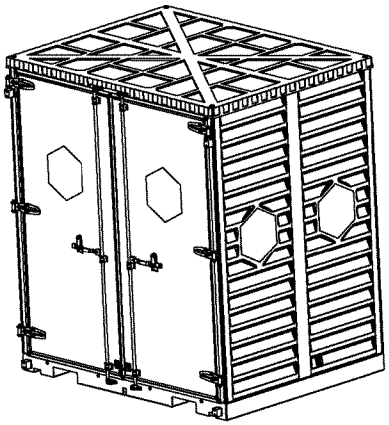
FIGS. 15A, 15B, 15C, 15D and 15E are views of the cargo container.
Figure 15D:
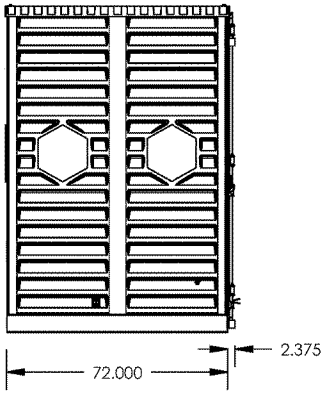
Figure 15A:
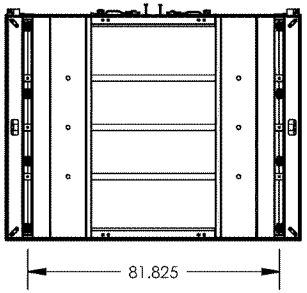
Figure 15B:
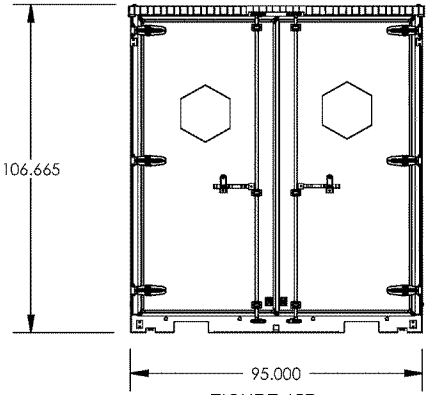
Figure 15C:
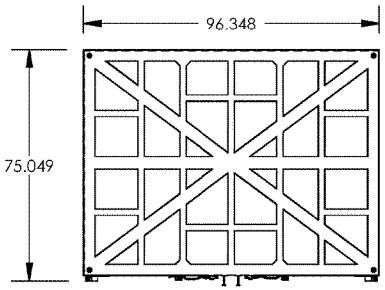
Figure 16:
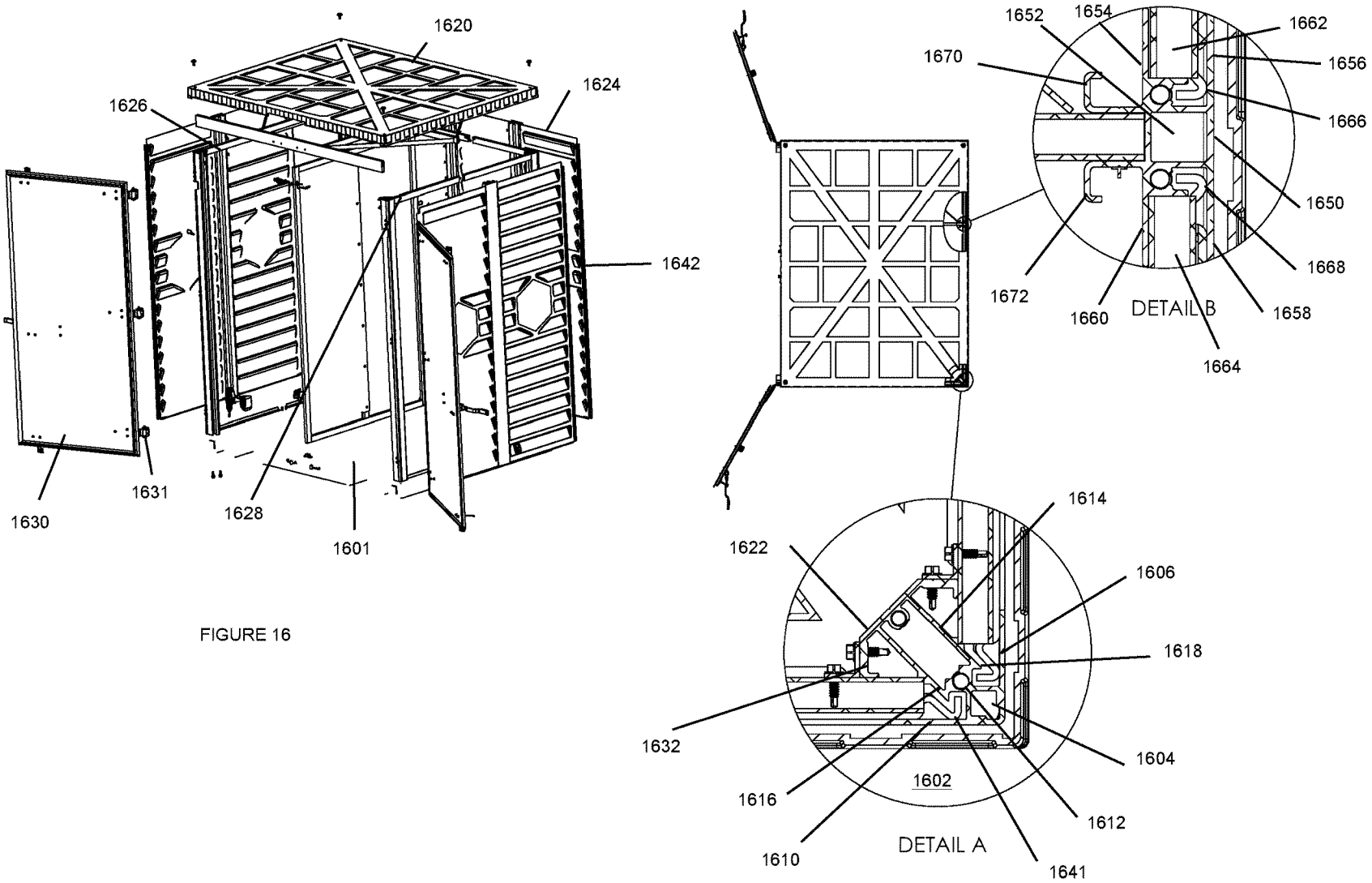
FIG. 16 depicts different views of the cargo container.
Figure 17:
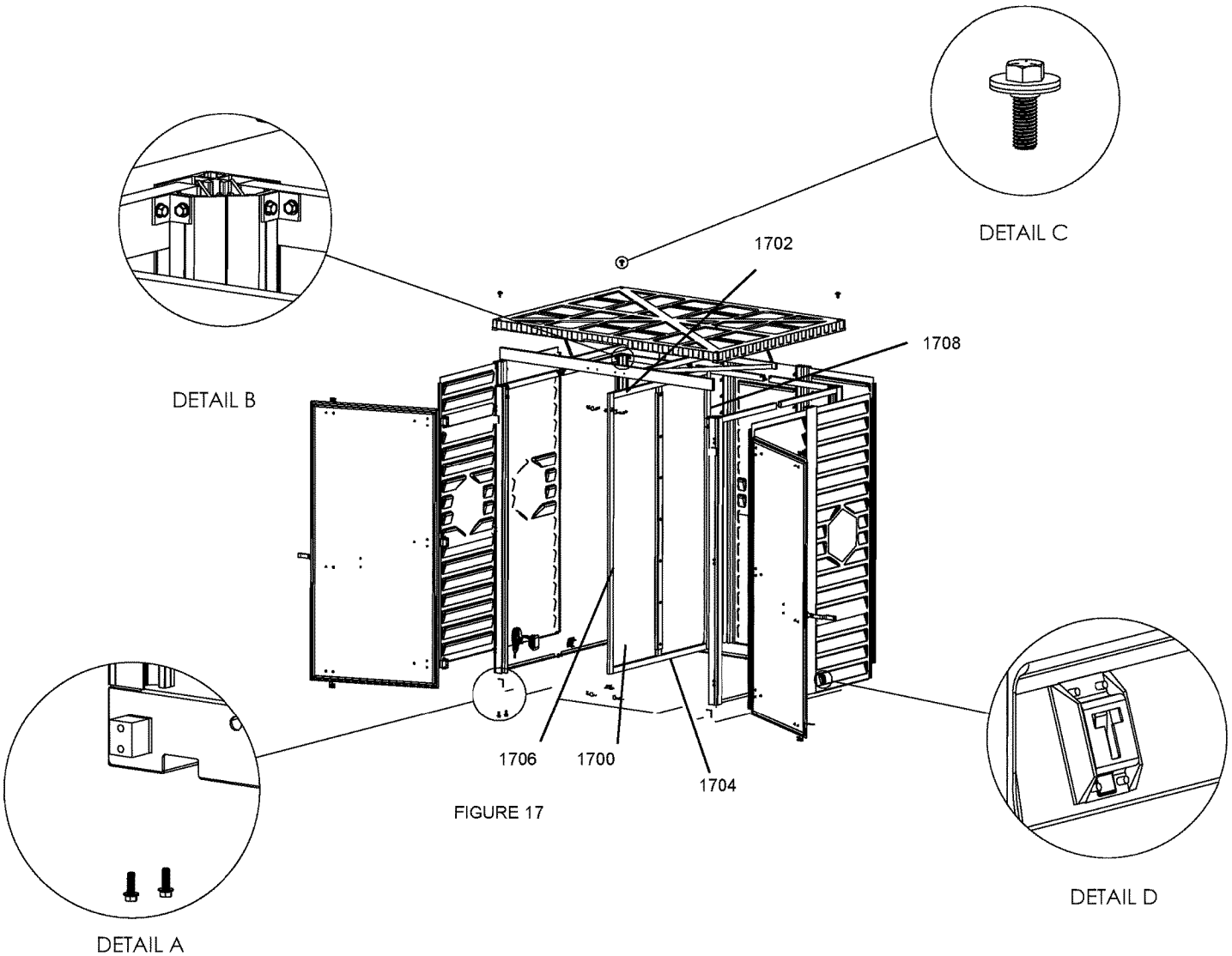
FIG. 17 is an exploded view of a shipping container and a base.
Figure 18:
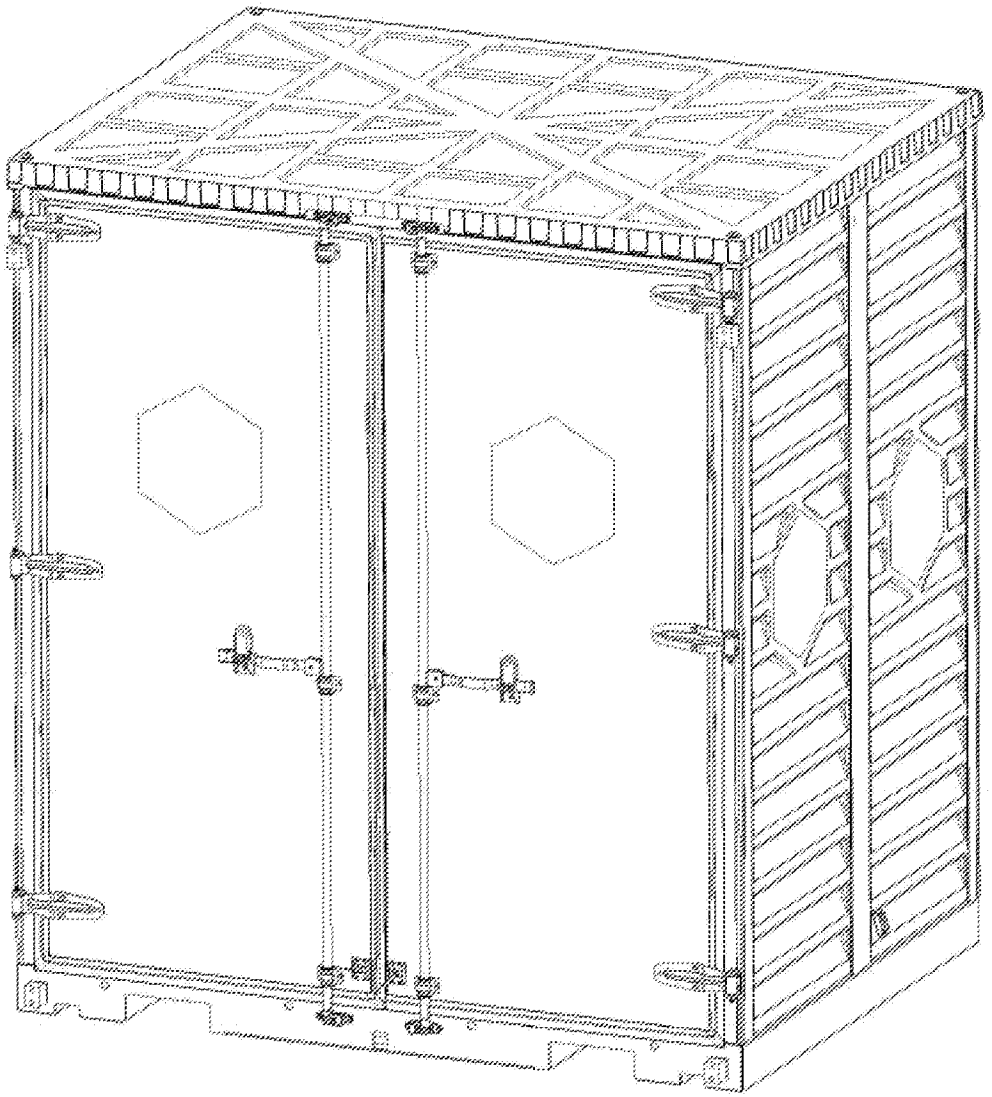
FIG. 18 is a front view of a shipping container and a base.
Figure 19:
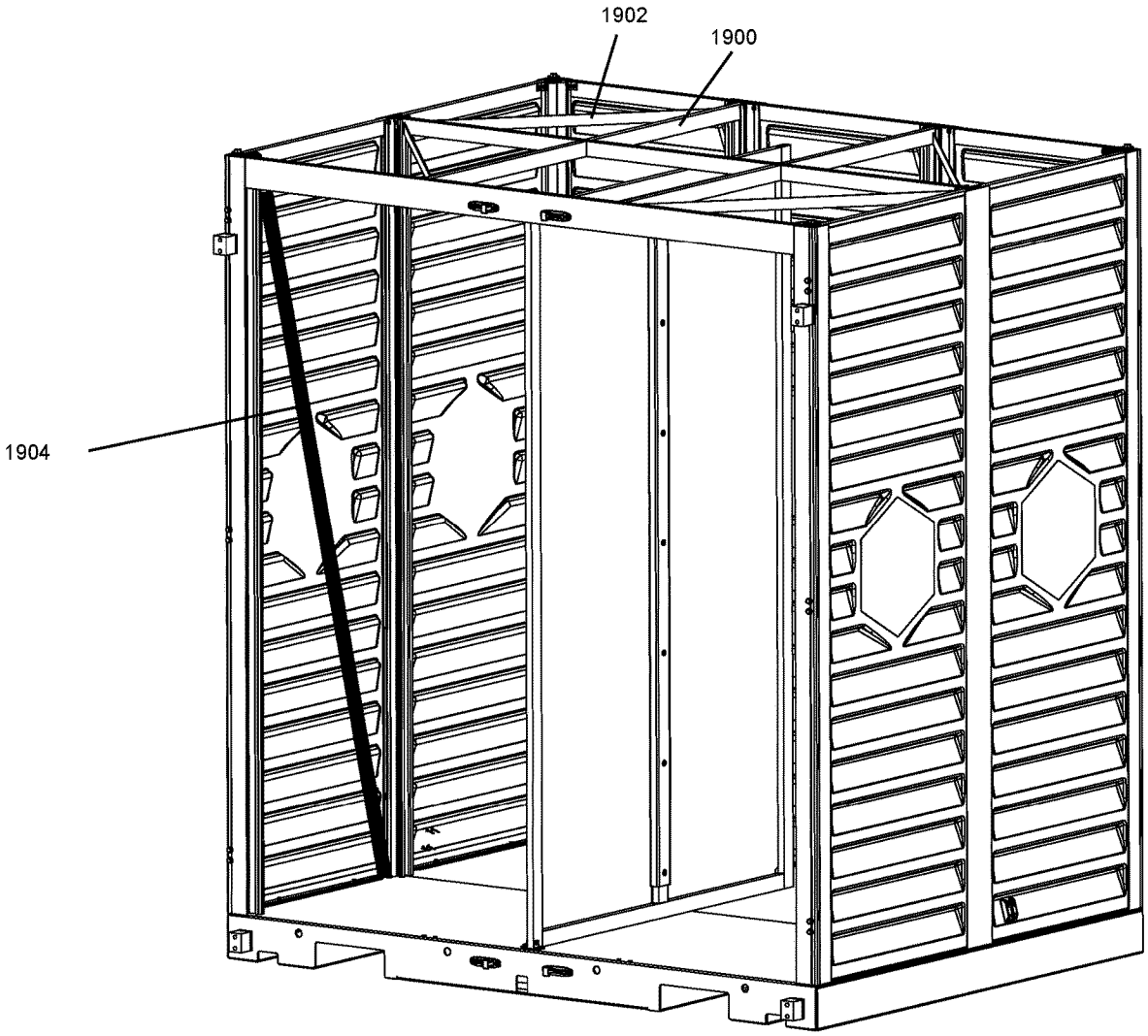
FIG. 19 is a front view of a shipping container and a base with the doors and top removed and depicting the roof structure support.
Figure 20:
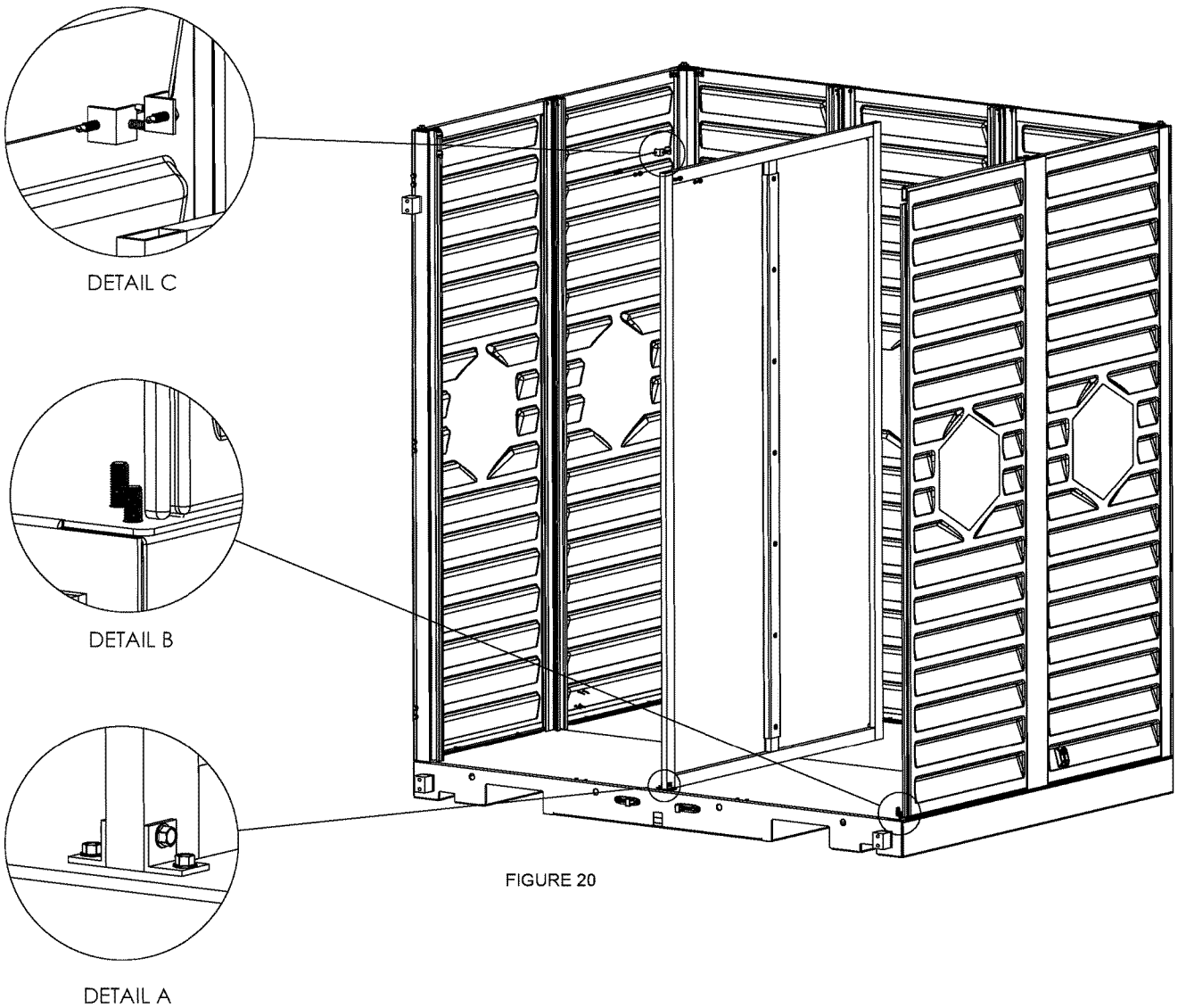
FIG. 20 is a front view of a shipping container and a base with the doors removed and the top removed.
Figure 21:
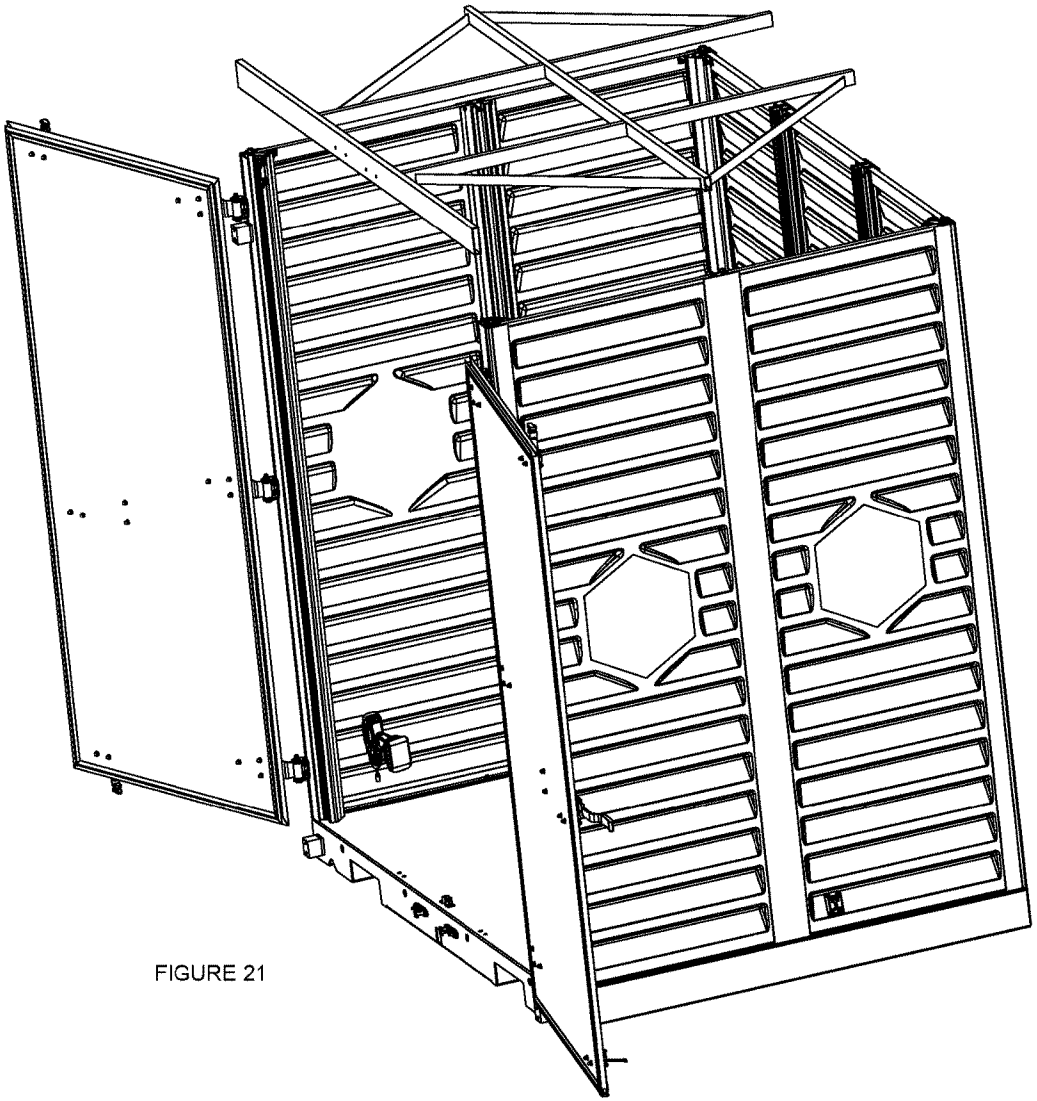
FIG. 21 depicts an exploded top view of the shipping container with top cross supports.
Figure 22:
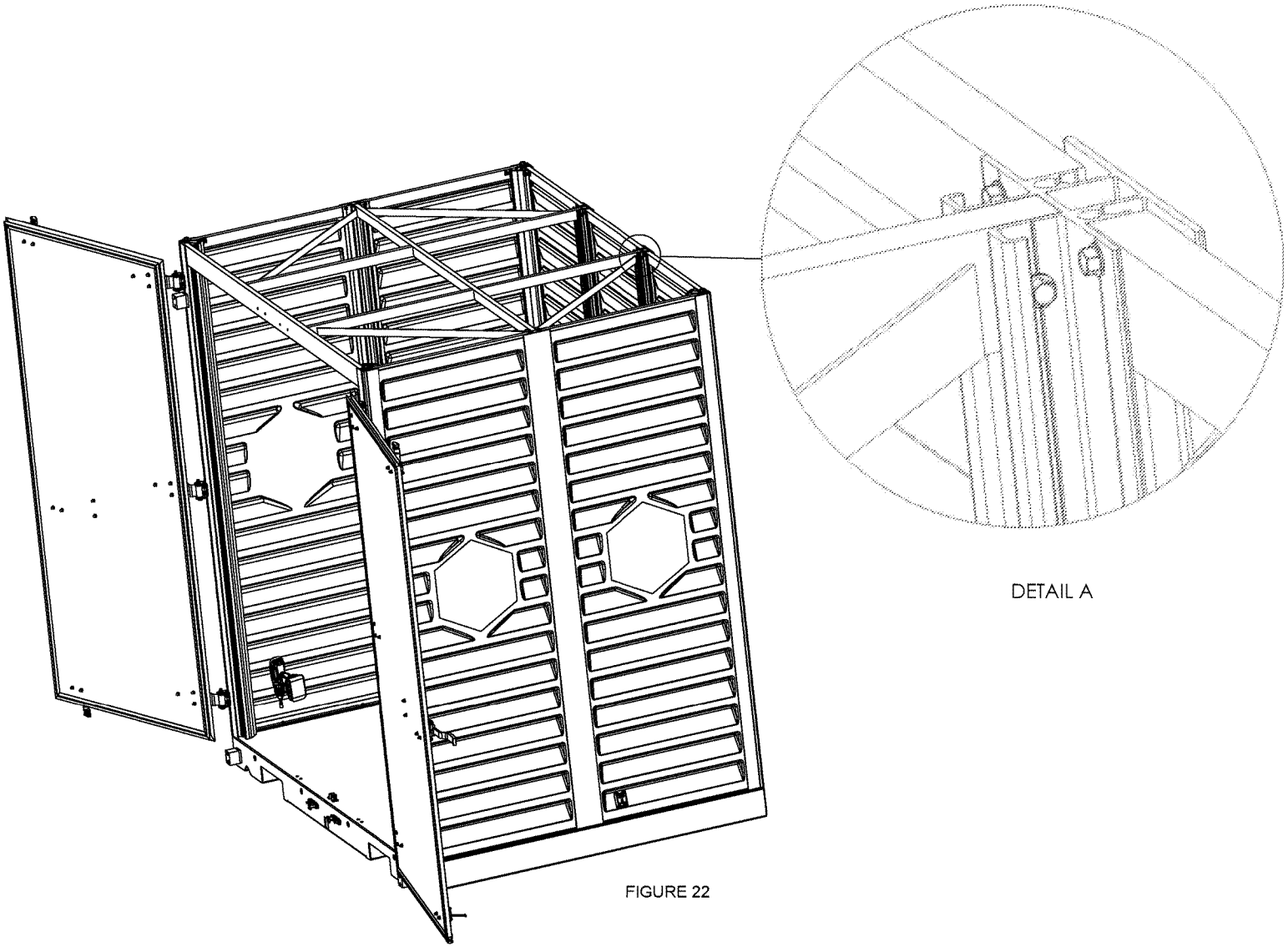
FIG. 22 depicts a top view of the shipping container with the top removed and top cross supports and depicting how the roof structure is supported by the center support.
Figure 23:
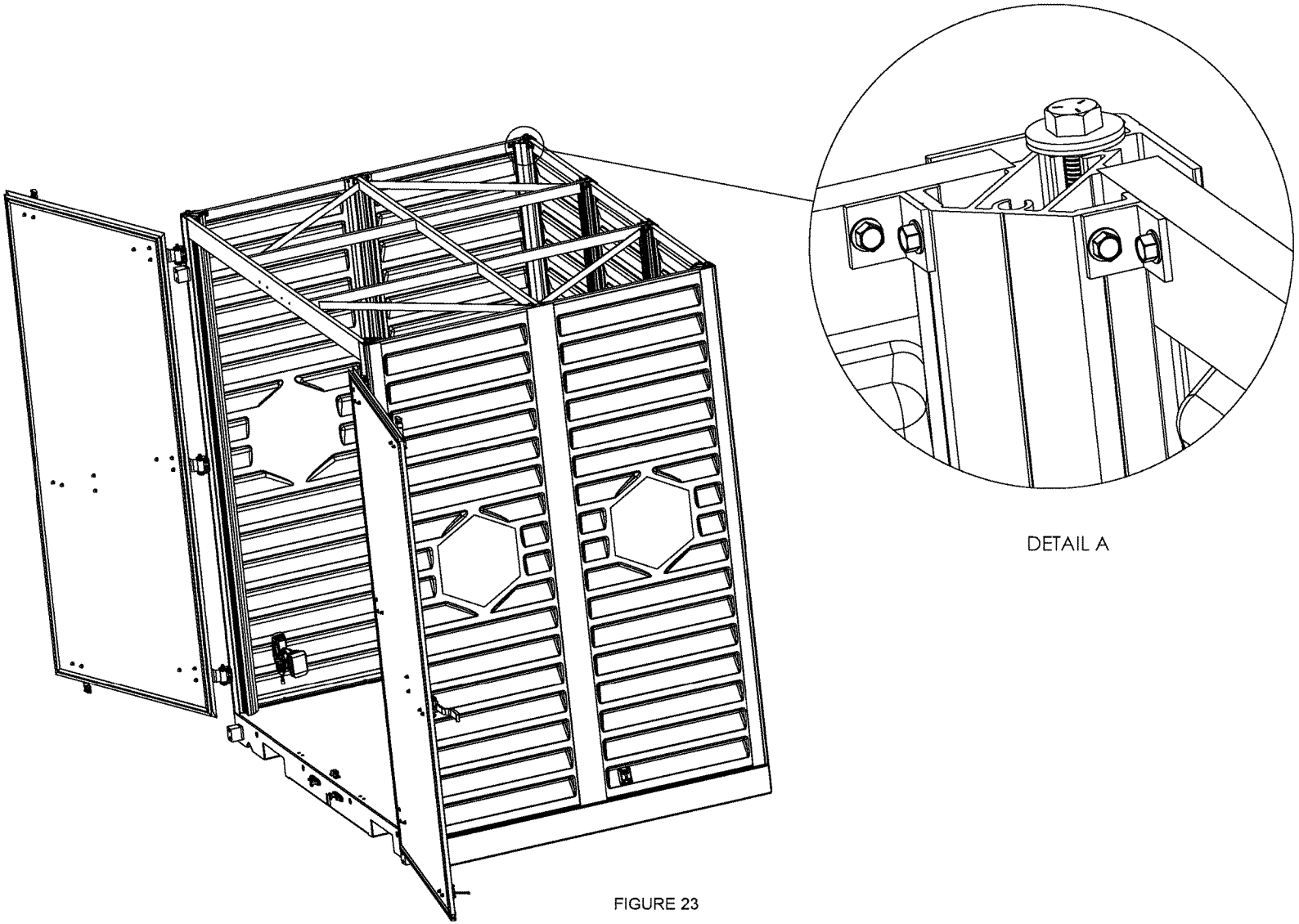
FIG. 23 depicts a top view of the shipping container with the top removed according to the present invention.
Figure 24:
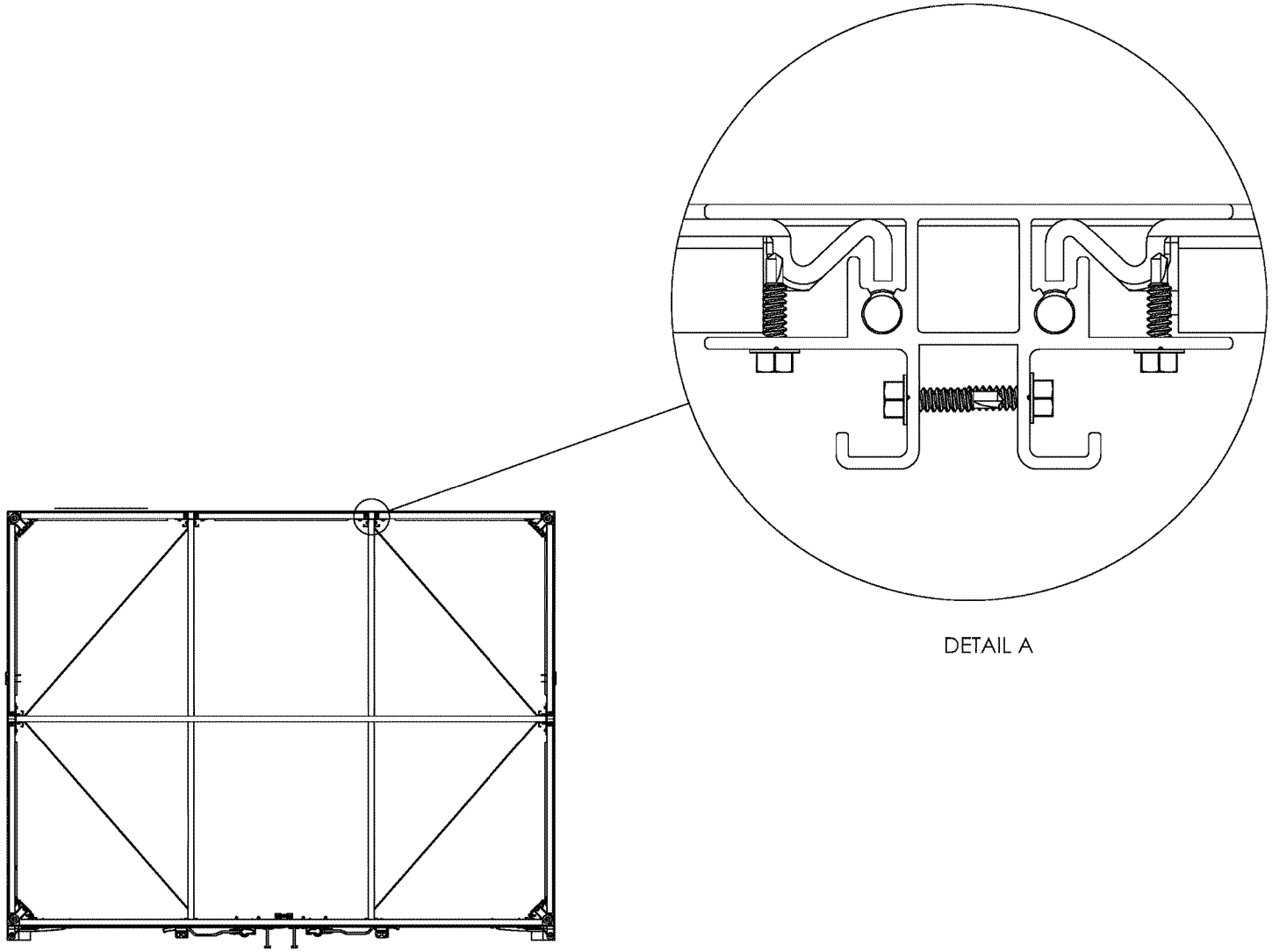
FIG. 24 depicts a top view of a cube with the roof removed and depicting the roof structure.
Figure 25:
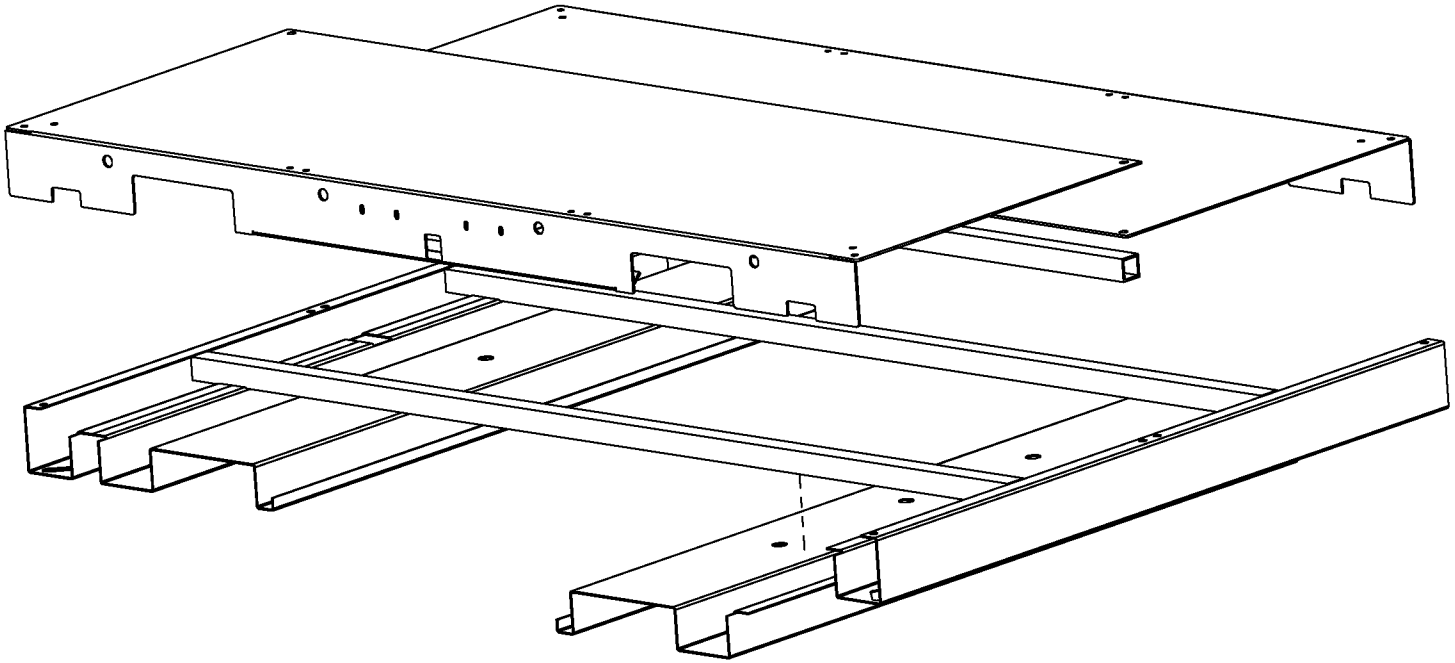
FIG. 25 is an exploded view of a base.
Figure 27:
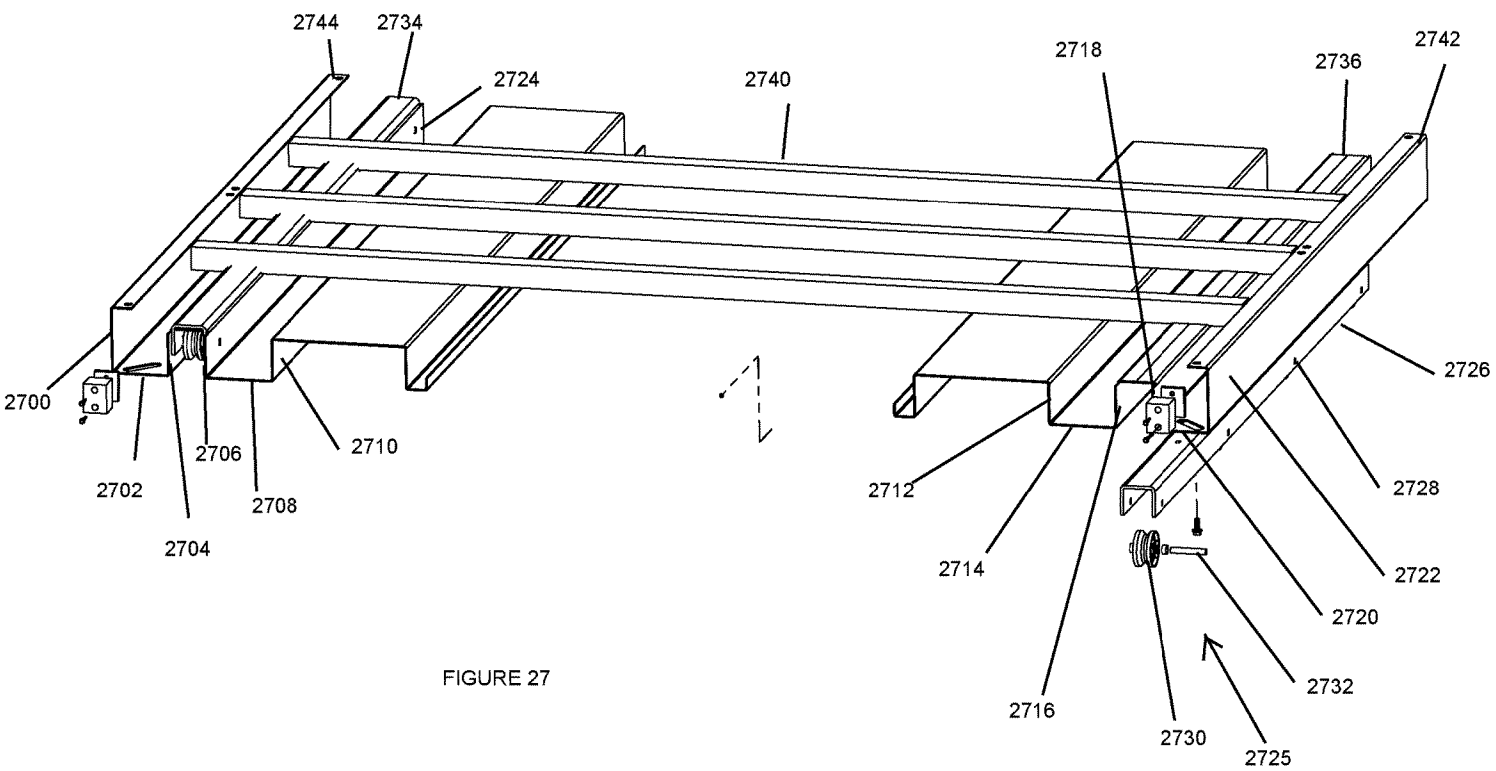
FIG. 27 is a top view of a base with the cover removed.
Figure 29:
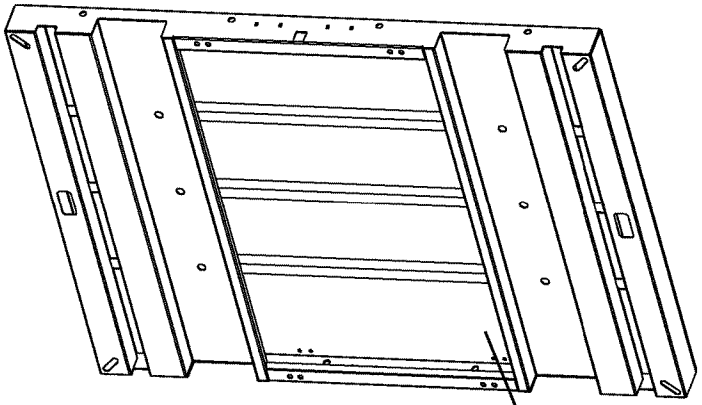
FIG. 28 is a top view of a base with the cover attached and FIG. 29 is a bottom view of a base with the cover attached.
Figure 28:
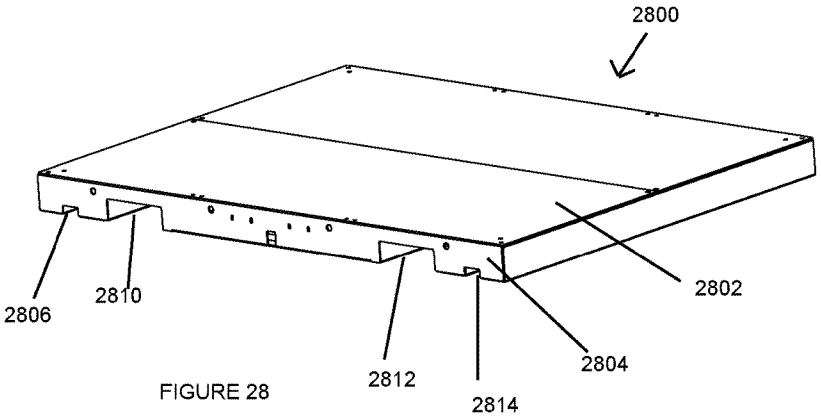
Figure 30:
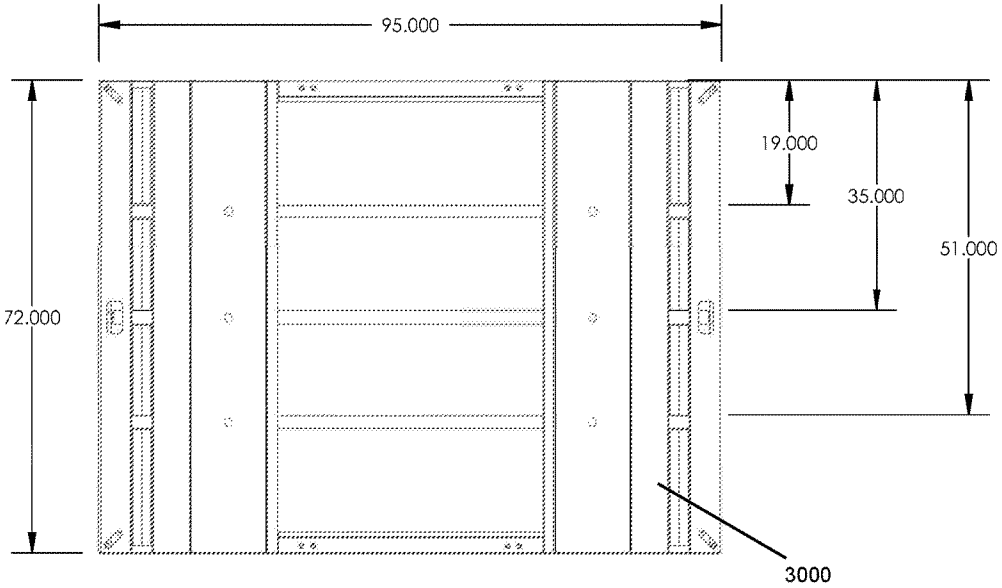
FIG. 30 is a bottom picture of a base with example dimensions.
Figure 31:
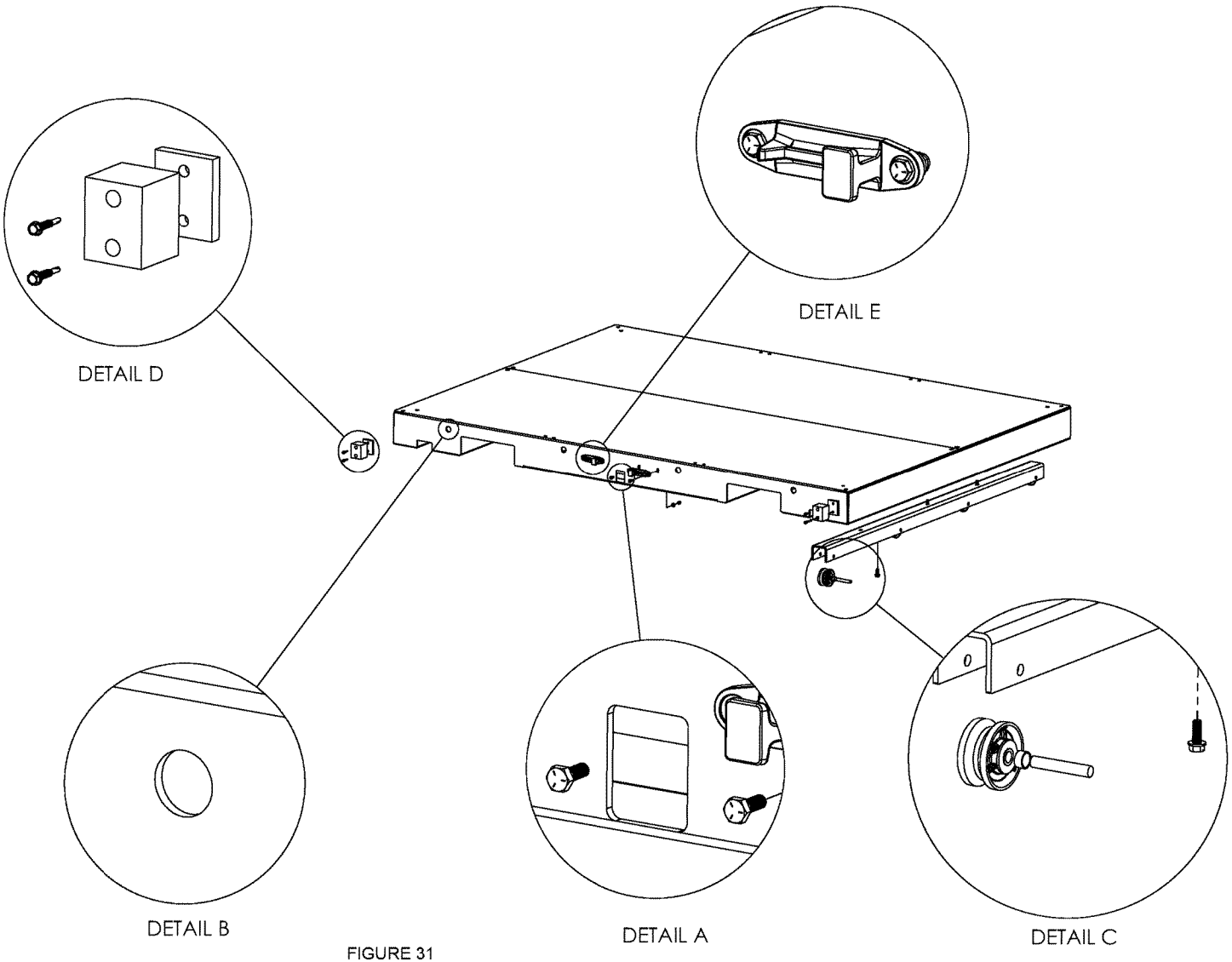
FIG. 31 is an exploded top view of a base.
Figure 32:
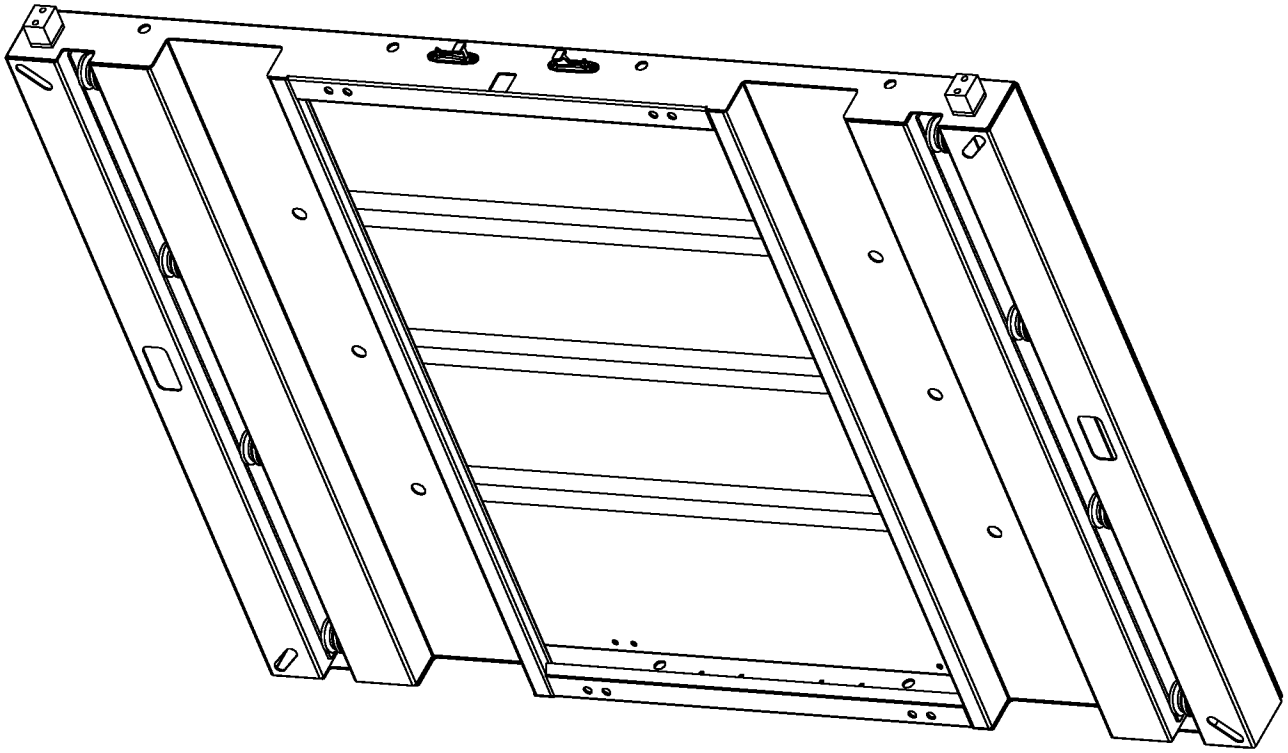
FIGS. 32 and 33 depict a bottom view of a base.
Figure 33:
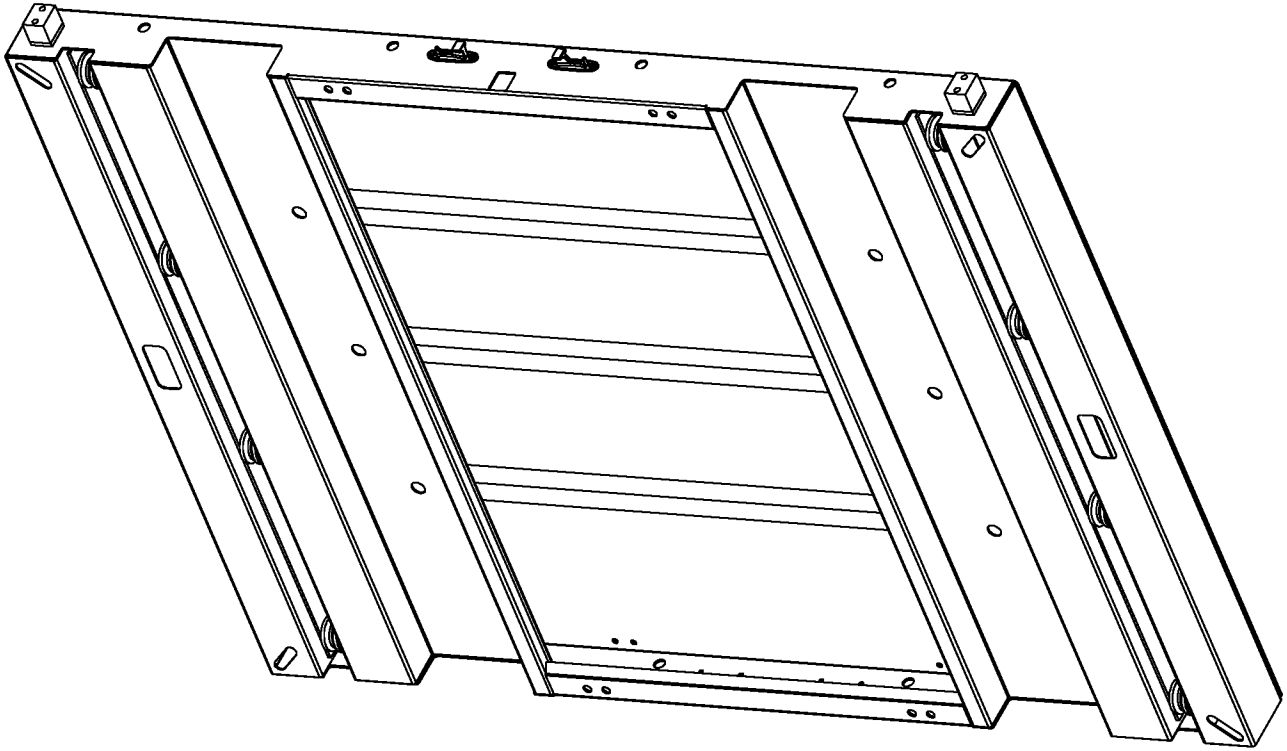
Figure 34:
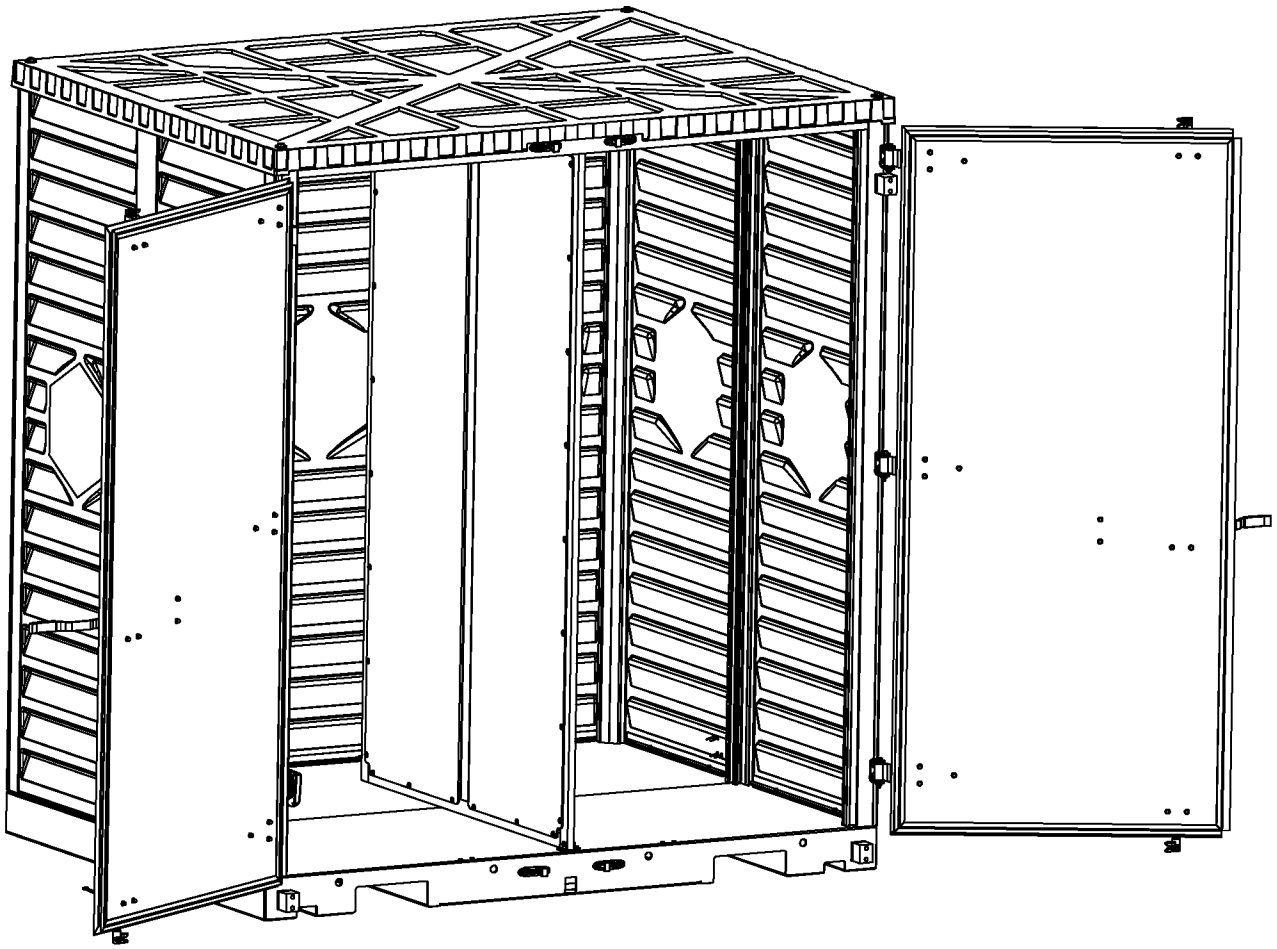
FIG. 34 is a picture of a cargo container attached to a base with the doors open.
Figure 44:
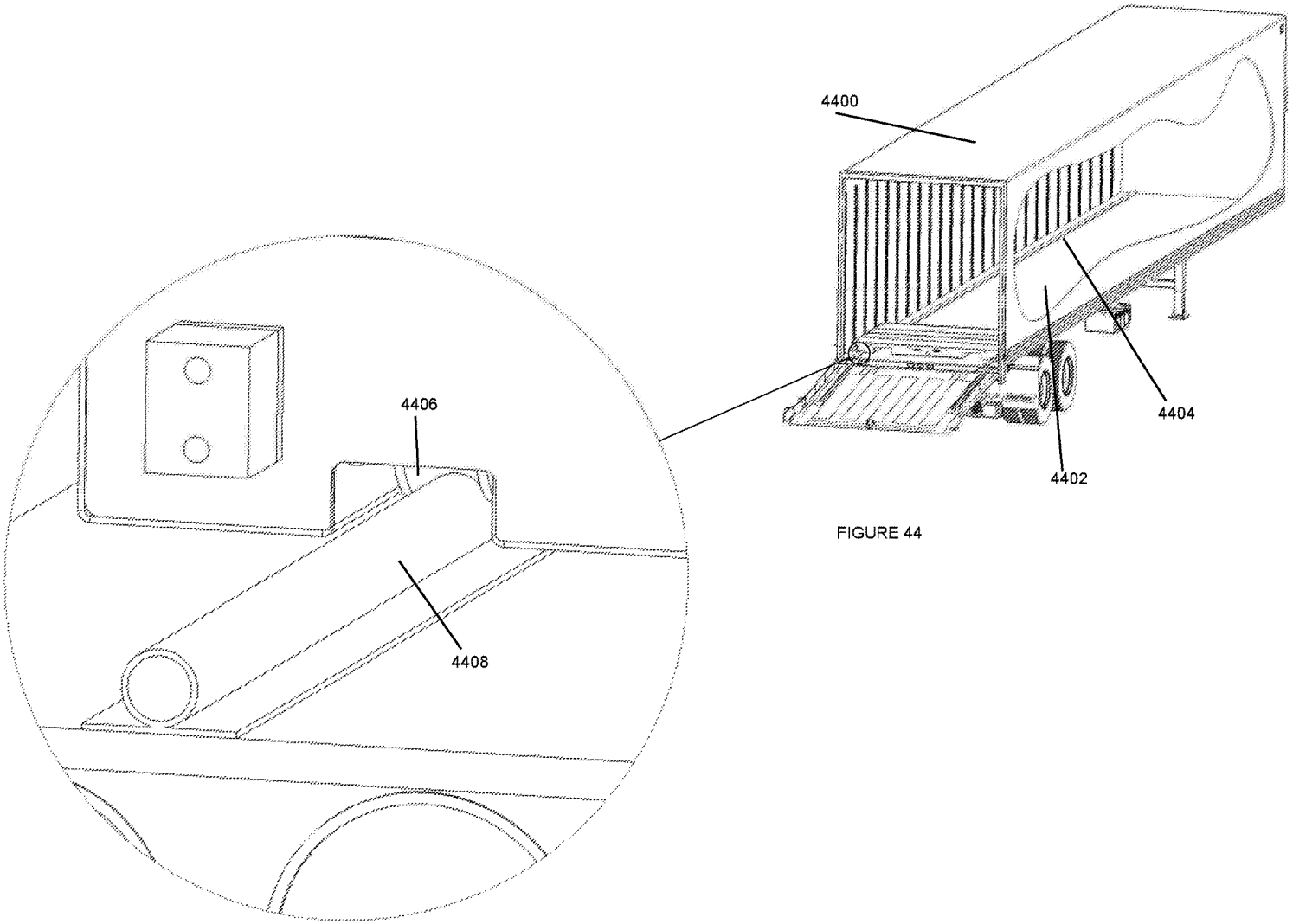
FIG. 44 depicts a back view of a truck with a circular tube shaped track, a round groove wheel and a base.
Figure 45:
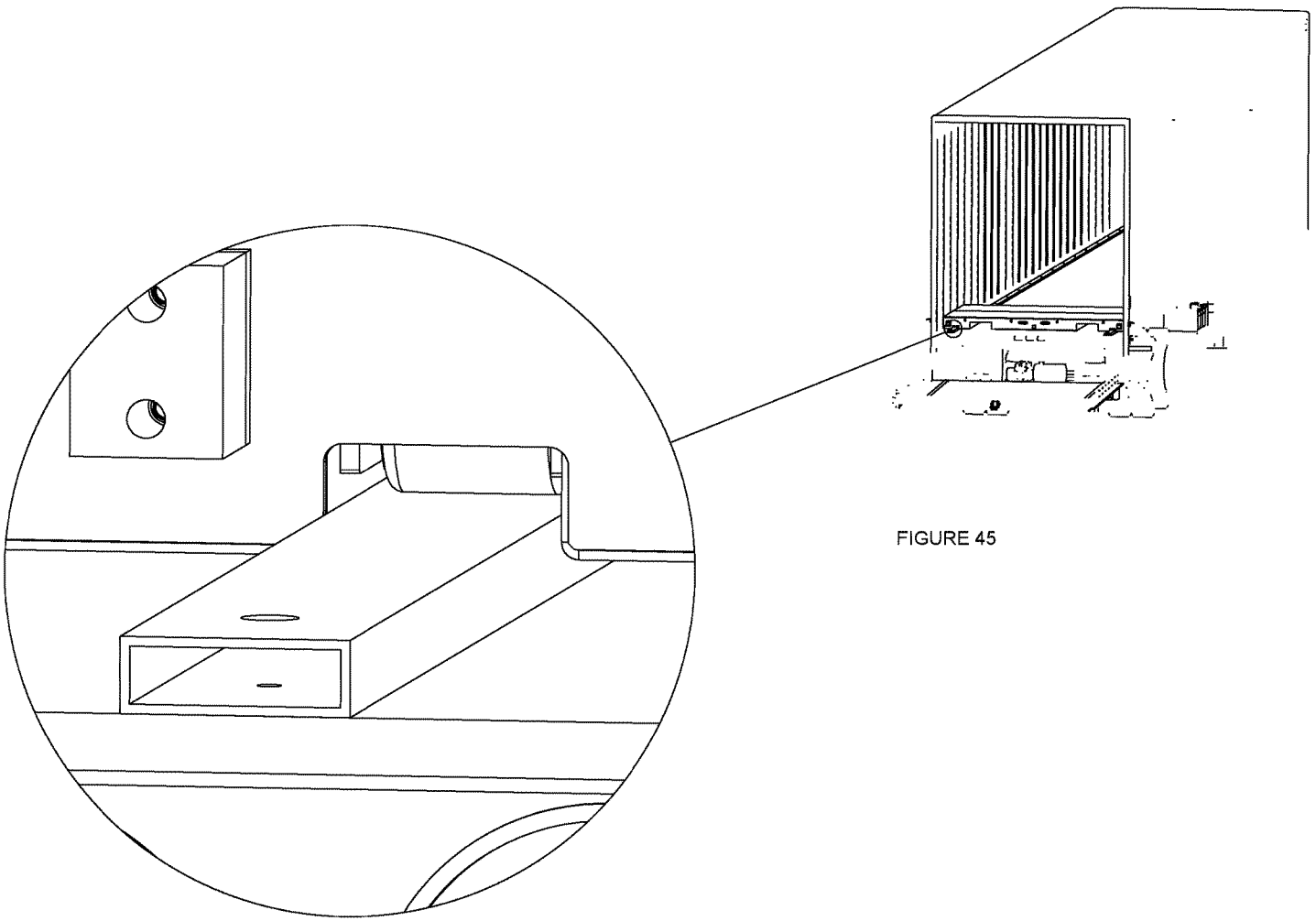
FIG. 45 depicts a back view of a truck with a rounded rectangular wheel and rectangular shaped track.
Figure 48:
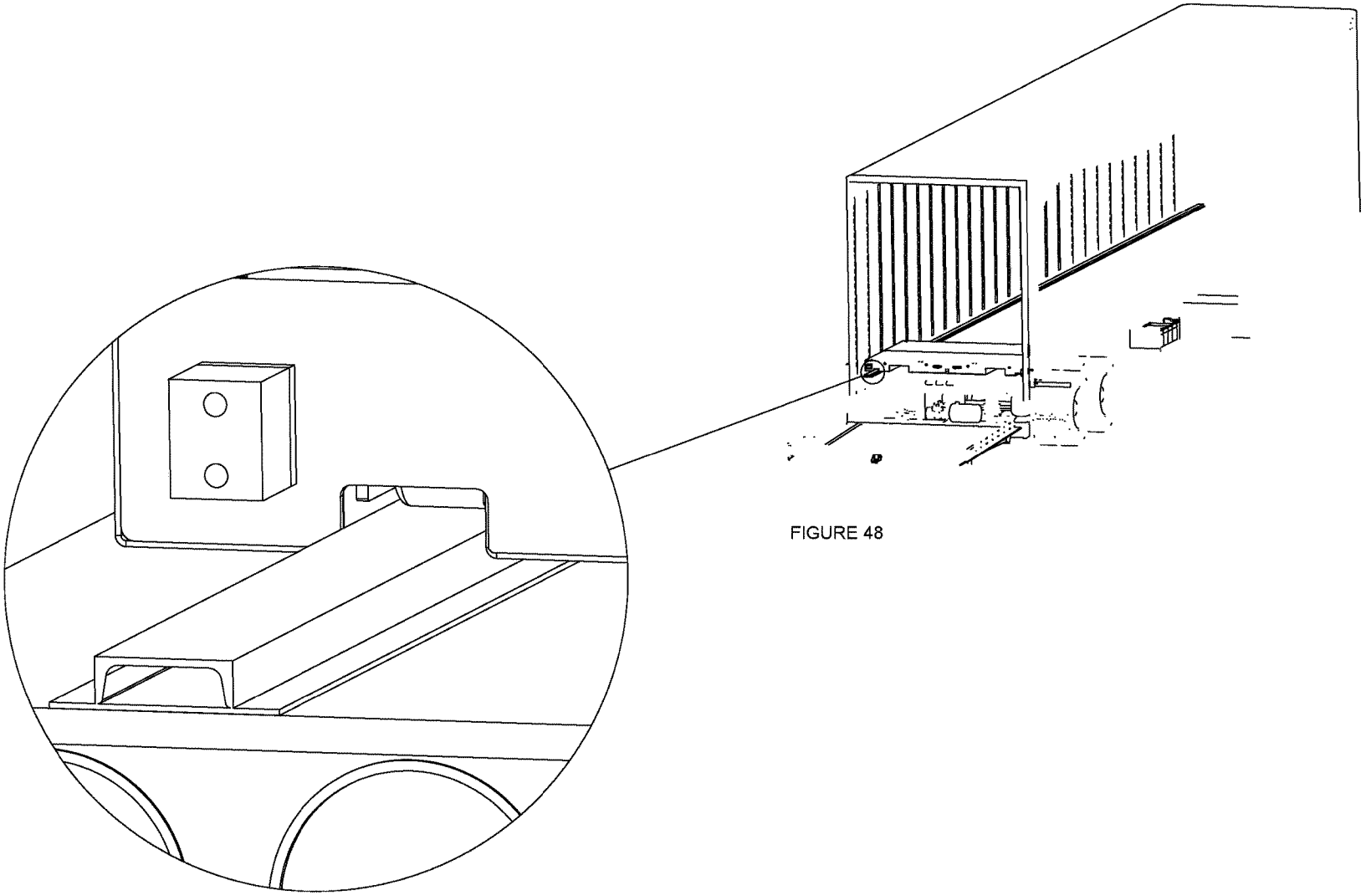
Figure 50:
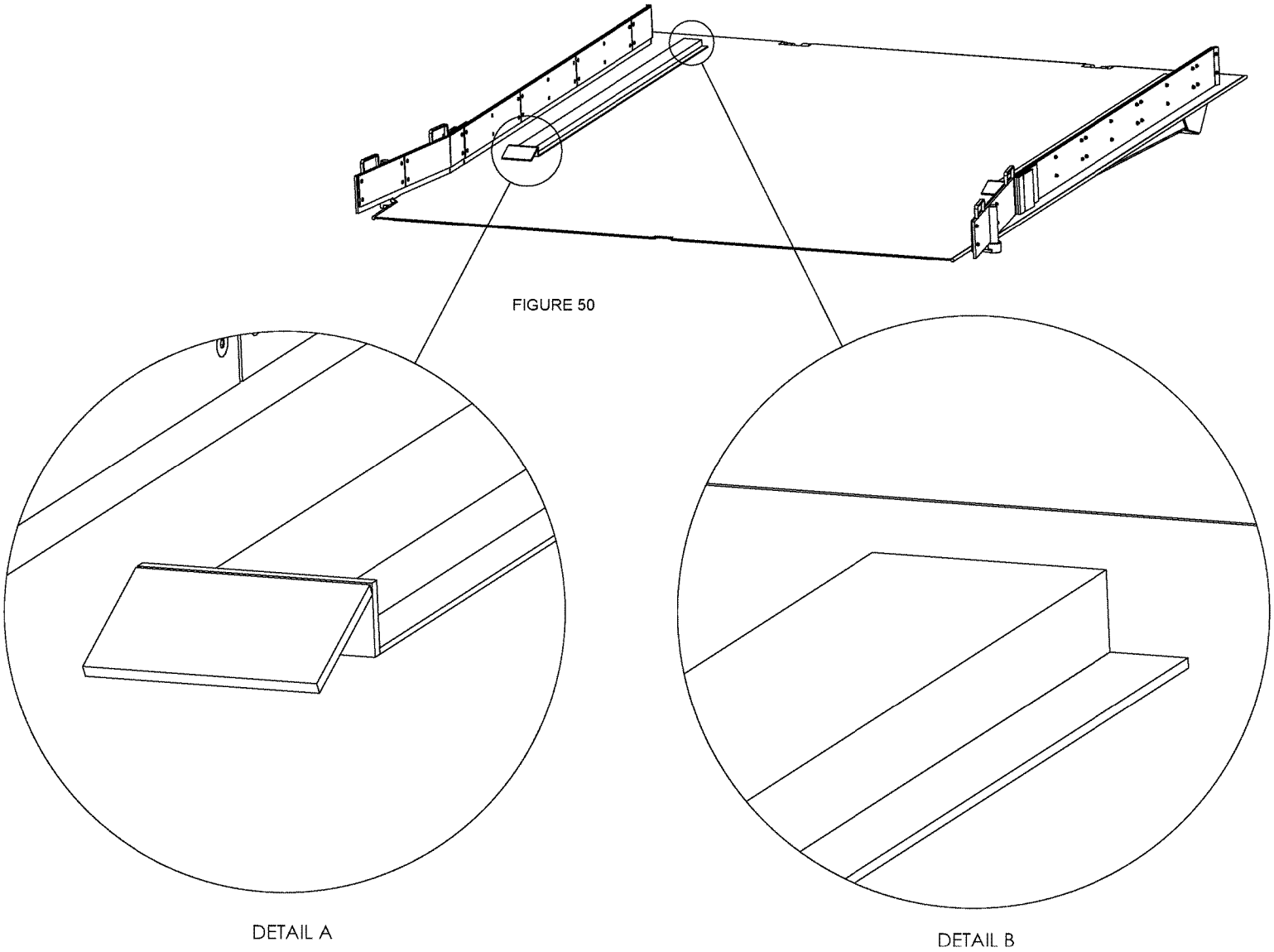
FIG. 50 depicts a liftgate with a rectangular track and a stopper.
Figure 51:
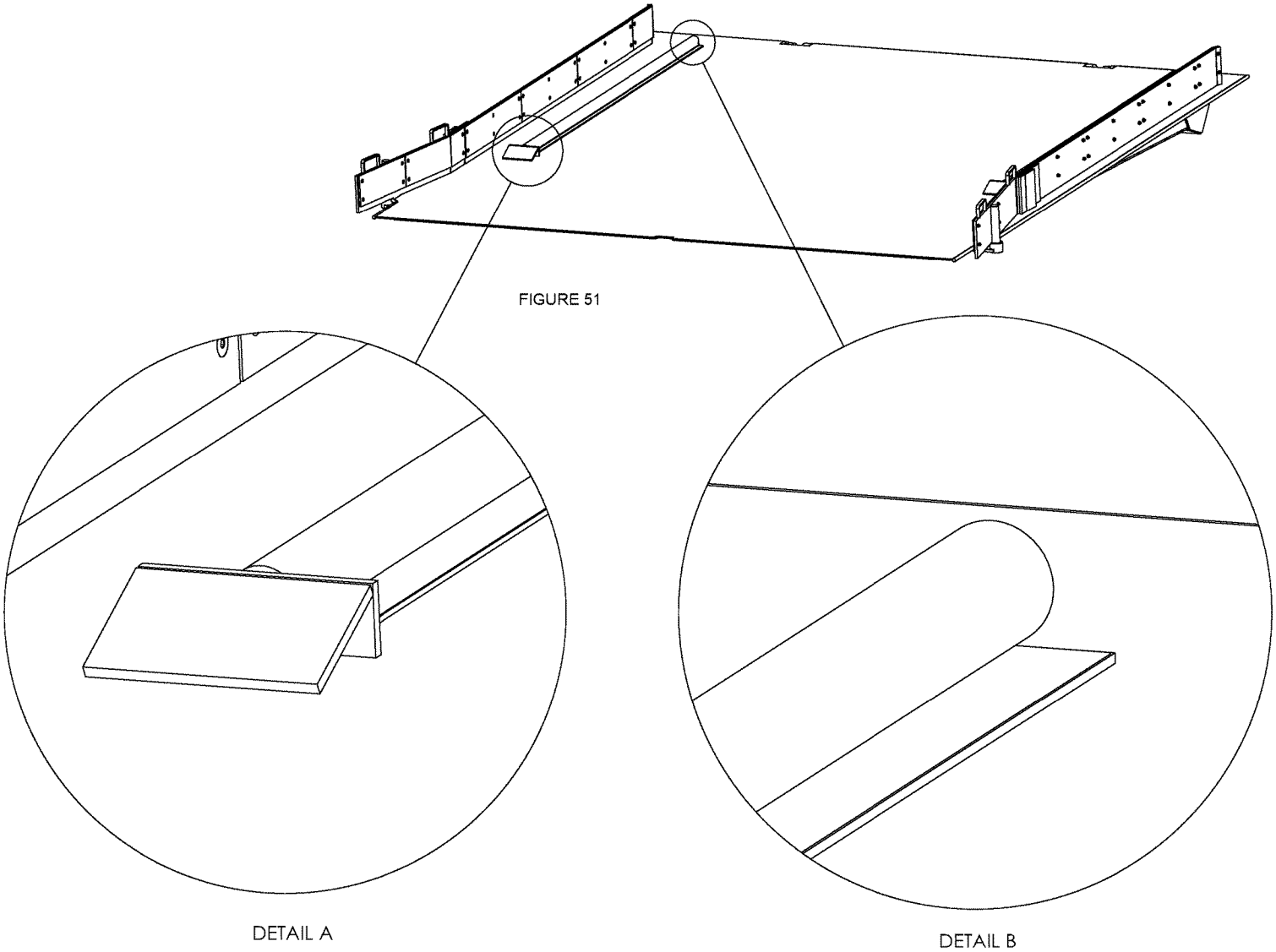
FIG. 51 depicts a circular tube shaped track on a liftgate of a truck and a stopper.
Figure 52:
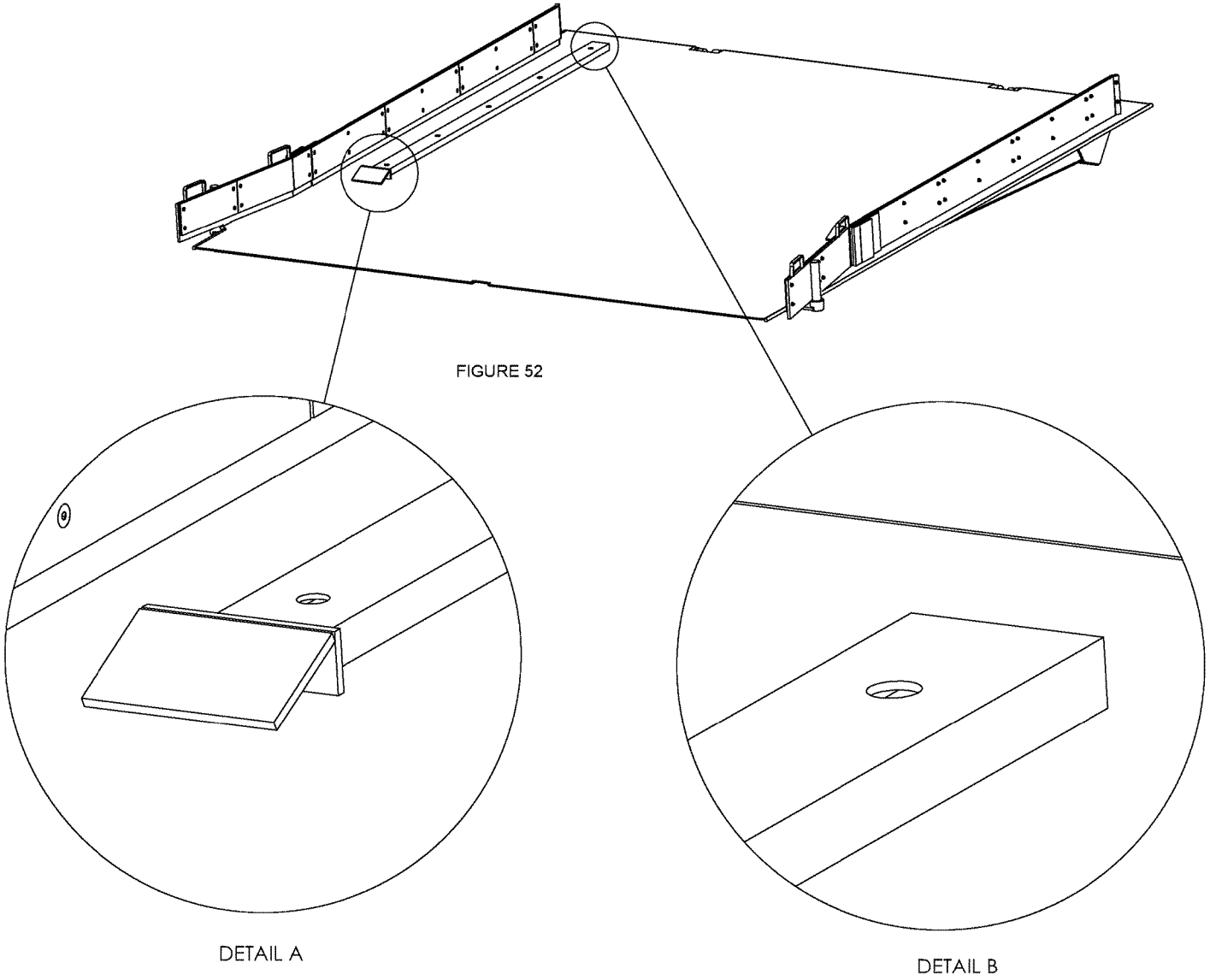
FIG. 52 depicts a rectangular track on a liftgate of a truck and a stopper.
Figure 53:
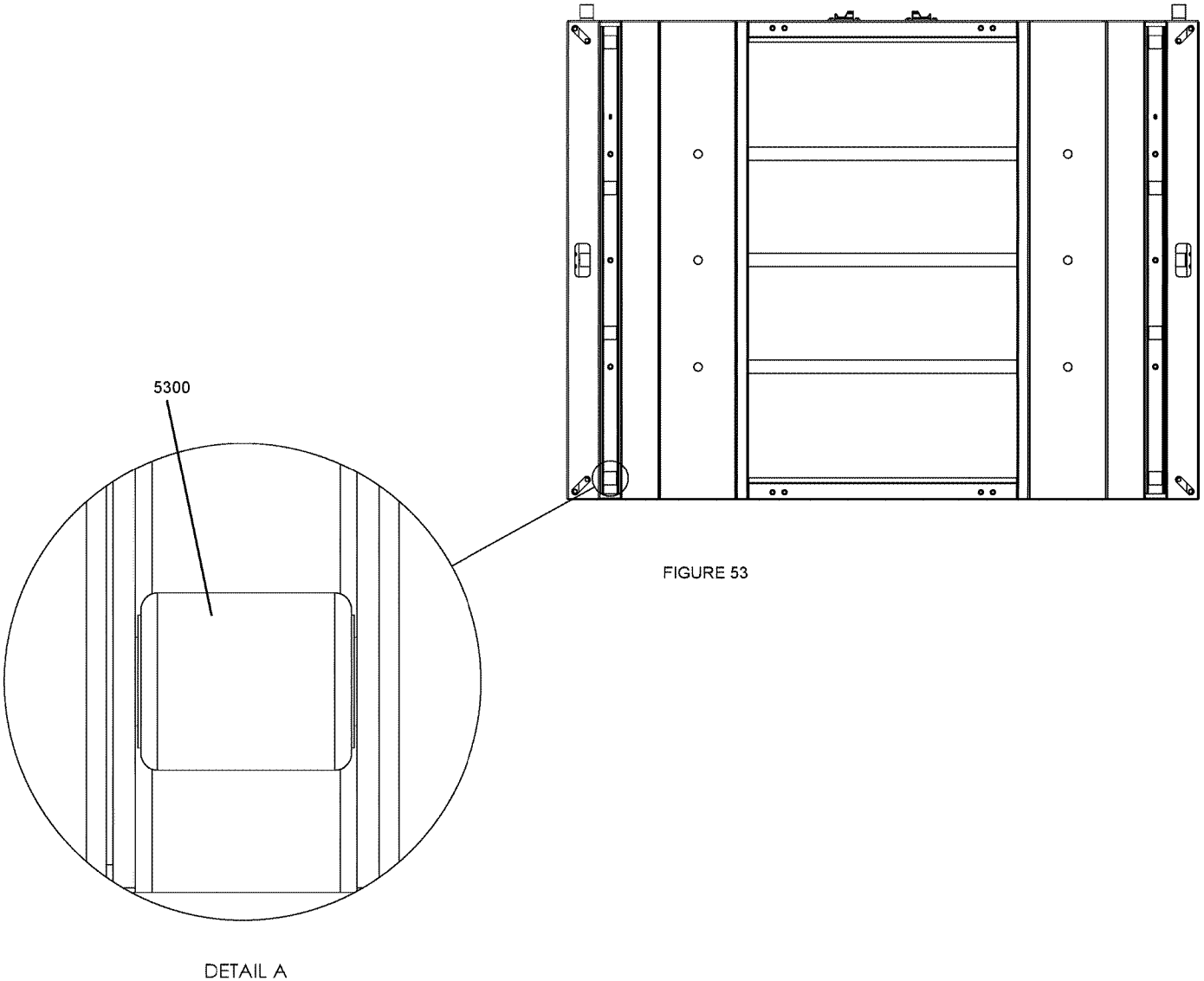
FIG. 53 depicts a bottom view of a base with rounded rectangular wheels.
Figure 54:
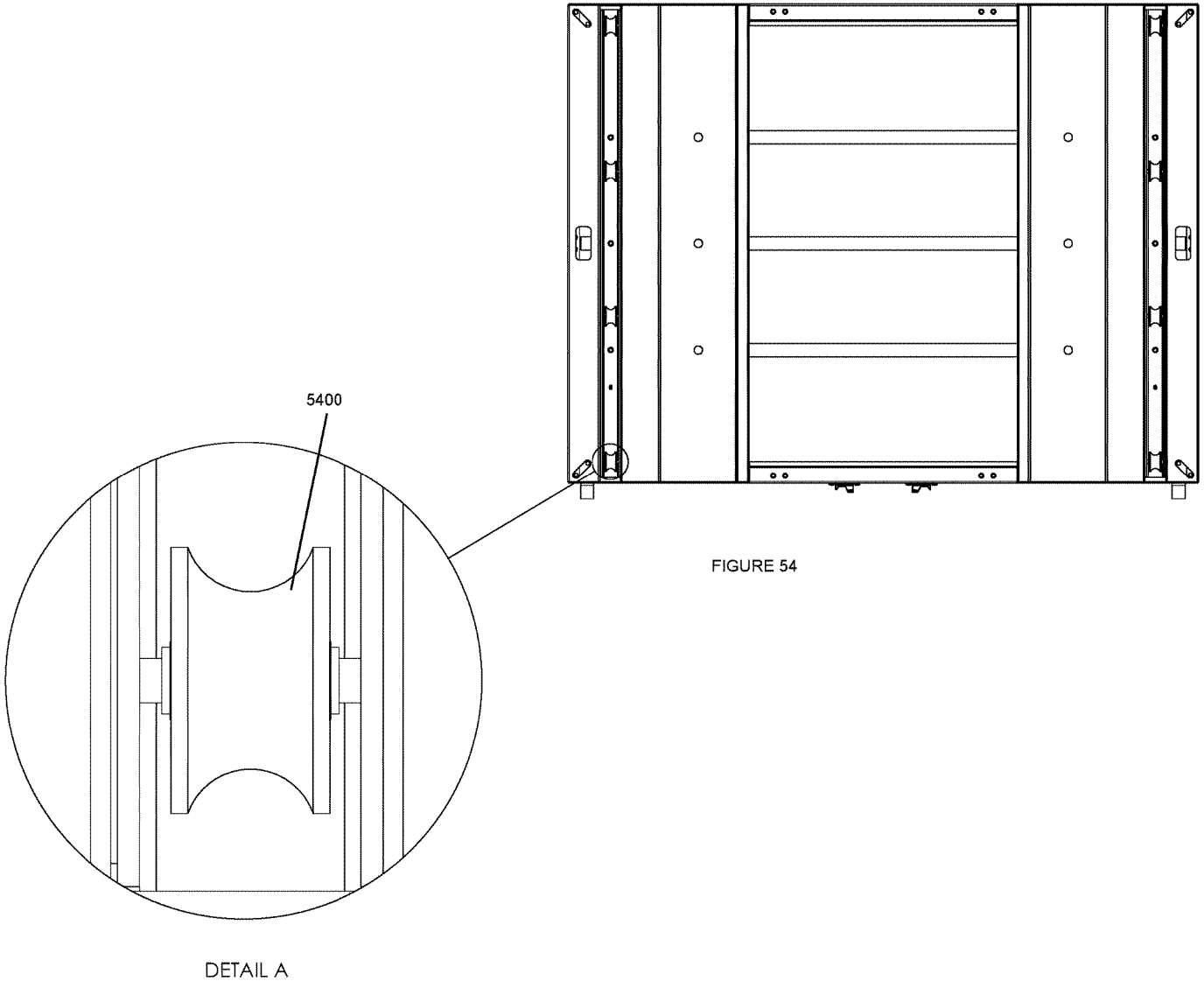
FIG. 54 depicts a bottom view of a base with round groove wheels.
Figure 55:
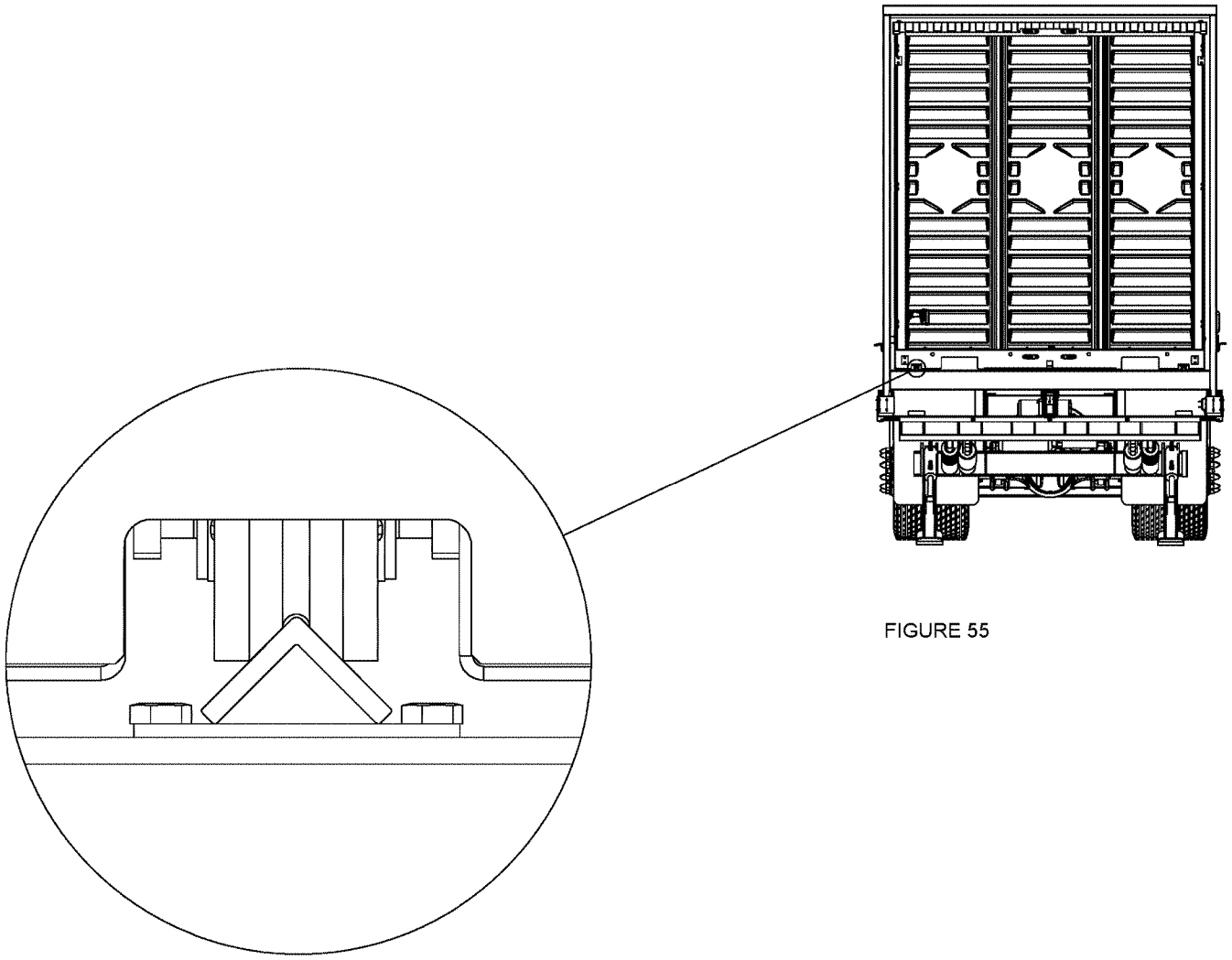
FIGS. 55 and 56 depict a back of a truck with V-shaped tracks and V groove wheels.
Figure 56:
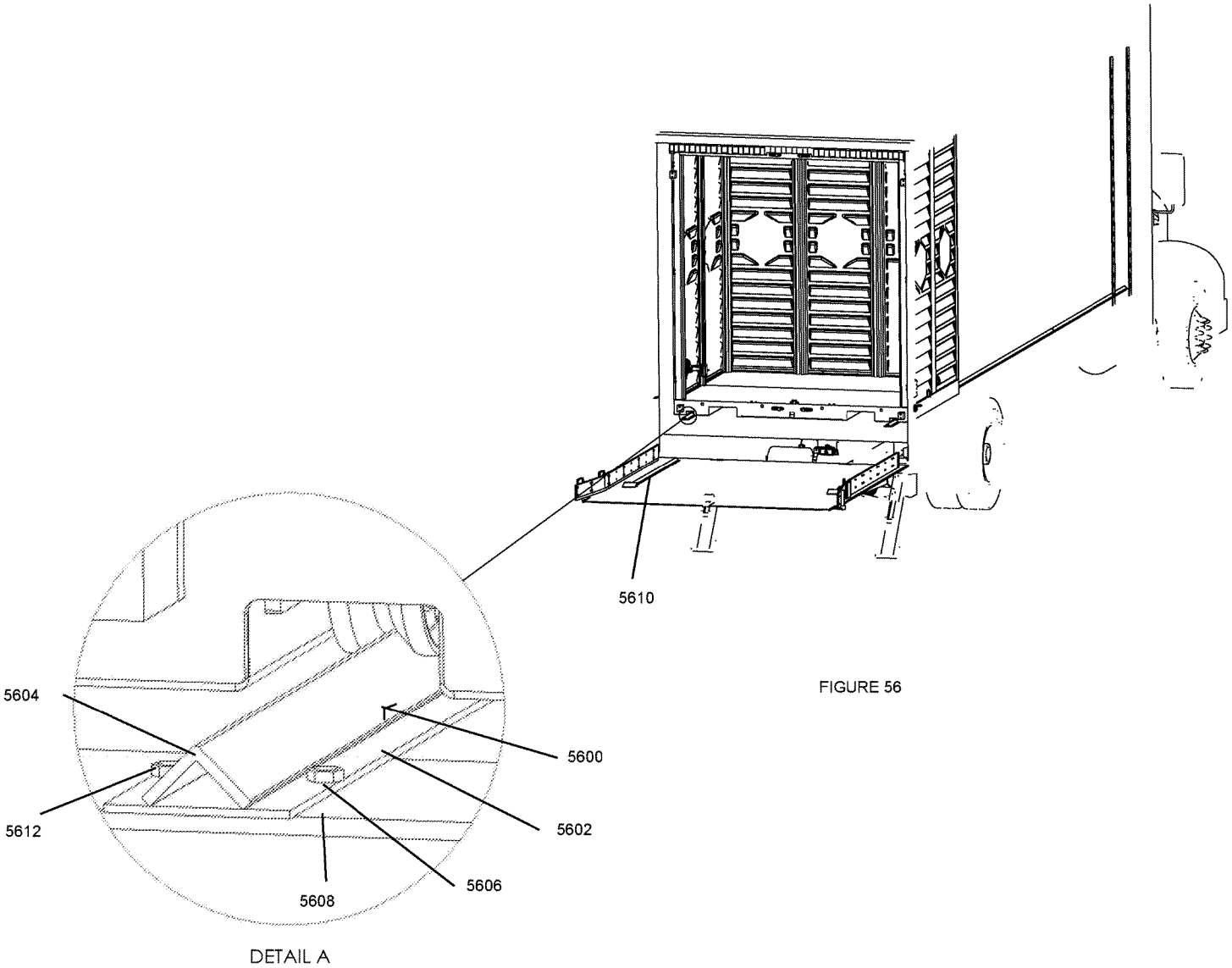
Figure 57:
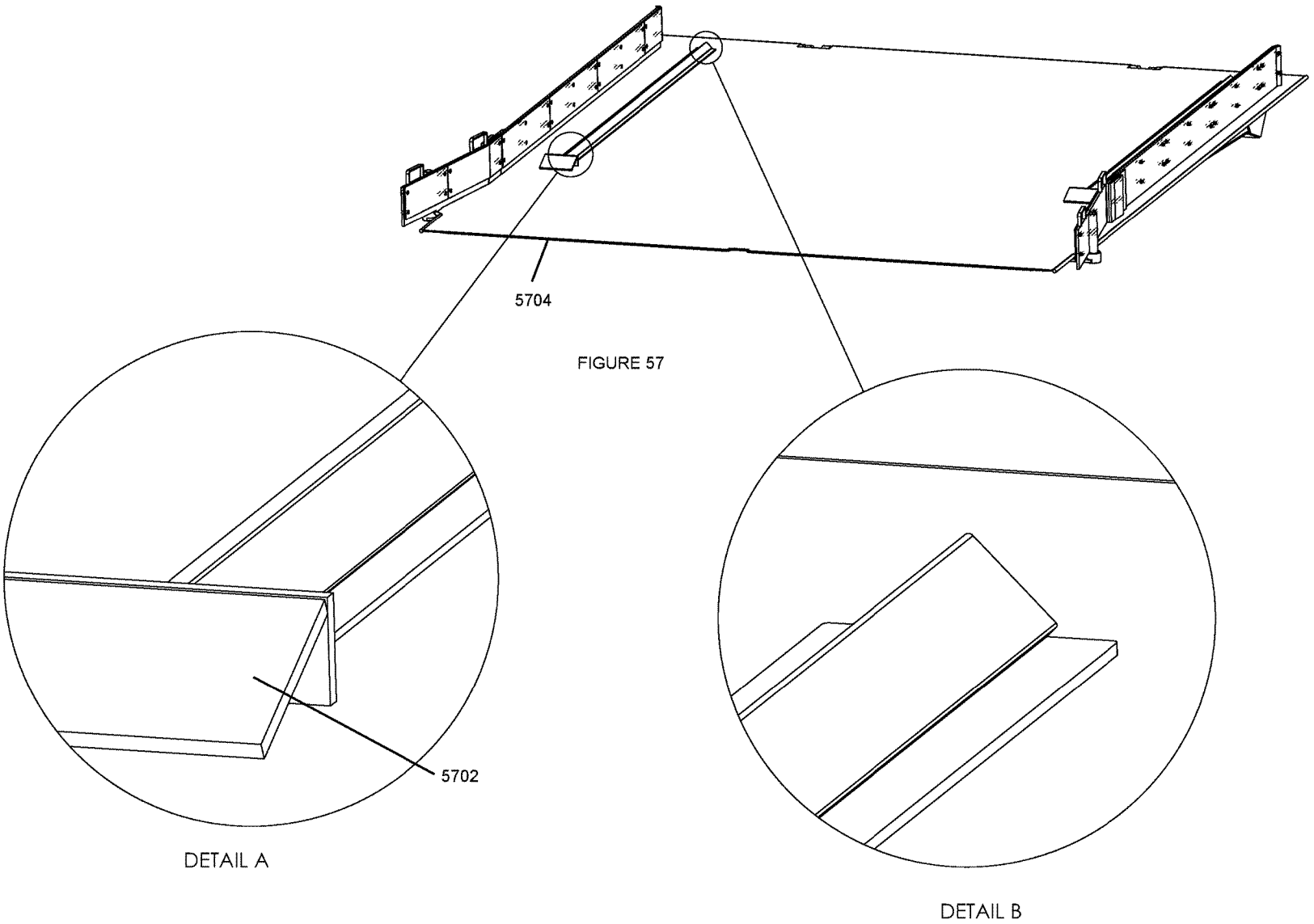
FIG. 57 depicts a liftgate of a truck with V-shaped tracks and a stopper.
Figure 58:
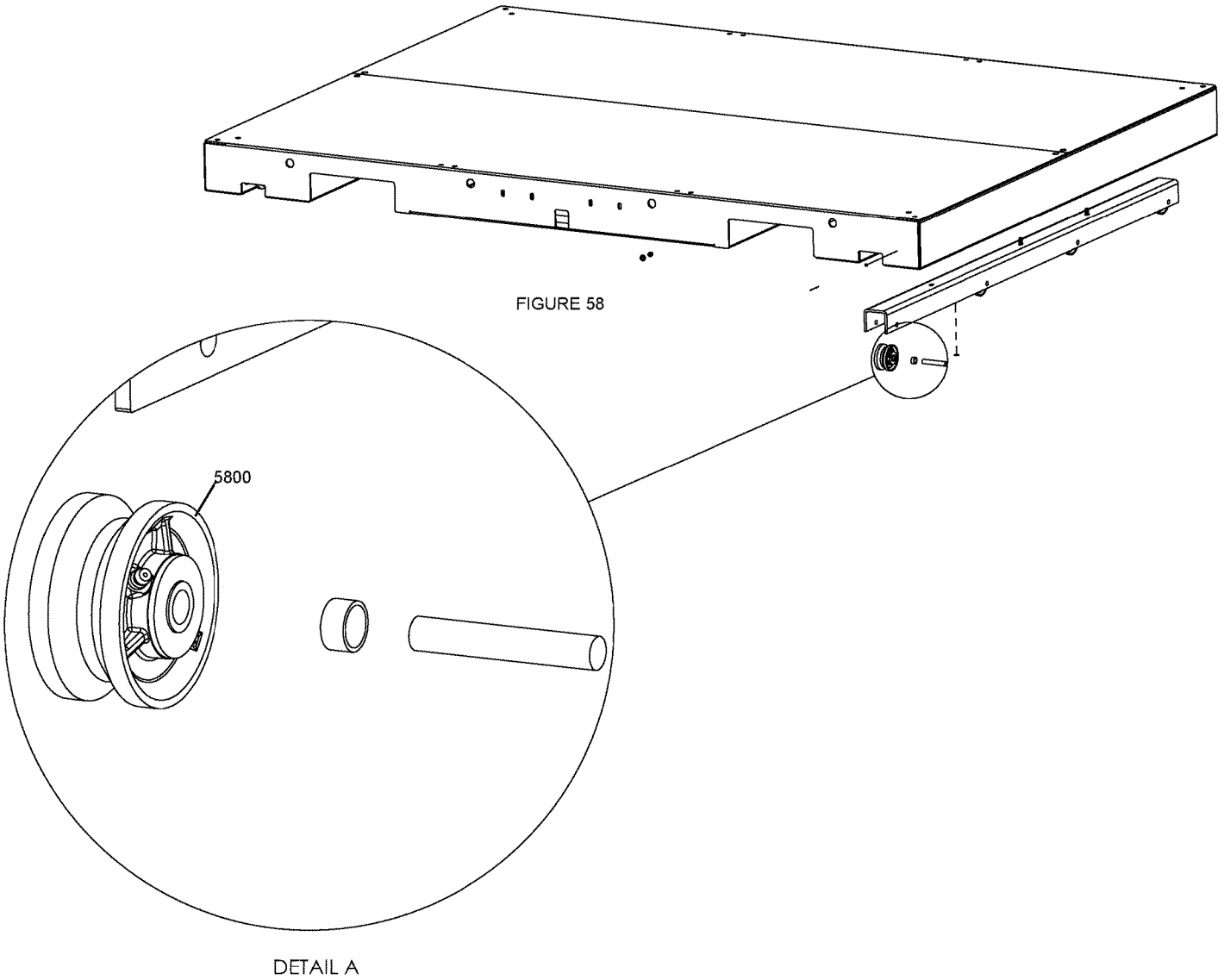
FIG. 58 depicts an exploded view of a base with V-groove wheels.
Figure 59:
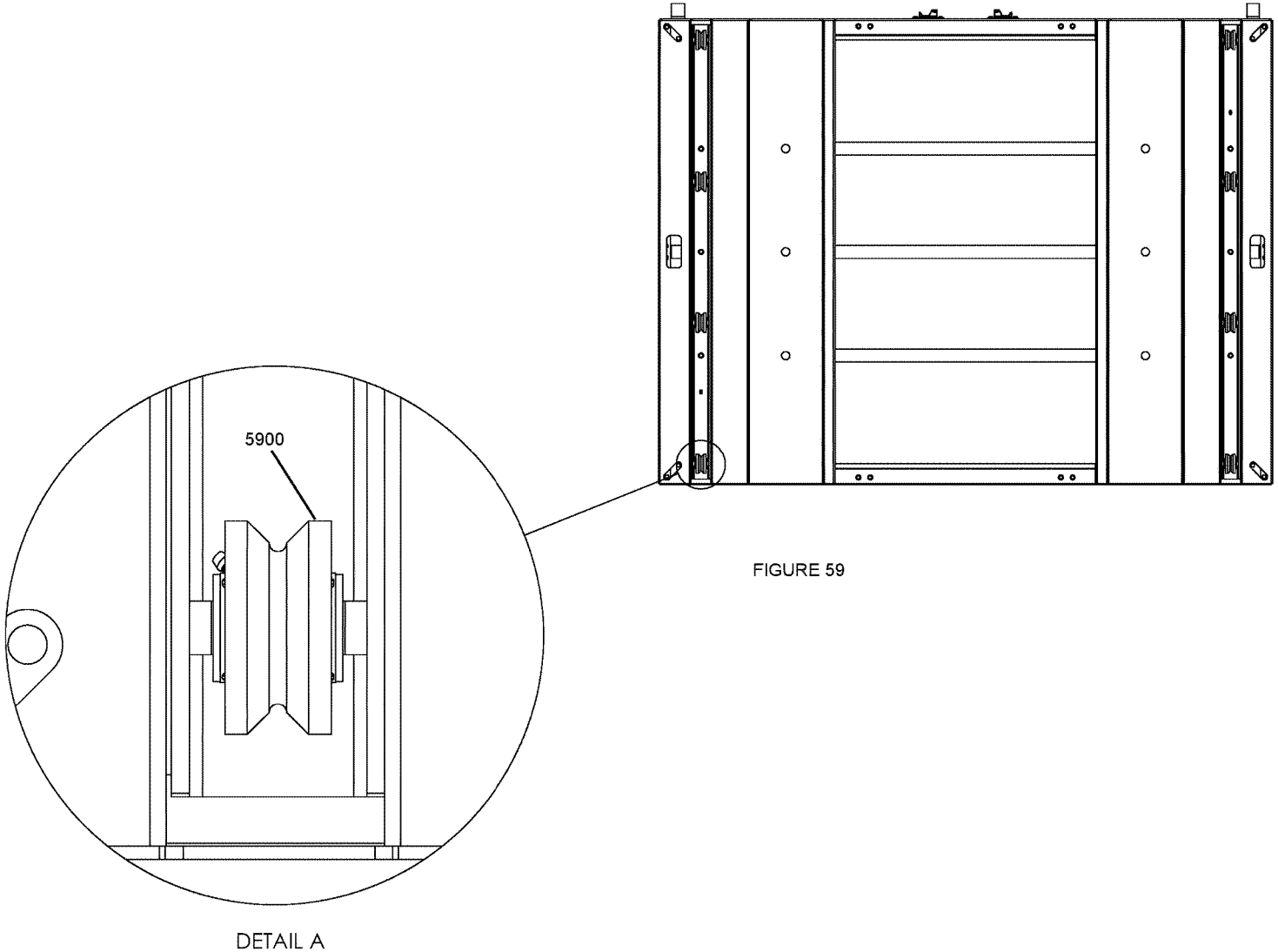
FIG. 59 depicts a bottom view of V-groove wheels in a base.
Figure 60:
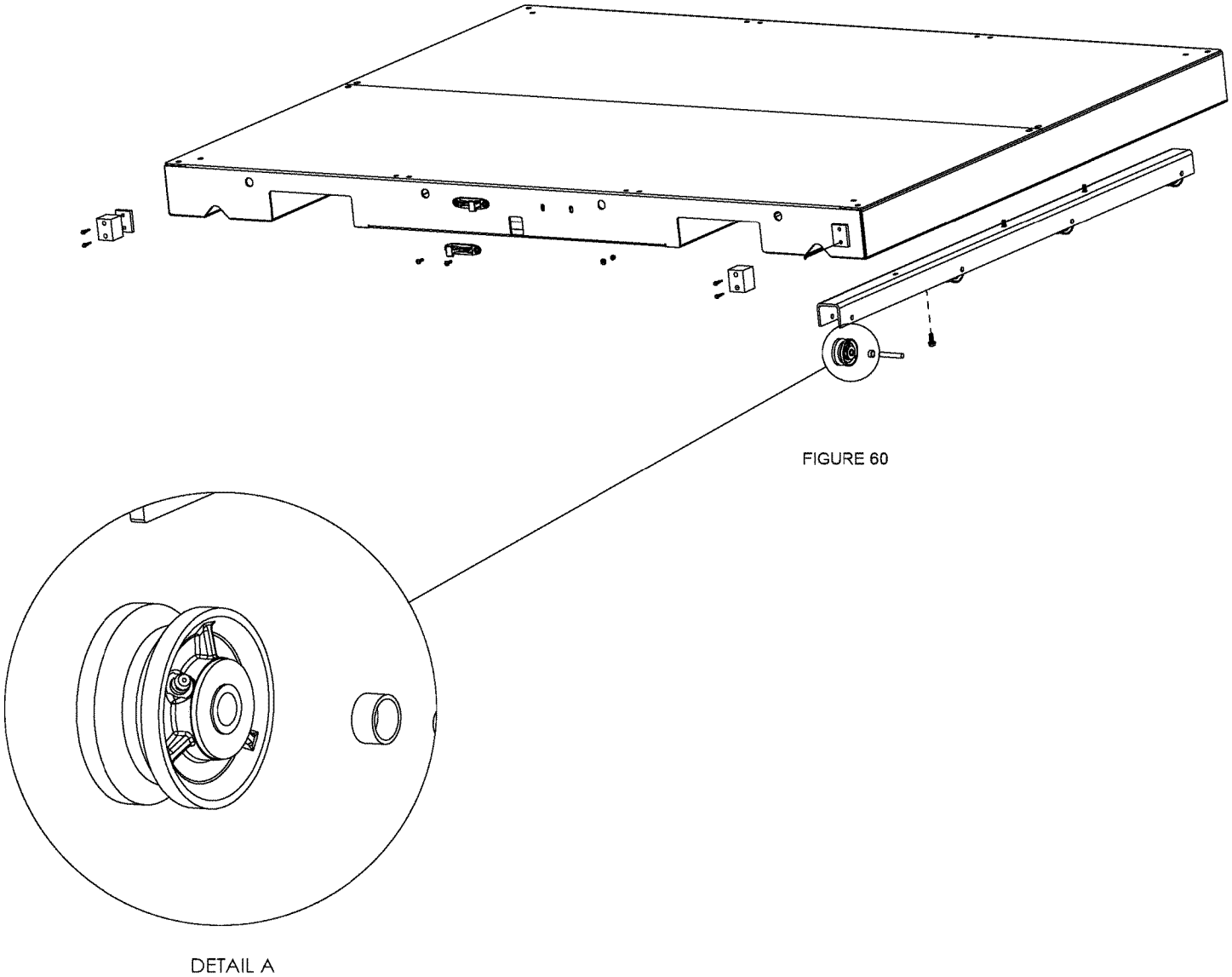
FIG. 60 depicts an exploded view of a base with V-groove wheels and a bumper.
Figure 68:
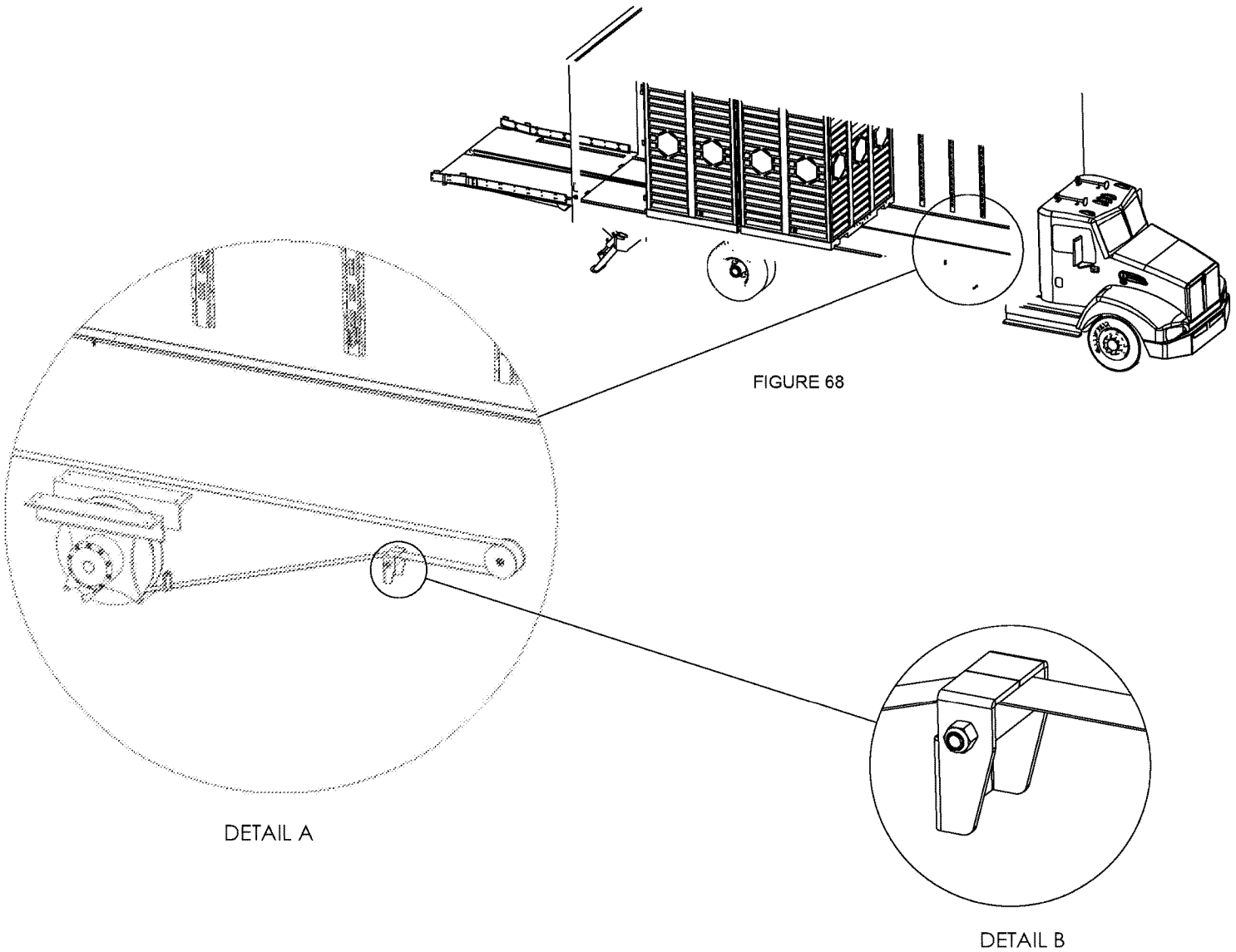

As shown in FIGS. 1-68, the present invention provides a modular shipping container apparatus. According to one embodiment, there is a base (e.g. 2800, 2900, 3000) each base having two support portions (e.g. 2600, 2602) each of the two support portions (e.g. 2600 and 2602) having two substantially open top rectangular shaped spaces (e.g. 2604, 2606, 2608 and 2610) each having a bottom side (e.g. 2702, 2708, 2714 and 2720), a left side (2700, 2704, 2712 and 2716) and a right side (e.g. 2704, 2710, 2716, 2722) and a flat portion (e.g. 2734 and 2736) between the two substantially open top rectangular shaped spaces and at least one set of base holes (e.g. 2724) in at least one of the left side and the right side. There is at least one wheel assembly (2725) that is received between the two substantially open top rectangular shaped spaces (e.g. 2604, 2606, 2608 and 2610). Each wheel assembly has a substantially open bottom rectangular piece (2726) with at least one set of wheel assembly holes (2728) and at least one wheel (2730) with a center opening. The wheel assembly is retained between the two substantially open top rectangular shaped spaces by at least one bar (2732) through the at least one set of base holes (e.g. 2724), the at least one set of wheel assembly holes (e.g. 2728) and the center opening of each of the wheels (e.g. 2730). The at least one wheel is typically retained above the bottom side of the two substantially open top rectangular shaped spaces. The left side of FIG. 27 shows the wheel in a retained position and the right side shows an exploded view of how the wheel assembly is assembled into the area between the two substantially open top rectangular shaped spaces. As shown, a single sheet of metal material may be bent to form a receiving assembly and a channel. It may also be formed of attached pieces without departing from the invention. As shown in, by way of example, FIG. 44, there is a shipping container (4400) with a bottom interior (4402) and having at least two tracks (4404) attached to the bottom interior (4402). At least a portion of each of the at least one wheel assemblies (4406) slides along one of the at least two tracks (4404). The top of the tracks (e.g. 4200) attached to the bottom interior are above the bottom side (4202) of the two substantially open top rectangular shaped spaces. The wheels may be any wheels, by way of example, V-groove wheels (5800, 5900), round groove wheels (5400), rounded rectangular wheels (5300). The two tracks may be any shaped track, for example, V-shaped tracks (5600), U channel track (4900), rectangular shaped track (4204) and circular tube shaped track (4408). The term V-groove wheel is intended to describe that there is a channel in the middle of the wheel that is substantially V shaped to allow the V-grove wheel to slide along a V-shaped track Note that the term V-shaped track refers to the upside down V shape as shown in FIG. 56. Note that the term U channel track, refers to that shown in FIG. 49 which is an upside down U shape. The edges may be squared off or rounded. Each of the tracks typically have a bottom flat portion (5602) and a raised portion (5604). The raised portion is typically that which forms the shape to provide a circular tube shape track, an elongated V shaped track, an elongated U shaped track and an elongated rectangular shape. The flat portion (5602) of the track has at least two openings (5606) and the at least two tracks are removably attached to at least one of the inside (5608) of a transportation container and the inside of a liftgate (5610) of a transportation container by a fastener (5612) attached through each of the least two openings and into at least one of the inside of a transportation container and the inside of a liftgate of a transportation container. The fastener, as shown, is a screw.

Figure 26:
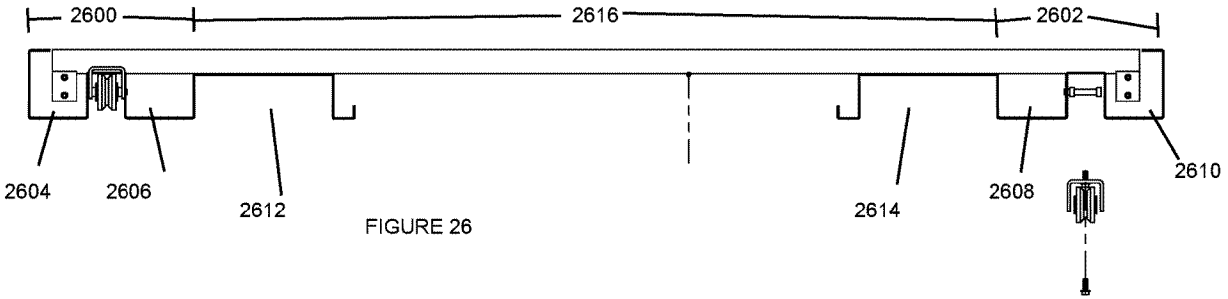
FIG. 26 is a front view of a base.

Each base may have a center portion (2616) with a first channel (2612) and a second channel (2614) to receive a portion of a forklift. There may also be at least one support (2740) on top of the at least two open bottom rectangular spaces and retained by a lip (e.g. 2742, 2744) along an outer edge of two opposed substantially open top rectangular portions. The lip would typically be on the left and right side of the base when looking at the front view of the base (as in FIG. 26). In this way, the supports (e.g. 2740) are retained over and across, substantially perpendicular to, the two substantially open top rectangular shaped spaces (e.g. 2604, 2606, 2608 and 2610). The cover (2802) having a front portion (2804) with at least one wheel assembly opening (e.g. 2806 and 2814) that is aligned with the at least one wheel assembly between the two substantially open top rectangular shaped spaces. The cover (2802) may also have a front portion (2804) with at least one forklift channel opening (e.g. 2810 and 2812) that is aligned with the first channel and the second channel to receive a portion of a forklift. The cover may also have a bumper (3702) attached to the front portion.

Figure 61:
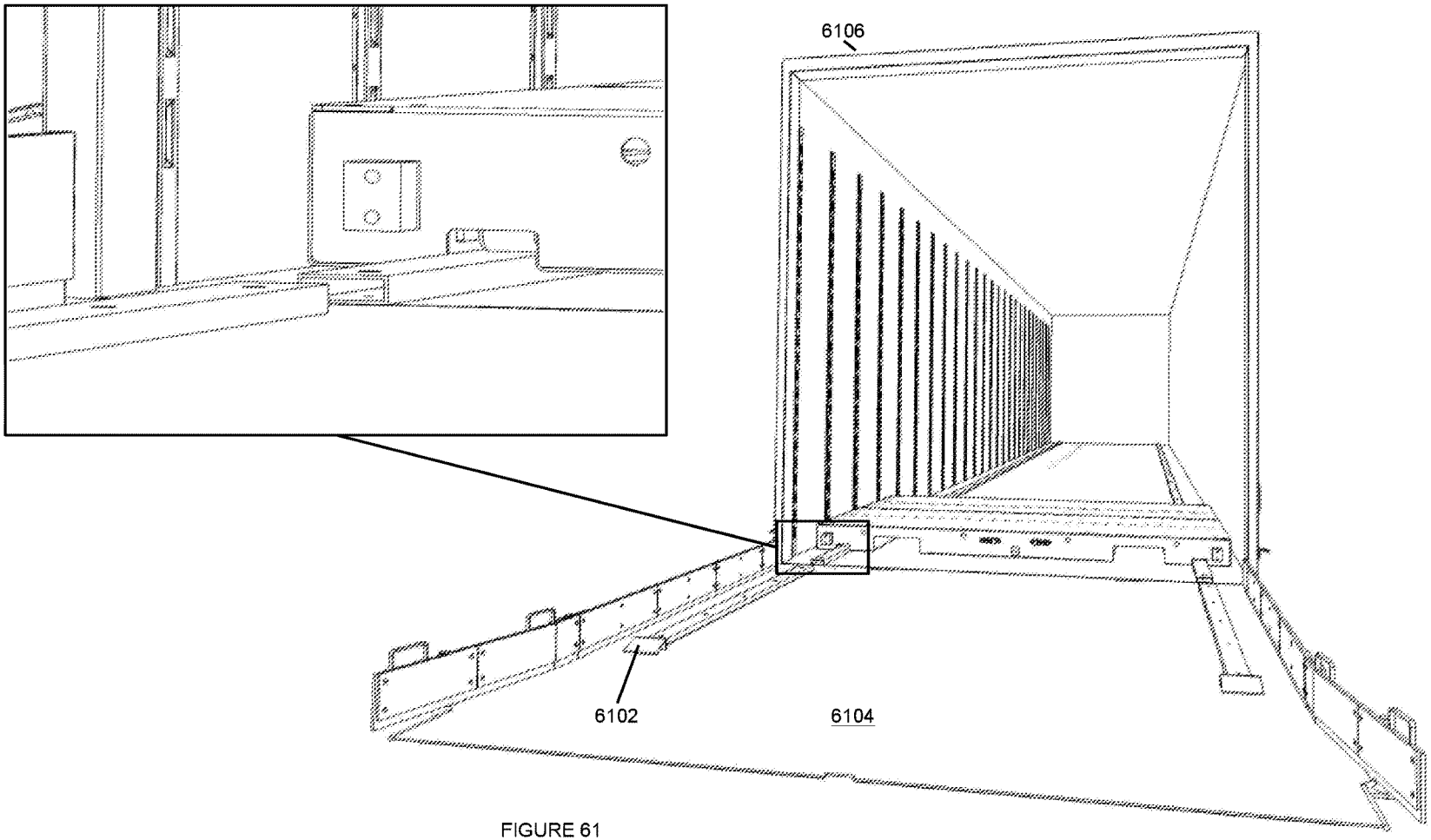
FIG. 61 depicts a rectangular shaped track on a liftgate that is aligned with a track on the inside of a truck.
Figure 62:
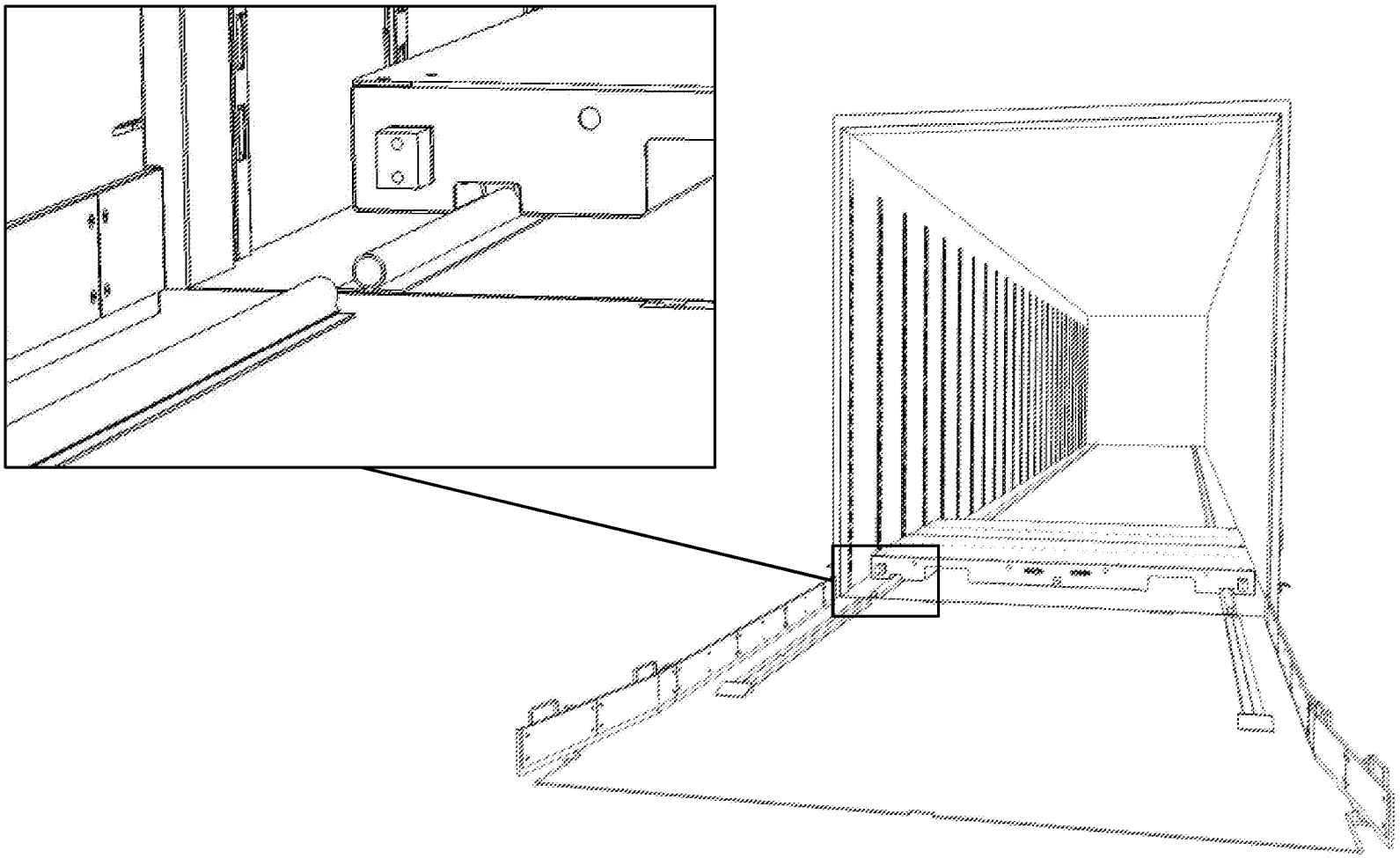
FIG. 62 depicts a circular tube shaped track on a liftgate that is aligned with a track on the inside of a truck.
Figure 63:
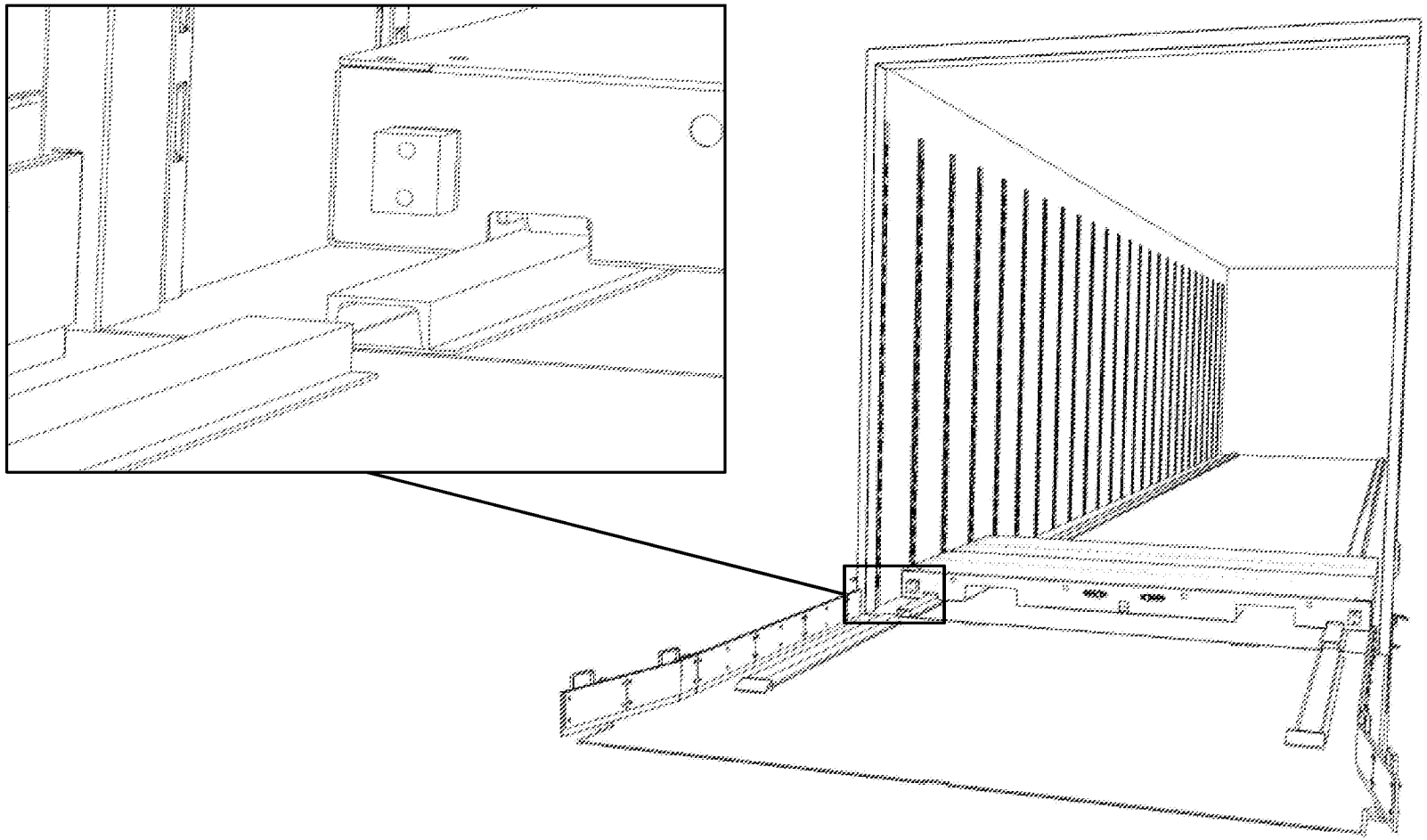
FIG. 63 depicts a U channel track on a liftgate that is aligned with a track on the inside of a truck.
Figure 64:
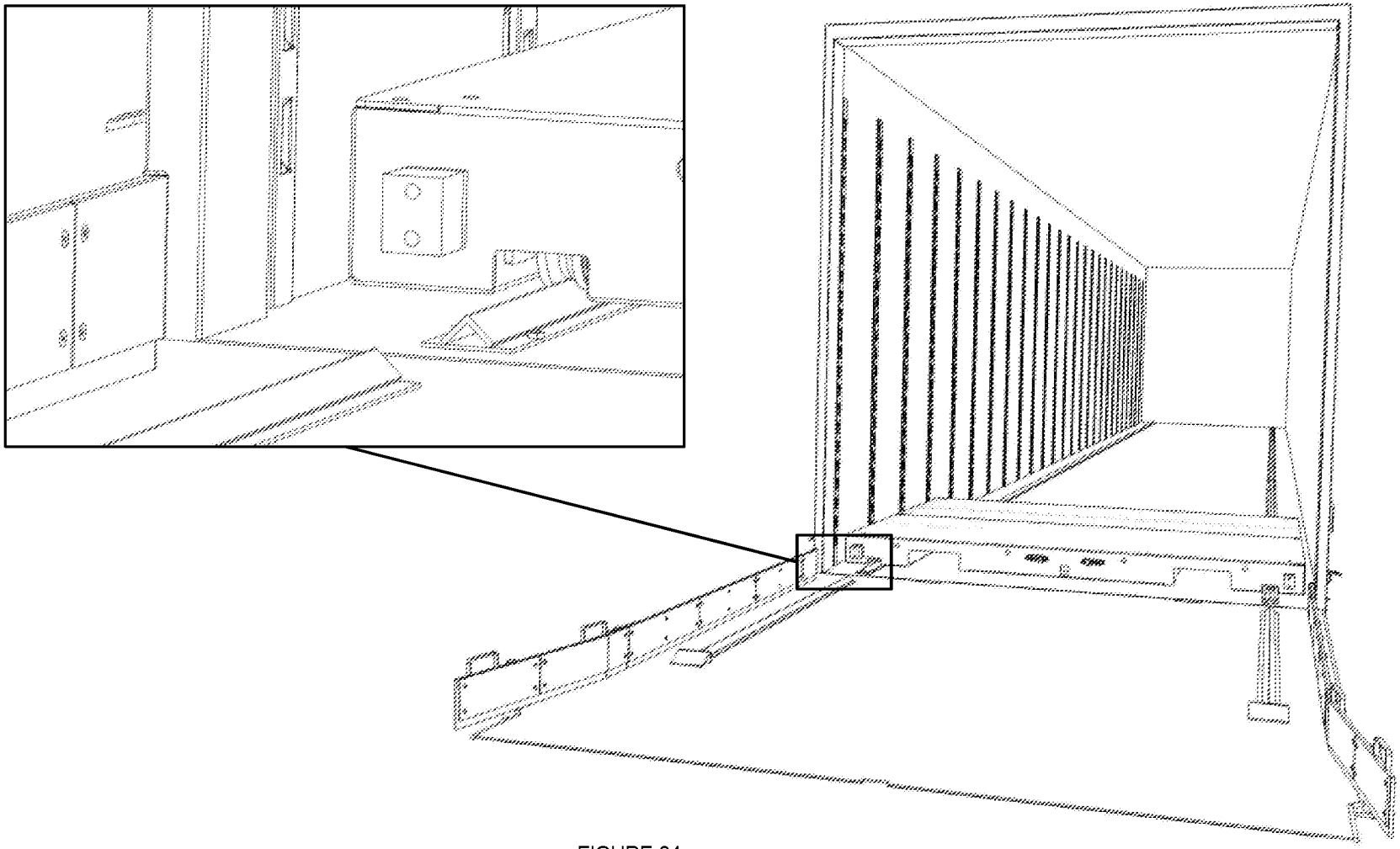
FIG. 64 depicts a V-shaped track on a liftgate that is aligned with a track on the inside of a truck.
Figure 65:
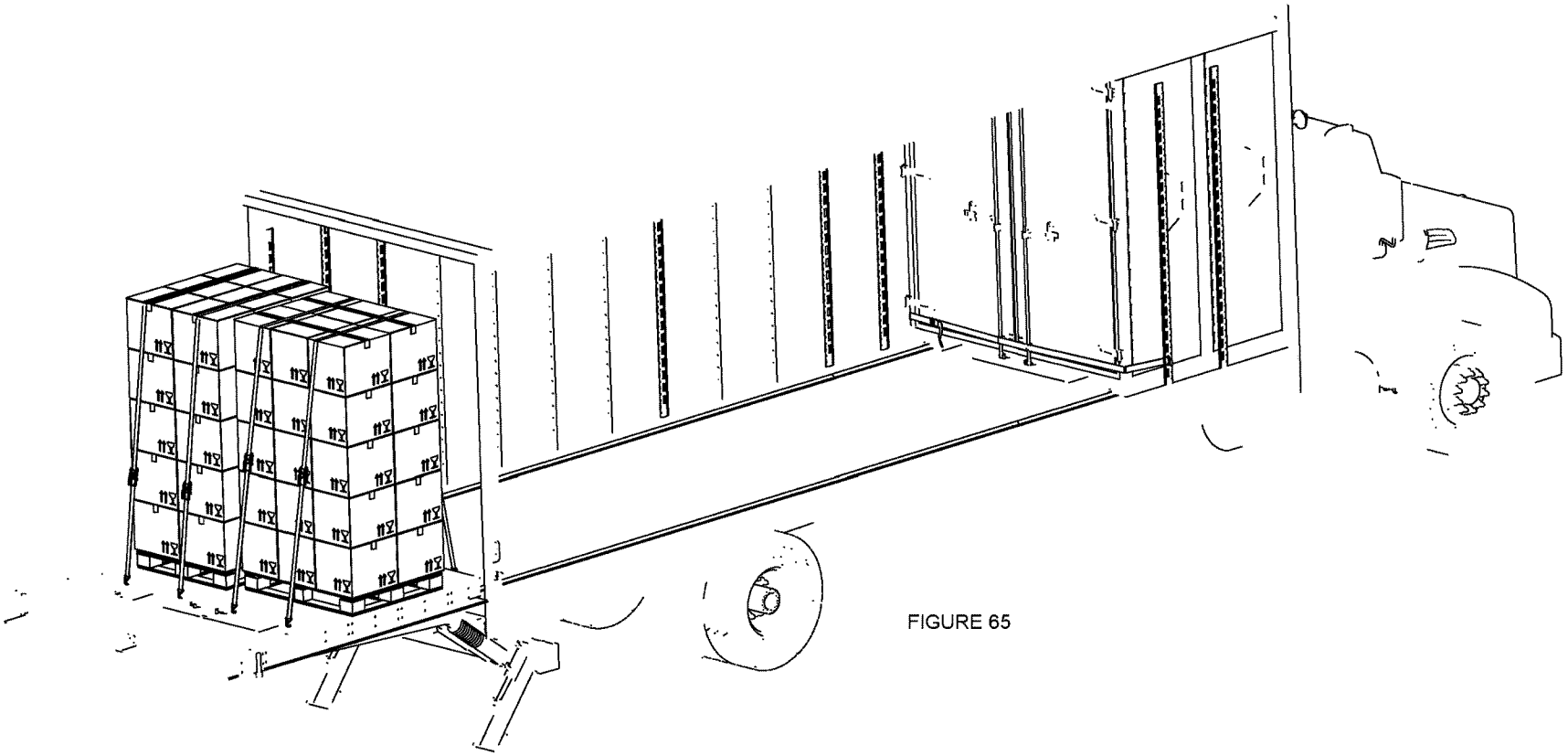
FIGS. 65-68 depicts a truck with a portion of the side removed.

As shown in FIG. 61, a shipping container (6106) with a bottom interior and a liftgate (6104), having at least two tracks attached to the interior of the liftgate, wherein the at least two tracks attached to the interior of the liftgate align with the at least two tracks attached to the bottom interior of the shipping container and at least a portion of each of the at least one wheel assemblies slides along one of the at least two tracks attached to the interior of the liftgate. The close up box of FIG. 61 depicts how the liftgate track perfectly aligns with the track inside the track. The at least two tracks attached to the interior of the liftgate have a stopper (5702) at an end of the at least two tracks that is furthest away from the shipping container. As can be seen in FIG. 61, for example, the liftgate (6104) opens and the track has an end with a stopper (6102) that is furthest away from the shipping container (truck 6106). The stoppers prevent a cargo container base from rolling back.

Figure 66:
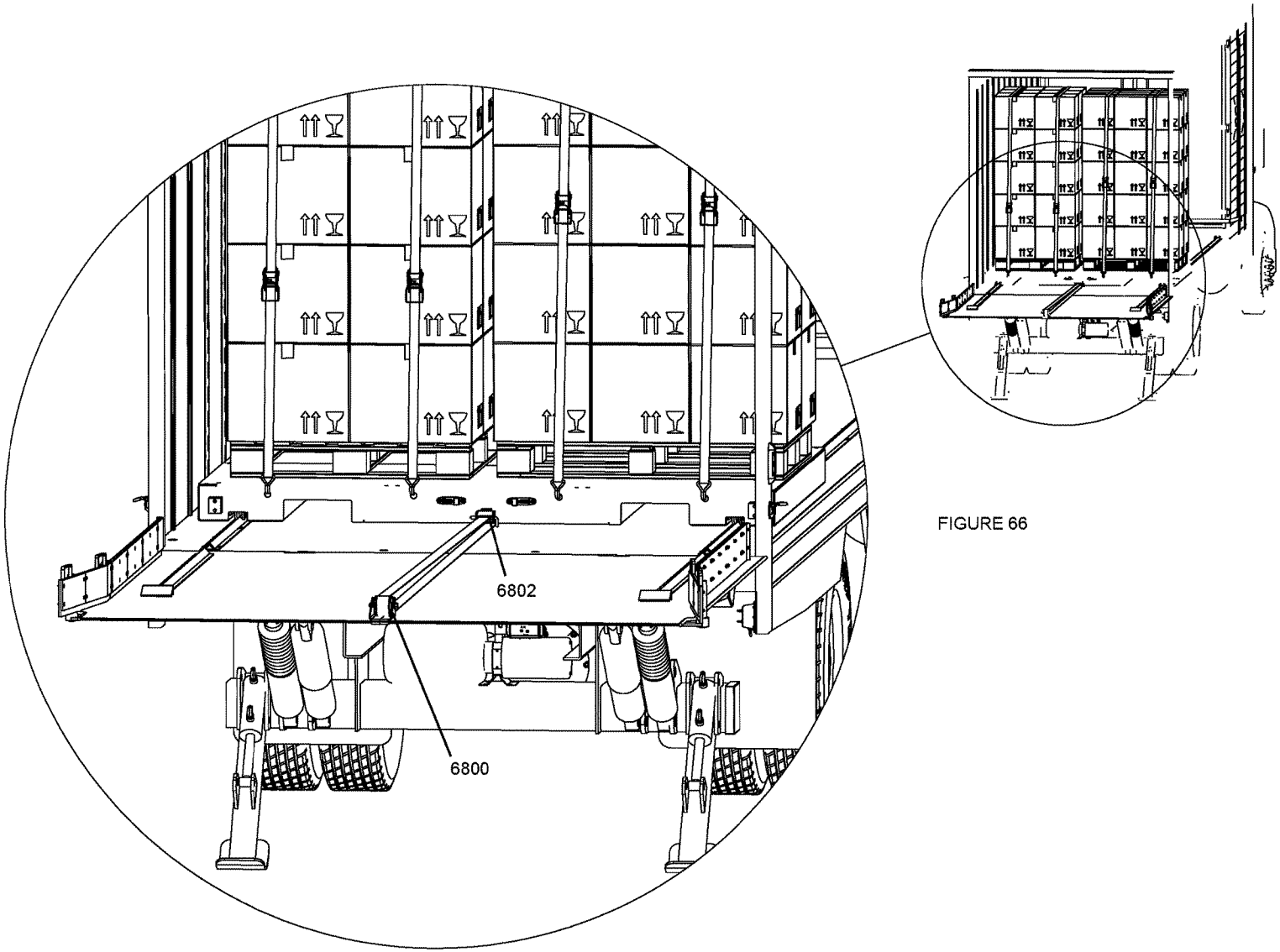
Figure 67:
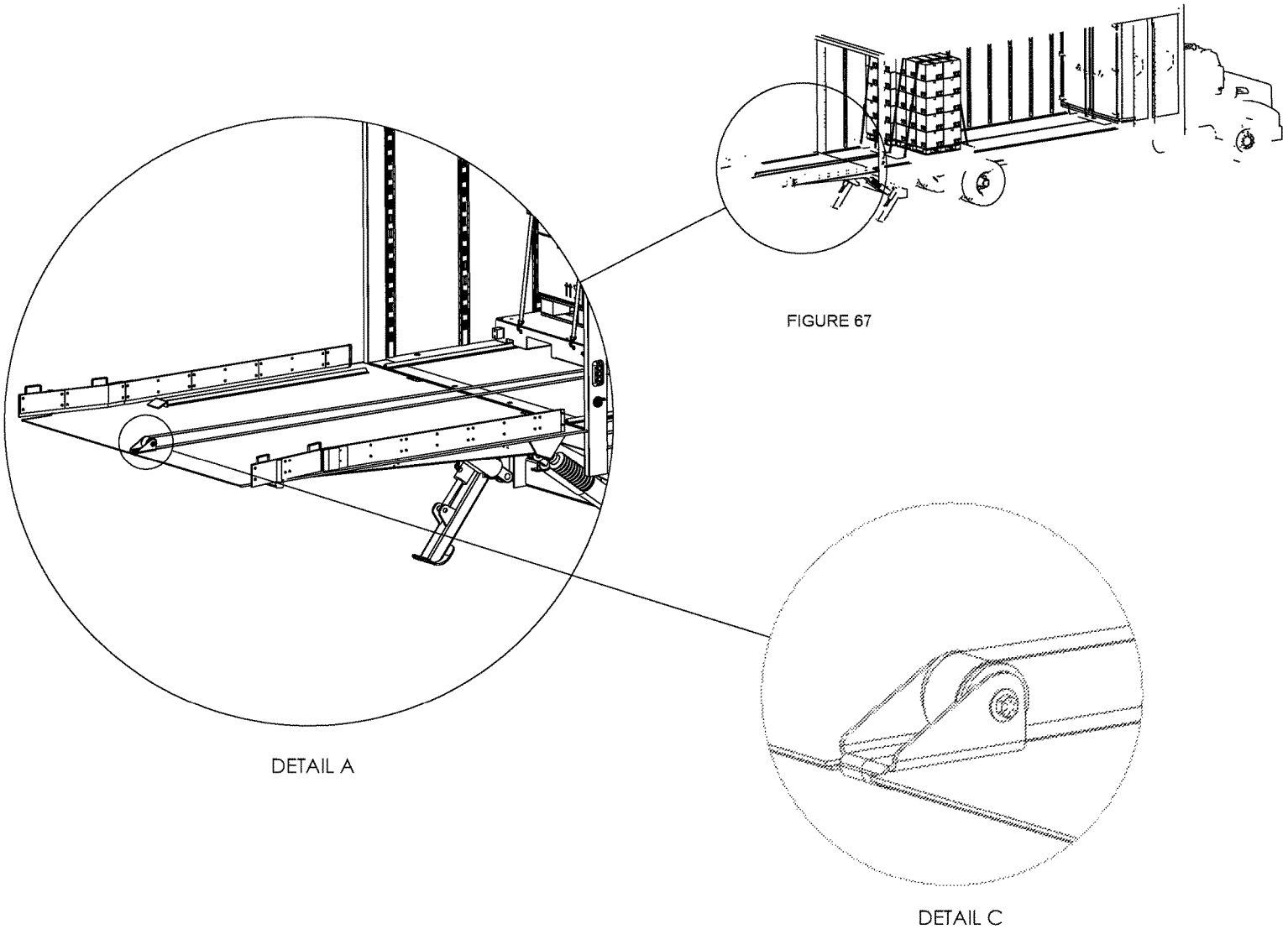

As shown in FIG. 66, there may be a pulley system (6800) assembly attached to the bottom interior of the shipping container and aligned with a center portion opening (6802) of the base along a middle front portion of the center portion opening, wherein a portion of the pulley system assembly threads the center portion opening (6802).

The modular shipping container may have at least four end frame supports (1602) attached substantially perpendicular to the base (1601). Each of the end frame supports e.g. 1602) may have a substantially closed square portion (1604) with four sides and having outer extensions (1606 and 1610) extending from two of the four sides and an additional support (1614) extending from the junction (1612) of the remaining two of the four sides of the substantially closed square portion. The additional support (1614) may have two substantially L-shaped portions (1616 and 1618) that are substantially parallel to the outer extensions (1606 and 1610). Each of the at least four end frame supports having a corner support (1622) that is substantially parallel to the junction. There may be at least three panels (e.g 1624), wherein each of the panels has two S-shaped ends (1641) and at least one of the two S-shaped ends is interposed between one of the two substantially L-Shaped portions (1616 and 1618) that are substantially parallel to the outer extensions. There may be at least three rectangular frames (e.g. 1626 and 1628) each being removably attached to a corner support, a top (1620) attached to the at least three rectangular frames. The at least three rectangular frames may extend above the corner support and the at least three panels. There may be at least one door (1630), each at least one door attached by at least one hinge (1631) to one of the outer extensions of one of the at least four closed end frame supports. There may also be a ratchet extension (1632) extending from the corner support. There may be a female threaded hole, for receipt of a corresponding screw, between the two substantially L-shaped portions (1616 and 1618) that are substantially parallel to the outer extensions (1606 and 1610) and a brace having a hole at a first end and a hole at a second end, wherein a first screw is inserted through the hole at a first end and into a female threaded hole of one of the at least four end frame supports (1602) and a second screw is inserted through the hole at the second end and into a female threaded hole of another one of the at least four end frame supports (1602).

There may also be at least one center support (1650) attached to the base (1601) between two of the at least four end frame supports (e.g. 1602). The center support does not need to be in the center of the base, it may be anywhere between the at least four end frame supports. The term center is merely intended to denote that it is not at the corners, where the end frame supports are. It is also noted that the number of panels may be adjusted according to the number of center supports. The present invention envisions any number of center supports and panels between the end frame supports. This is a purpose of the invention to accommodate and allow for different sized cargo containers to be attached to the base. It may also be desirable to have more sturdy, reinforced boxes or lighter less reinforced boxes, depending on the cargo. The center support has a closed square center portion (1652) with four sides and four corners and center extensions (1654, 1656, 1658 and 1660) extending from each of the four corners of the closed square center portion, two partially open rectangular portions (e.g. 1662 and 1664) each between two center extensions and having an opening on a side away from the closed square center portion (1652) for the receipt of one of the two S-shaped ends (e.g. 1666 and 1668) of one of the panels. There may be two substantially L-shaped portions (e.g. 1670 and 1672) that each extend from one of the four corners and are substantially perpendicular to the center extensions. The substantially L-Shaped portions (e.g. 1670 and 1672) are typically faced in opposing directions. There may be a center support female threaded hole for receipt of a corresponding screw in at least one of the two partially open rectangular portions (e.g. 1662 and 1664) and a brace having a hole at a first end and a hole at a second end, wherein a first screw is inserted through the hole at a first end and into a center support female threaded hole and a second screw is inserted through the hole at the second end and into a female threaded hole of another center support.

There may also be partition (1700) having a top (1702), bottom (1704), a first side (1706) and a second side (1708), wherein one of the first side (1706) and the second side (1708) is between and supported in an upright position by the two substantially L-shaped portions (e.g. 1670 and 1672.

There may be at least one header support (1900) attached to the at least one center support (1650) at an end opposite the base and below the top and in communication with the top. There may also be one top cross support (1902) between at least one of the end frame supports, the center support and the header support. There may further be at least one side support (1904) substantially proximate to at least one panel between at least one of the end frame supports, the center support and the header support.

Figure 35:
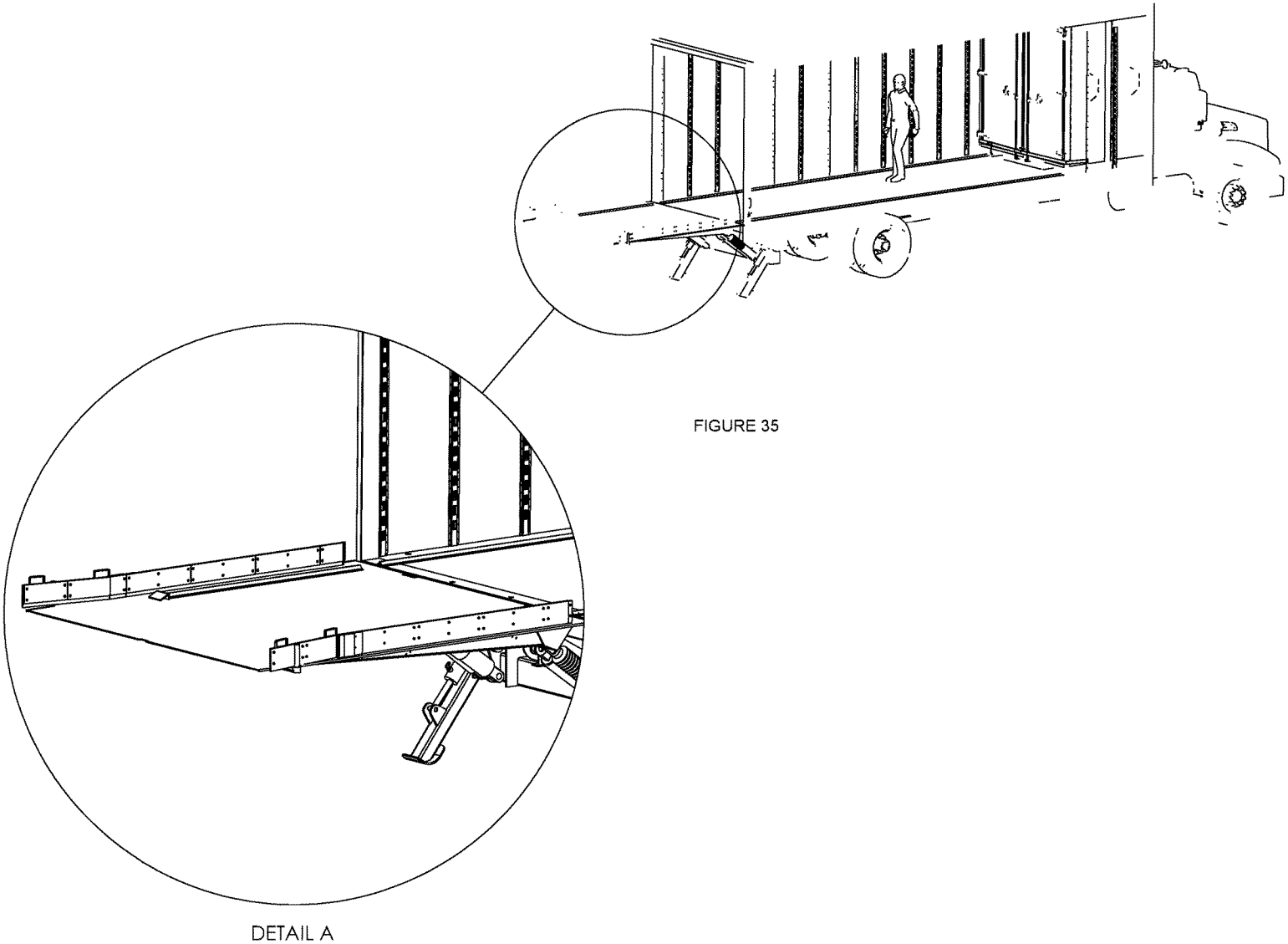
FIG. 35 depicts a truck with a liftgate and depicting the guide rails on the liftgate.
Figure 36:
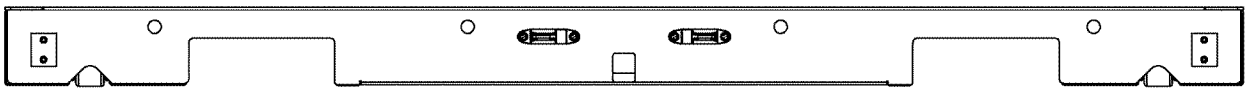
FIGS. 36-37 depict a base.
Figure 37:
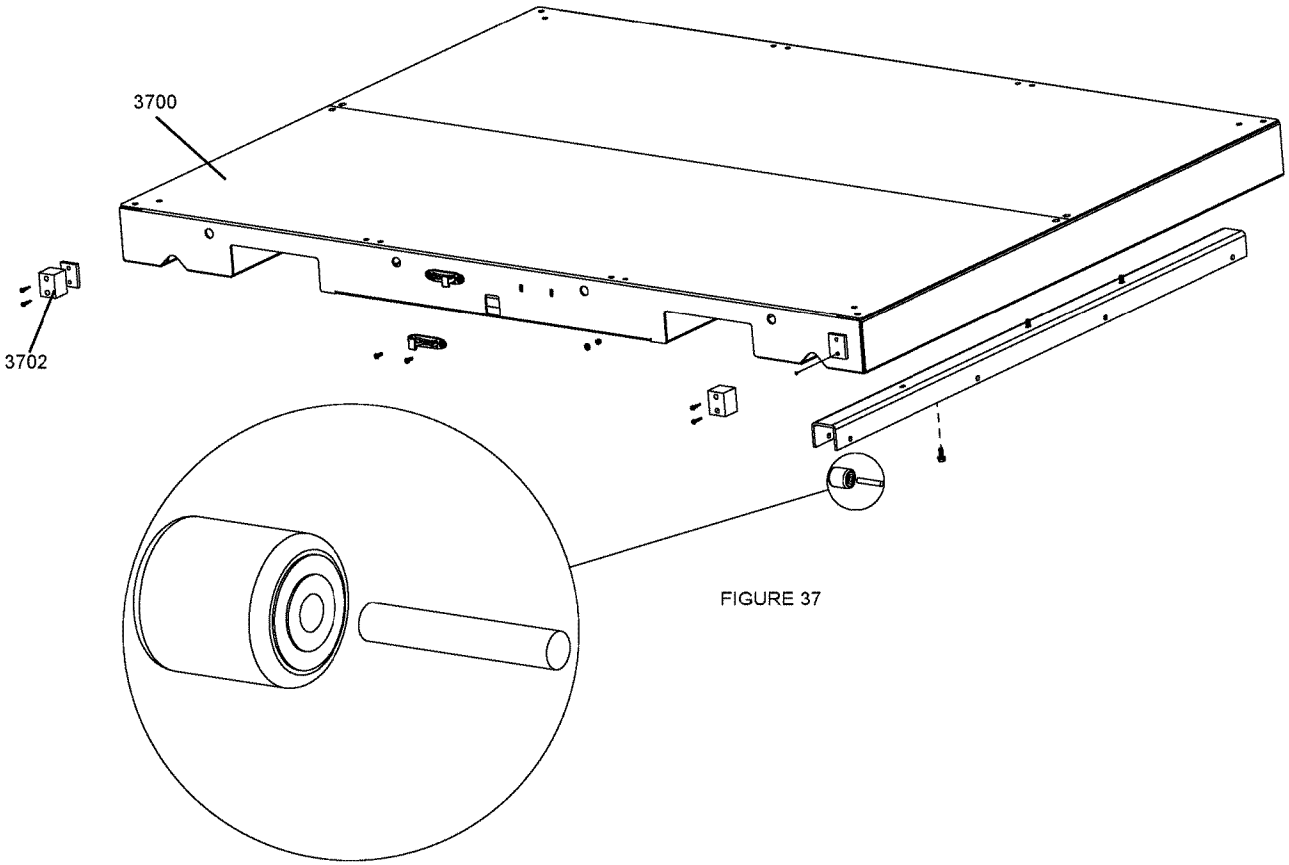
Figure 38:
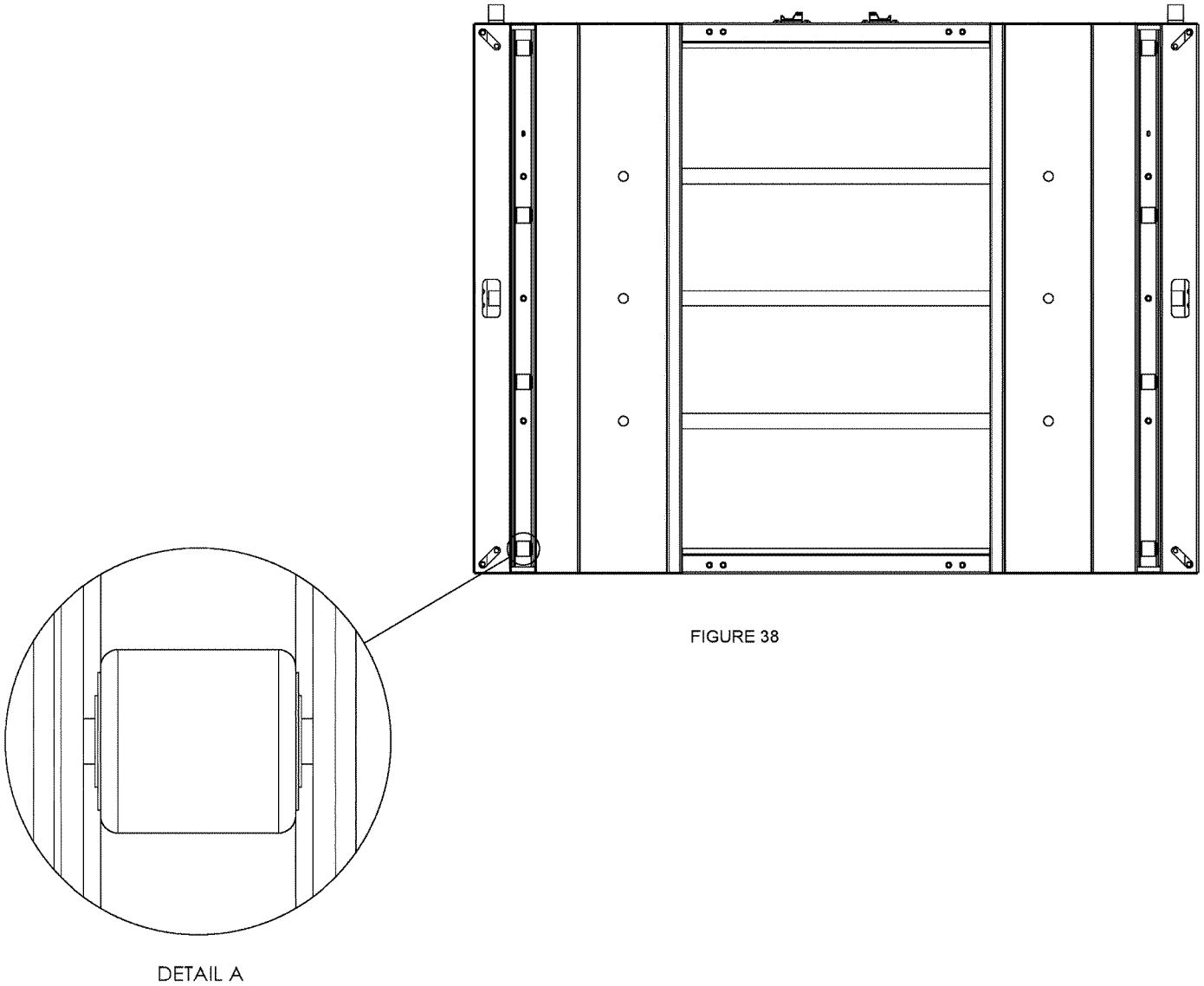
FIG. 38 depicts a bottom view of a base with a rounded rectangular wheel.
Figure 41:
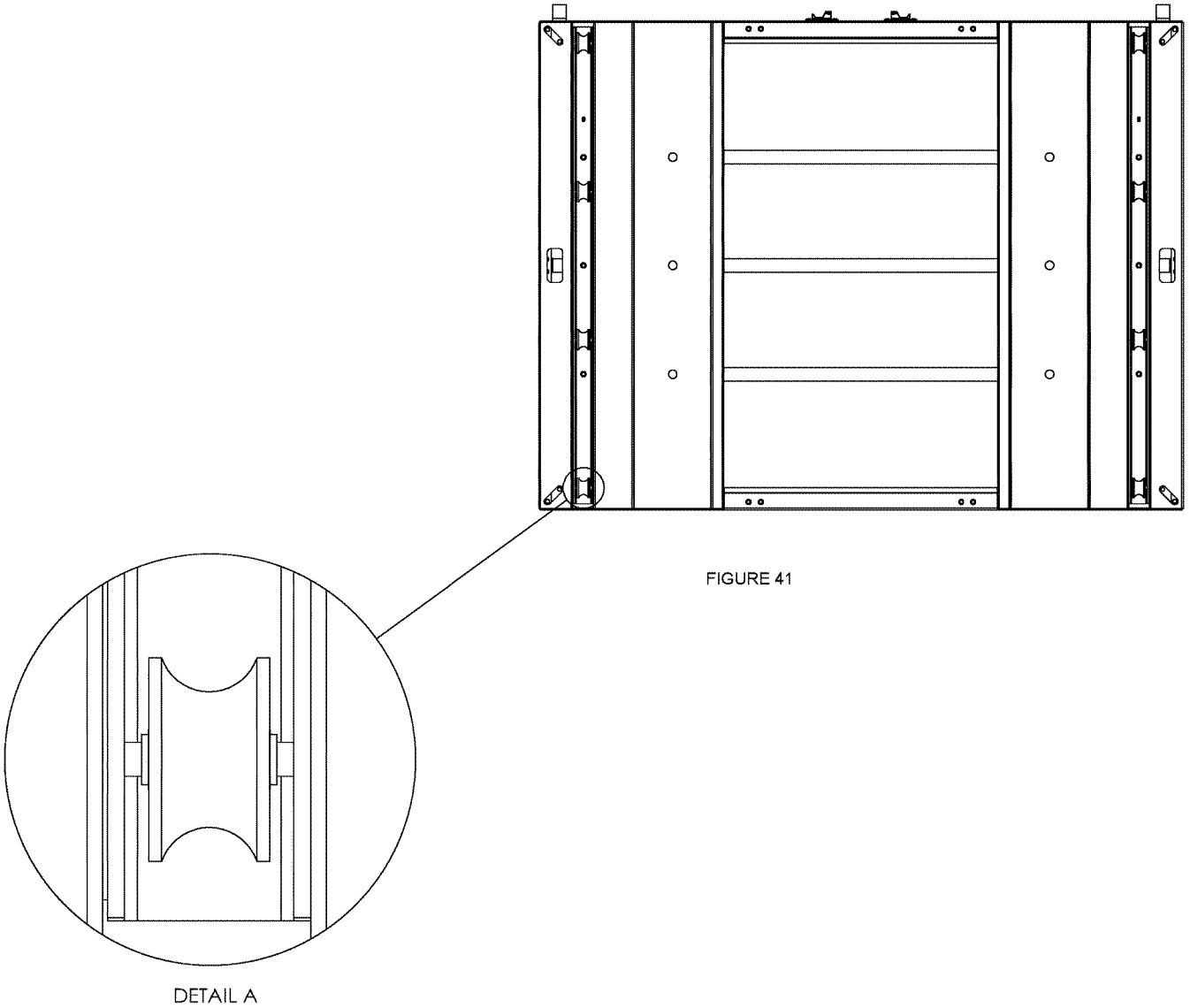
FIG. 41 depicts a bottom view of a base with round groove wheels.
Figure 43:
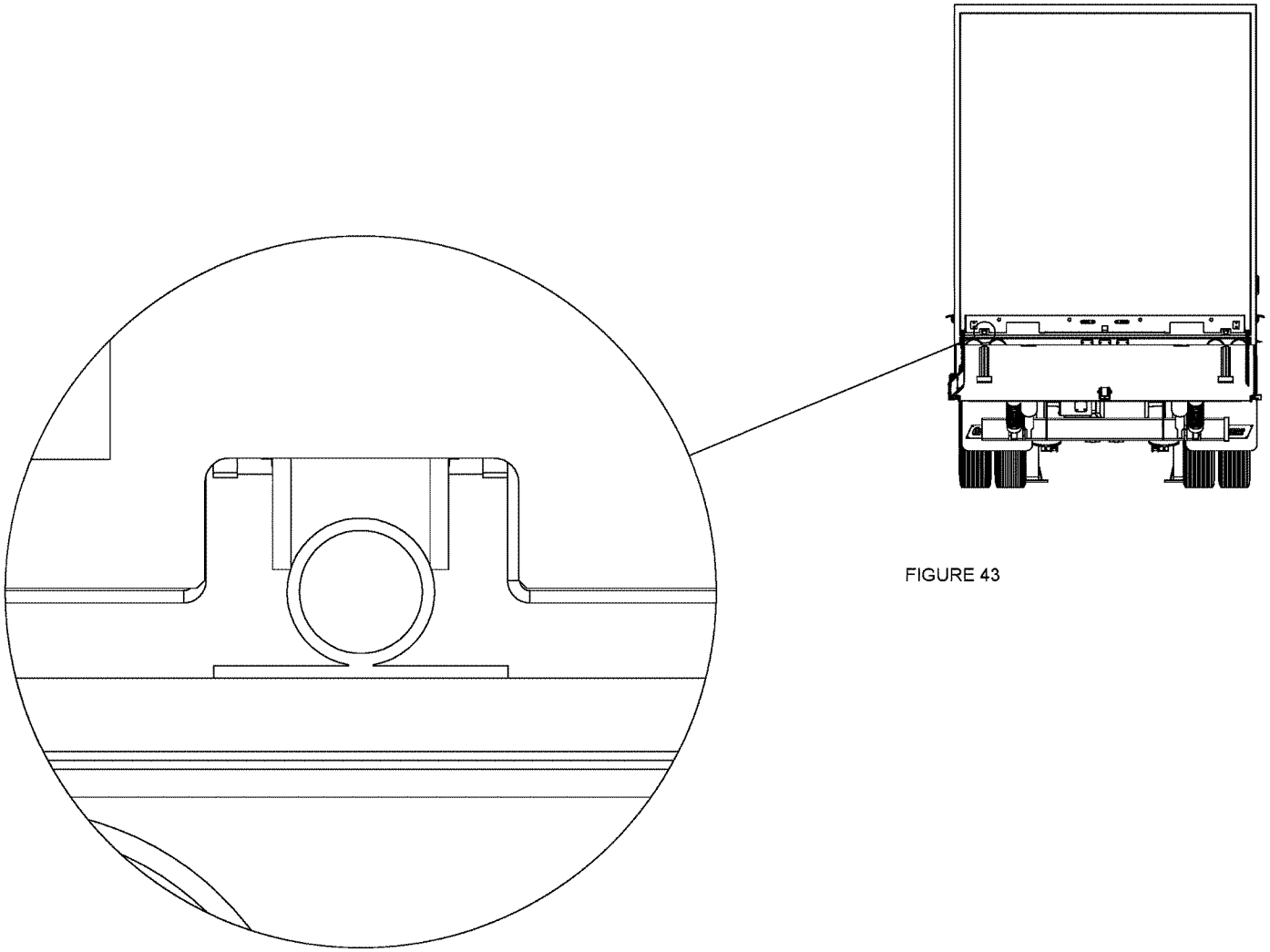
FIG. 43 depicts a back view of a truck with a circular tube shaped track and a round groove wheel.

The pulley system may utilize a nylon strap but it is also envisioned, by way of example, that many other things could be used, such as a Steel Cable, rope or chain. The first open bottom channel and second open bottom channel may be sized to receive a portion of a lifting device. For example, they may be sized to receive the fork portion of a fork lift. The present invention envisions using many different types of lifting devices. The base and the panels generally form a cargo cube that is (1) 60"×96"×107"; (2) 72"×96"×107"; OR 96"×96"×107." This is by example only and it may be any size. As shown in FIG. 35, there is also shown a picture of a hydraulic (3500) that will lift a lift gate up and down.

The present invention also envisions a variety of support on the interior of the panels. While the Figures depicts examples of top cross supports, center supports, side supports and header supports, It noted the location and number and location of supports may be varied without departing from the scope of the present invention.

The present invention allows for a cargo container that when empty, a user may easily disassemble in order to provide more efficient transportation. A cargo container base may be constructed out of aluminum or steel. Sides, door, and top of a cargo container are constructed out of aluminum, polyethylene, wood, and steel. The panels having S-shaped ends is also a very important feature of the present invention, as it allows for easy assembly and disassembly and also allows for the panels to expand and contract in heat or extreme cold. The panels having S-shaped ends also prevents water from dripping down at the end of the panel. This is very important, because cargo frequently sits in extreme heat or cold and the contents may expand or contract. If the sides of the panel are not able to do this, they may break and damage valuable cargo.

The present invention also allows for easy installation and removal of the tracks to allow for bases to slide along the tracks when in use. The tracks may also be easily removed to allow for stand pallets to be utilized. In this way, the installation and removal of the tracks is very flexible.

I claim:

1. A modular shipping container apparatus comprising:

a base, each base having two support portions, each of the two support portions having two substantially open top rectangular shaped spaces each having a bottom side, a left side and a right side and at least one set of base holes in at least one of the left side and the right side;

at least one wheel assembly between the two substantially open top rectangular shaped spaces, wherein the at least one wheel assembly has a substantially open bottom rectangular piece with at least one set of wheel assembly holes and at least one wheel with a center opening, wherein the at least one wheel assembly is retained between the two substantially open top rectangular shaped spaces by at least one bar through the at least one set of base holes, the at least one set of wheel assembly holes and the center opening of each of the wheels;

at least two tracks for attachment to a bottom interior of a shipping container, wherein at least a portion of each of the at least one wheel assemblies slides along one of the at least two tracks attached to the bottom interior of a shipping container;

wherein the at least two tracks have a bottom flat portion and a raised portion, wherein the flat portion has at least two openings and the at least two tracks are removably attached to at least one of the inside of a shipping container and the inside of a liftgate of a shipping container by a fastener attached through each of the least two openings and into at least one of the inside of a shipping container and the inside of a liftgate of a shipping container.

2. A modular shipping container apparatus, comprising:

a base, each base having two support portions, each of the two support portions having two substantially open top rectangular shaped spaces each having a bottom side, a left side and a right side and at least one set of base holes in at least one of the left side and the right side;

at least one wheel assembly between the two substantially open top rectangular shaped spaces, wherein the at least one wheel assembly has a substantially open bottom rectangular piece with at least one set of wheel assembly holes and at least one wheel with a center opening, wherein the at least one wheel assembly is retained between the two substantially open top rectangular shaped spaces by at least one bar through the at least one set of base holes, the at least one set of wheel assembly holes and the center opening of each of the wheels;

at least two tracks for attachment to a bottom interior of a shipping container, wherein at least a portion of each of the at least one wheel assemblies slides along one of the at least two tracks attached to the bottom interior of a shipping container, at least four end frame supports attached substantially perpendicular to the base, wherein each of the end frame supports has a substantially closed square portion with four sides and having outer extensions extending from two of the four sides and an additional support extending from the junction of the remaining two of the four sides of the substantially closed square portion, wherein the additional support has two substantially L-shaped portions that are substantially parallel to the outer extensions and each of the at least four end frame supports having a corner support that is substantially parallel to the junction;

at least three panels, wherein each of the panels has two S-shaped ends and at least one of the two S-shaped ends is interposed between one of the two substantially L-Shaped portions that are substantially parallel to the outer extensions;

at least three rectangular frames each being removably attached to a corner support;

a top attached to the at least three rectangular frames;

at least one door, each at least one door attached by at least one hinge to one of the outer extensions of one of the at least four closed end frame supports.

3. A modular shipping container apparatus as in claim 2, further comprising a ratchet extension extending from the corner support.

4. A modular shipping container apparatus as in claim 2, further comprising a female threaded hole, for receipt of a corresponding screw, between the two substantially L-shaped portions that are substantially parallel to the outer extensions and a brace having a hole at a first end and a hole at a second end, wherein a first screw is inserted through the hole at a first end and into a female threaded hole of one of the at least four end frame supports and a second screw is inserted through the hole at the second end and into a female threaded hole of another one of the at least four end frame supports.

5. A modular shipping container apparatus as in claim 2, further comprising at least one center support attached to the base between two of the at least four end frame supports, wherein the center support has a closed square center portion with four sides and four corners and center extensions extending from each of the four corners of the closed square center portion, two partially open rectangular portions each between two center extensions and having an opening on a side away from the closed square center portion for the receipt of one of the two S-shaped ends of one of the panels.

6. A modular shipping container apparatus as in claim 5, further comprising two substantially L-shaped portions that each extend from one of the four corners and are substantially perpendicular to the center extensions, wherein the two substantially L-Shaped portions are faced in opposing directions.

7. A modular shipping container apparatus as in claim 5, further comprising a partition having a top, bottom, a first side and a second side, wherein one of the first side and the second side is between and supported in an upright position by the two substantially L-shaped portions.

8. A modular shipping container apparatus as in claim 5, further comprising a partition having a top, bottom, a first side and a second side, wherein one of the first side and the second side is between and supported in an upright position by the two substantially L-shaped portions;

further comprising at least one header support attached to the at least one center support at an end opposite the base and below the top and in communication with the top.

9. A modular shipping container apparatus as in claim 5, further comprising a center support female threaded hole for receipt of a corresponding screw in at least one of the two partially open rectangular portions and a brace having a hole at a first end and a hole at a second end, wherein a first screw is inserted through the hole at a first end and into a center support female threaded hole and a second screw is inserted through the hole at the second end and into a female threaded hole of another center support.

10. A modular shipping container apparatus as in claim 5, further comprising a pulley system assembly attached to the bottom interior of the shipping container and aligned with a center portion opening along a middle front portion of the center portion opening, wherein a portion of the pulley system assembly threads the center portion opening.

11. A modular shipping container apparatus as in claim 2, wherein the at least three rectangular frames extend above the corner support and the at least three panels.

12. A modular shipping container apparatus as in claim 2, further comprising at least one top cross support between at least one of the end frame supports, the center support and the header support.

13. A modular shipping container apparatus as in claim 2, further comprising at least one side support substantially proximate to at least one panel between at least one of the end frame supports, the center support and the header support.

14. A modular shipping container apparatus as in claim 2, further comprising at least two tracks attached to the interior of a liftgate of the shipping container, wherein the at least two tracks attached to the interior of the liftgate align with the at least two tracks attached to the bottom interior of the shipping container and at least a portion of each of the at least one wheel assemblies slides along one of the at least two tracks attached to the interior of the liftgate.

15. A modular shipping container apparatus as in claim 14, wherein the at least two tracks attached to the interior of the liftgate have a stopper at an end of the at least two tracks that is furthest away from the shipping container.

* * * * *